US007441851B2

(12) United States Patent
Liou et al.

(10) Patent No.: US 7,441,851 B2
(45) Date of Patent: Oct. 28, 2008

(54) CIRCUIT OF MULTIPLEXING INKJET PRINT SYSTEM AND CONTROL CIRCUIT THEREOF

(75) Inventors: Jian-Chiun Liou, Hsinchu (TW); Ching-Yi Mao, Hsinchu (TW); Chun-Jung Chen, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 183 days.

(21) Appl. No.: 11/532,012

(22) Filed: Sep. 14, 2006

(65) Prior Publication Data

US 2007/0153034 A1 Jul. 5, 2007

(30) Foreign Application Priority Data

Dec. 29, 2005 (TW) ..... 94147336 A

(51) Int. Cl.
*B41J 29/38* (2006.01)

(52) U.S. Cl. ..... 347/12; 347/5; 347/9

(58) Field of Classification Search ..... 347/5, 347/9, 11, 12, 42, 43, 48, 56
See application file for complete search history.

(56) References Cited

U.S. PATENT DOCUMENTS 5,635,968 A 6/1997 Bhaskar et al.
5,790,140 A * 8/1998 Koizumi et al. ..... 347/12
6,055,624 A 4/2000 Webb et al.
6,176,569 B1 1/2001 Anderson et al.
6,312,079 B1 11/2001 Anderson et al.
6,315,388 B1 11/2001 Goh
6,402,279 B1 6/2002 Torgerson et al.
6,431,677 B1 8/2002 Anderson et al.
6,820,957 B2 * 11/2004 Aihara ..... 347/12

* cited by examiner

*Primary Examiner*—Lam S Nguyen
(74) *Attorney, Agent, or Firm*—Workman Nydegger

(57) ABSTRACT

A circuit of a multiplexing inkjet print system and a control circuit thereof for driving a plurality of jet orifices. A signal generating unit generates an enable signal according to a first clock signal and data. Then, a counter counts according to the enable signal to generate a plurality of time counting signals for N decoders, wherein N is a positive integer equal to or greater than 2. The N decoders decode the received time counting signal to generate N groups of start signals. Moreover, a shift register shifts data according to the enable signal and a second clock signal (or according to the first and the third clock signals) to generate i address signals, wherein i is a positive integer. Therefore, each of the heater circuits is driven under the control of an address signal and one of start signals of each group, thereby driving the corresponding jet orifice.

41 Claims, 50 Drawing Sheets

Fig. 3（prior art）

CIRCUIT OF MULTIPLEXING INKJET PRINT SYSTEM AND CONTROL CIRCUIT THEREOF

CROSS-REFERENCE TO RELATED APPLICATIONS

This non-provisional application claims priority under 35 U.S.C. § 119(a) on Patent Application No(s). 094147336 filed in Taiwan, R.O.C. on Dec. 29, 2005, the entire contents of which are hereby incorporated by reference.

BACKGROUND OF THE INVENTION

1. Field of Invention

The present invention relates to an inkjet print technology, and more particularly to a circuit of a multiplexing inkjet print system and a control circuit thereof.

2. Related Art

Along with the progress of science and technology, inkjet print technology tends to develop an inkjet chip having high resolution, high print speed, and a large number of jet orifices, so as to achieve the application in more sophisticated fields. Ink drop of smaller size can achieve a higher print resolution. However, under the same conditions, if the resolution is improved, the print speed is lowered. Thus, in order to improve the print speed and the print resolution in sync, the most effective way is to increase the number of the jet orifices on a single inkjet chip.

In the circumstance of thermal inkjet printing, each ink drop generator is actuated by controlling the current passing through a resistance element. Here, the resistance element generates heat in response to the current, thereby heating the ink in a vaporizing cavity nearby the resistance element, so as to boil the ink to generate steam bubbles. As the steam bubbles expand, the ink is pushed toward the jet orifices and forms droplets at the top end of the jet orifices. When the steam bubbles keep expanding, the droplets may get rid of the surface tension of the ink under the pressure of the steam bubbles and then are spurted out through the jet orifices.

As for a conventional inkjet printhead with a small number of jet orifices, the operating state of a heating resistor is determined by the on/off of the external contacts. When such as a switching element of a field-effect transistor (FET) is driven by a gate, the current passes through the heating resistor, making the heating resistor generate heat to heat the ink, thus spurting ink out through the jet orifices. However, in this one-to-one driving manner, when the number of the required jet orifices increases, the number of the external contacts increase correspondingly, such that the manufacturing cost of the printhead and print device raises and the fabricating and assembling thereof also become more difficult.

Therefore, a two-dimensional matrix driving manner is developed, in which a plurality of address lines forms the first dimension and a plurality of power lines forms the second dimension, such that the number of the jet orifices is the product of the number of the address lines and the number of the power lines. One end of the heating resistor is electrically connected to a power line and the other end thereof is electrically connected to the drain of an FET. Moreover, the source of the FET is electrically connected to ground and the gate thereof is electrically connected to the address line. Only when the address line corresponding to the heating resistor turns on the FET connected thereto and the power line electrically connected thereto provides a proper voltage or current, the heating resistor starts operating, as shown in U.S. Pat. No. 5,635,968. As for an inkjet printhead adopting the two-dimensional matrix driving manner, generally 200~300 jet orifices are provided, and when more jet orifices are required, the number of the external contacts may also increase.

Thus, in order to satisfy the requirement of 400 or more jet orifices, a three-dimensional matrix driving manner is developed to greatly increase the number of the jet orifices without greatly increasing the number of the external contacts.

Here, the three-dimensional matrix driving manner is achieved by adding a select line to the two-dimensional matrix driving architecture constituted by an address line and a power line. Referring to FIG. 1, in each of the heater circuits, one end of the heating resistor R is electrically connected to a power line and the other end thereof is electrically connected to the drain of a first FET M1. The source of the first FET M1 is electrically connected to ground and the gate thereof is electrically connected to the source of a second FET M2. The drain and gate of the second FET M2 are respectively electrically connected to an address line LA and a select line LQ. When the address line LA and select line LQ are both at a high electric potential, the first FET M1 is turned on and meanwhile the power line LP also provides a proper voltage or current. At this time, the heating resistor R starts operating. Here, the number of the jet orifices is the product of the number of the select lines, the number of the address lines, and the number of the power lines, as shown in U.S. Pat. No. 6,176,569 and U.S. Pat. No. 6,431,677.

As for another similar architecture adopting a three-dimensional matrix driving manner, referring to FIG. 2, effective lines LE constitute the third dimension, and the number of the jet orifices is the product of the number of the effective lines LE, the number of the address lines LA, and the number of the power lines LP, as shown in U.S. Pat. No. 6,402,279. In practice, the above-mentioned architecture may form 37 electric contacts for the printhead when 416 jet orifices are provided.

The above three-dimensional matrix driving manner still has limitations, i.e., though the increase of the number of the select lines or effective lines that constitute the third dimension may reduce the electric contacts between the printhead and the host, the heater circuit becomes more complicated. That is, in addition to using the two FETs to control the operating state of the heating resistor, more FETs (such as FETs M3, M4, M5 in FIG. 1 and FET M6 in FIG. 2) are required to provide the discharge function, so that the first FET may not be turned on by noises or unexpected coupling voltage, thereby avoiding operation mistakes when the heating resistor stops working.

In order to further increase the jet orifices and reduce the electric contacts, a manner of sequence input is adopted to provide 640 jet orifices, which requires only 26 electric contacts to the host. The architecture of the related driving circuit can refer to U.S. Pat. No. 6,312,079. However, such a data input manner requires a fast semiconductor device to process a huge amount of sequence input data. Moreover, high-pressure drive is required to provide energy for ink jet, so the problems such as high power consumption, complicated process, and high cost still exist.

In another three-dimensional matrix driving manner, the power line LP, address line LA, and address start line LD constitute the drive of three-dimensional matrix. Referring to FIG. 3, in each of the heater circuits, the heating resistor R is disposed between the power line LP and the drain of a power transistor M7. The address line LA and the address start line LD are electrically connected to the gate of the power transistor M7 through a logic element. When the address line LA and address start line LD are both of logic low signal "0", the logic high signal "1" is generated after the operation of the logic element, so as to turn on the power transistor M7. Meanwhile, the power line LP also provides a proper voltage or current, and then the heating resistor R starts operating. Meanwhile, the heating resistors R connected to the same power line LP are turned on in sync to accelerate printing rate. However, the printhead control circuit is constituted of decoders, and image data is designated to the corresponding jet orifices after being decoded by the decoders, so plenty of control signal input is required.

Although in the conventional art, several three-dimensional matrix driving manners are provided to accelerate printing rate and improving the print resolution in sync, and to greatly increase the jet orifices without greatly increasing the number of the external contacts, the aforementioned three-dimensional matrix driving manners have limitations, such as complicated circuit structure, high power consumption, high cost, the increase of the contacts for the control signals. Moreover, along with the progress of science and technology, the number of the jet orifices provided by the conventional art under an acceptable number of electric contacts will not satisfy the requirements. Therefore, in order to improve the print speed and print resolution at the same time, it remains a subject for the relevant researchers to increase the number of the jet orifices in a single inkjet chip without greatly increasing the number of the external contacts and meanwhile avoiding increasing the power consumption, circuit complexity, and area.

SUMMARY OF THE INVENTION

In view of the above, the main objective of the present invention is to provide a circuit of a multiplexing inkjet print system and a control circuit thereof, so as to solve the problems in the prior art.

Thus, in order to achieve the above objective, the present invention provides a control circuit of a multiplexing inkjet print system, which comprises a signal generating unit, a shift register, a counter, and N decoders, wherein N is a positive integer equal to or greater than 2.

The signal generating unit is electrically connected to the shift register and the counter. The counter is electrically connected to each of the decoders. The shift register and each decoder are electrically connected to each of the heater circuits, so as to control the drive of the corresponding heater circuit. The signal generating unit is used to generate an enable signal according to a first clock signal and data. The shift register is used to shift data according to the enable signal and a second clock signal, so as to generate i address signals, wherein i is a positive integer. The counter is used to count according to the enable signal, so as to generate a plurality of time counting signals. Each decoder is used to receive and decode a portion of the time counting signals, so as to generate a group of start signals, wherein N is a positive integer equal to or greater than 2. As such, the drive control of the heater circuits is achieved through the random combinations of the address signals and each group of the start signals, i.e., each of the heater circuits is driven under the control of an address signal and one of the start signals of each group.

Further, the signal generating unit is electrically connected to the shift register. The counter is electrically connected to each decoder. The shift register and each decoder are electrically connected to each of the heater circuits, so as to control the drive of the corresponding heater circuit. The signal generating unit is used to generate an enable signal according to a first clock signal and data. The shift register is used to shift data according to the first clock signal and a third clock signal, so as to generate i address signals, wherein i is a positive integer. The counter is used to count according to the enable signal, so as to generate a plurality of time counting signals accordingly. Each decoder is used to receiving a portion of the time counting signals and decode the received portion of the time counting signals to generate a group of start signals, wherein N is a positive integer equal to or greater than 2. As such, the drive control of the heater circuits is achieved through the random combinations of the address signals and each group of the start signals, i.e., each of the heater circuits is driven under the control of an address signal and one of the start signals of each group. Here, the third clock signal is half of the first clock signal.

Moreover, the number of the heater circuits is the product of the number of the address signals and the number of the start signals of each group.

The signal generating unit mainly comprises a plurality of flip-flops and a plurality of logic elements. The shift register mainly comprises a plurality of flip-flops. The counter mainly comprises a plurality of flip-flops and a plurality of logic elements. The decoders can be n-to-$2^n$ decoders, so as to decode n time counting signals to generate $2^n$ start signals, wherein n is a positive integer.

Moreover, the flip-flop in use can be constituted of a complementary metal-oxide-semiconductor (CMOS) FET, so as to reduce the power consumption and correspondingly reduce the power consumption of the control circuit of the whole inkjet chip to the minimum.

The present invention further discloses a circuit of a multiplexing inkjet print system for driving a plurality of jet orifices, which comprises a control circuit and an inkjet module. The control circuit comprises a signal generating unit, a shift register, a counter, and N decoders, and N is a positive integer equal to or greater than 2. The inkjet module comprises a plurality of heater circuits respectively corresponding to a jet orifice, wherein each of the heater circuits has an AND gate logic switch, a transistor switch, and a resistance element.

The signal generating unit is electrically connected to the shift register and the counter. The counter is electrically connected to each decoder. The shift register and each decoder are electrically connected to each of the heater circuits, so as to control the drive of the heater circuit. That is, in each of the heater circuits, the AND gate logic switch is electrically connected to the shift register and the decoder. The gate of the transistor switch is electrically connected to the output end of the corresponding AND gate logic switch, and the drain thereof is electrically connected to one end of the resistance element. An appropriate voltage or current is applied to the other end of the resistance element, such that the AND gate logic switch turns on the transistor switch under the control of the control circuit, thereby driving the resistance element to generate heat.

The signal generating unit is used to generate an enable signal according to a first clock signal and data. The shift register is used to shift data according to the enable signal and a second clock signal, so as to generate i address signals, wherein i is a positive integer. The counter is used to count according to the enable signal, so as to generate a plurality of time counting signals. Each decoder is used to receive a portion of the time counting signals and decode the received portion of the time counting signals to generate a group of start signals, wherein N is a positive integer equal to or greater than 2. Each of the AND gate logic switches is used to perform logic operation on an address signal and one of the start signals of each group, so as to generate a drive signal accordingly. The transistor switch is turned on according to the drive signal. The resistance element is used to generate heat when the transistor switch is turned on, thereby driving the corresponding jet orifice. As such, the drive control of the heater circuits is achieved through the random combinations of the address signals and each group of the start signals, i.e., each of the heater circuits is driven under the control of an address signal and one of the start signals of each group.

Further, the signal generating unit is electrically connected to the shift register. The counter is electrically connected to each decoder. The shift register and each decoder are electrically connected to each of the heater circuits, so as to control the drive of the corresponding heater circuit. The signal generating unit is used to generate an enable signal according to a first clock signal and data. The shift register is used to shift data according to the first clock signal and a third clock signal, so as to generate i address signals, wherein i is a positive integer. The counter is used to count according to the enable signal, so as to generate a plurality of time counting signals. Each decoder is used to receive a portion of the time counting signals and decode the received portion of the time counting signals to generate a group of start signals, wherein N is a positive integer equal to or greater than 2. Each of the AND gate logic switches is used to perform logic operation on an address signal and one of the start signals of each group, so as to generate a drive signal accordingly. The transistor switch is turned on according to the drive signal. The resistance element is used to generate heat when the transistor switch is turned on, thereby driving the corresponding jet orifice. As such, the drive control of the heater circuits is achieved through the random combinations of the address signals and each group of the start signals, i.e., each of the heater circuits is driven under the control of an address signal and one of the start signals of each group.

Moreover, the number of the heater circuits is the product of the number of the address signals and the number of the start signals of each group. That is, the number of the jet orifices is the product of the number of the address signals and the number of the start signals of each group.

The signal generating unit mainly comprises a plurality of flip-flops and a plurality of logic elements. The shift register mainly comprises a plurality of flip-flops. The counter mainly comprises a plurality of flip-flops and a plurality of logic elements. The decoders can be n-to-$2^n$ decoders, so as to decode n time counting signals to generate $2^n$ start signals, wherein n is a positive integer.

The transistor switch can be an FET with a high channel width-to-length ratio, so as to reduce the series parasitic resistance, thereby concentrating the power on the thermal resistance. Moreover, for an inkjet printhead of small droplets, as the printhead requires a low power to spurt out a single droplet, the power generated by the resistance element can be lowered by increasing the resistance of the resistance element without increasing the voltage provided by the host.

Further, the transistor switch can also be an asymmetric MOSFET for getting low driving transistor resistance and small transistor area. In addition, the drain of the asymmetric MOSFET is a double diffused drain (DDD), and the source thereof is of a low voltage N+ type diffuse structure, so as to reduce the parasitic resistance.

Moreover, the flip-flop in use can be constituted of CMOSFET, thus reducing the power consumption and correspondingly reducing the power consumption of the control circuit of the whole inkjet chip to the minimum.

The features and practice of the preferred embodiments of the present invention will be illustrated in detail below with the accompanying drawings.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

Figure 1:
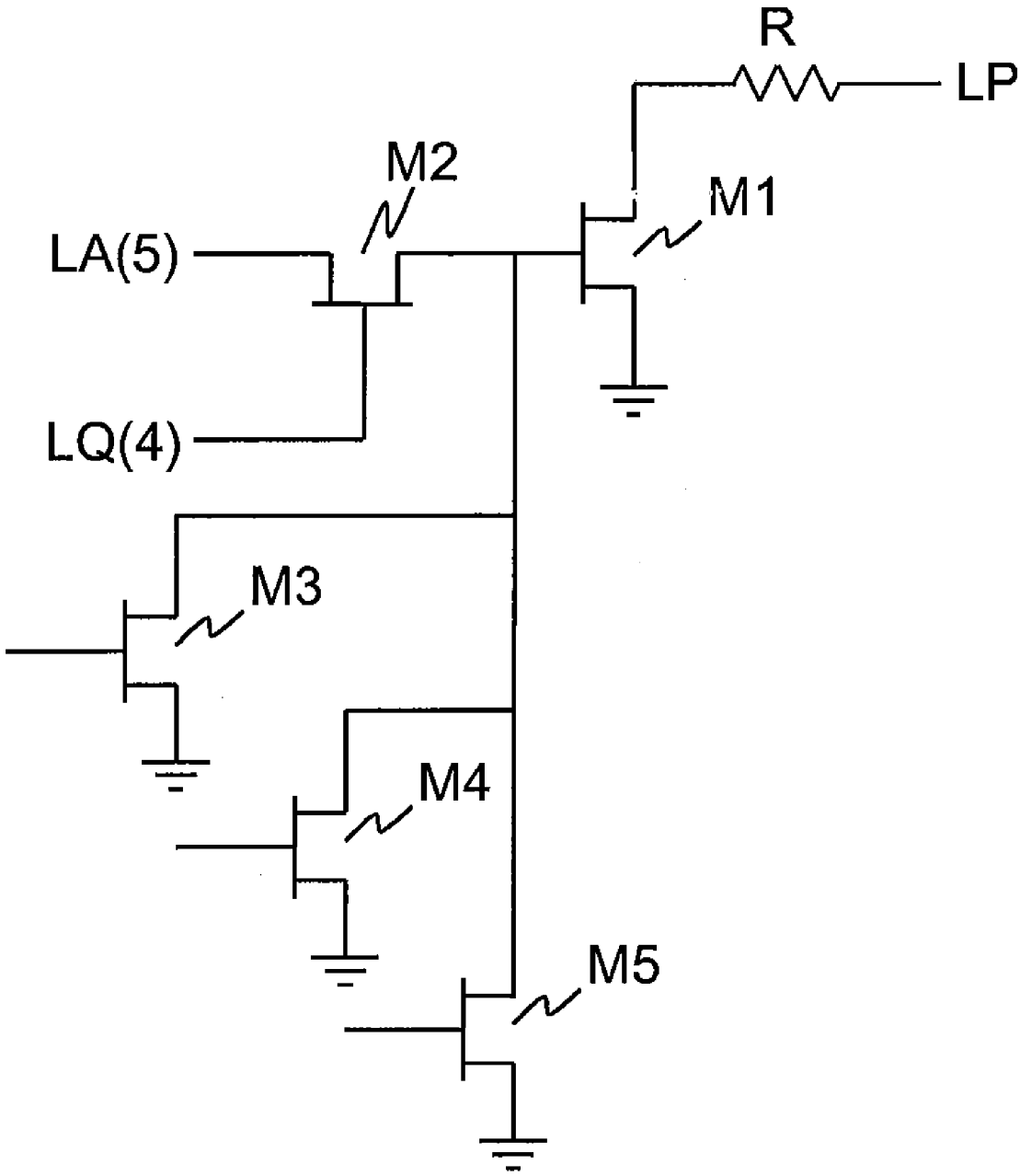
Fig. 1 (prior art)
FIG. 1 is a schematic view of the conventional heater circuit.
Figure 2:
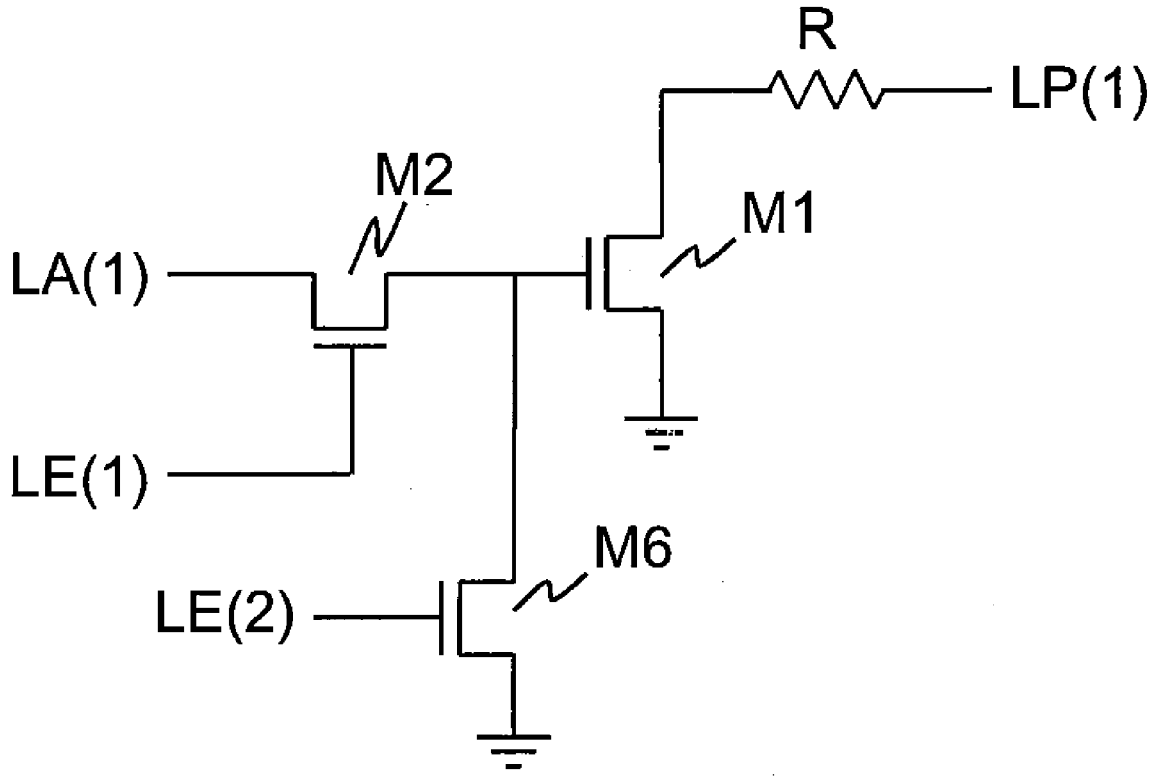
Fig. 2 (prior art)
FIG. 2 is a schematic view of the conventional heater circuit.
Figure 3:
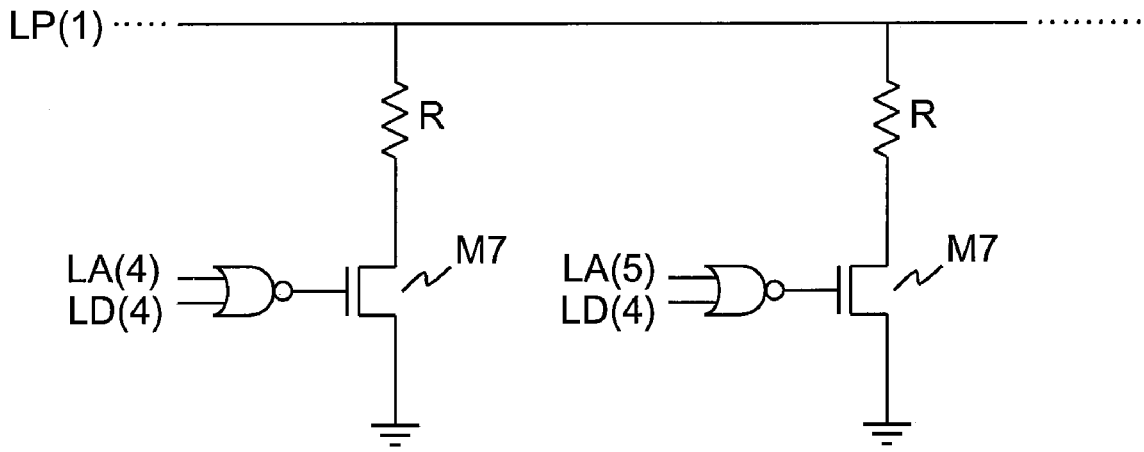
FIG. 3 is a schematic view of the conventional heater circuit.

Embodiments are described below to illustrate the content of the present invention in detail in accompanying with the drawings, in which the same symbols refer to those in the drawings.

Figure 4:
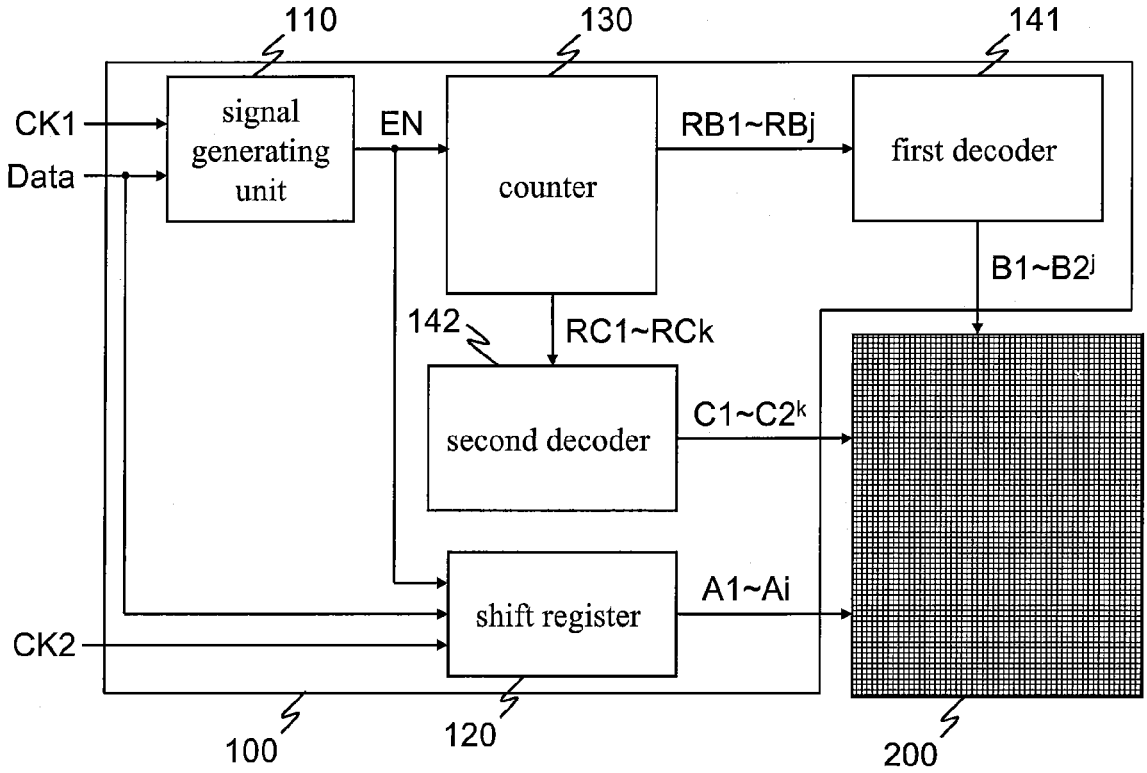
FIG. 4 is a schematic view of the circuit of a multiplexing inkjet print system according to the first embodiment of the present invention.

FIG. 4 is a circuit of a multiplexing inkjet print system according to an embodiment of the present invention. The circuit includes a control circuit 100 and an inkjet module 200. The control circuit 100 includes a signal generating unit 110, a shift register 120, a counter 130, a first decoder 141, and a second decoder 142.

The signal generating unit 110 is electrically connected to the shift register 120 and the counter 130. The counter 130 is electrically connected to the first decoder 141 and the second decoder 142. The shift register 120, the first decoder 141, and the second decoder 142 are electrically connected to the inkjet module 200 for controlling the print of the inkjet module 200.

The signal generating unit 110 generates an enable signal EN according to a first clock signal CK1 and data Data.

The counter 130 generates a group of time counting signals RB1~RBj, RC1~RCk according to the enable signal EN for counting. The time counting signals RB1~RBj, RC1~RCk are divided into two portions, wherein the time counting signals RB1~RBj of one portion are input into the first decoder 141 to be decoded, so as to generate a group of first start signals B1-B2$^j$; while the time counting signals RC1~RCk of the other portion are input into the second decoder 142 to be decoded, so as to generate a group of second start signals C1~C2$^k$. In other words, the time counting signals generated by the counter are divided into several portions according to the number of the decoders, and then respectively input into the corresponding decoders to be decoded for obtaining groups of start signals accordingly.

The shift register 120 shifts data Data according to the enable signal EN and a second clock signal CK2, so as to generate a group of address signals A1~Ai.

Further, the operation of the inkjet module 200 is controlled by the address signals A1~Ai, the first start signals B1~B2$^j$, and the second start signals C1~C2$^k$. That is, the drive control of $i\times2^j\times2^k$ heater circuits is achieved through the random combinations of the address signals A1~Ai, the first start signals B1~B2$^j$, and the second start signals C1~C2$^k$, thus controlling the operation of $i\times2^j\times2^k$ jet orifices, wherein i, j, and k are all positive integers.

The signal generating unit 110 mainly includes flip-flops and logic elements.

Figure 5A:
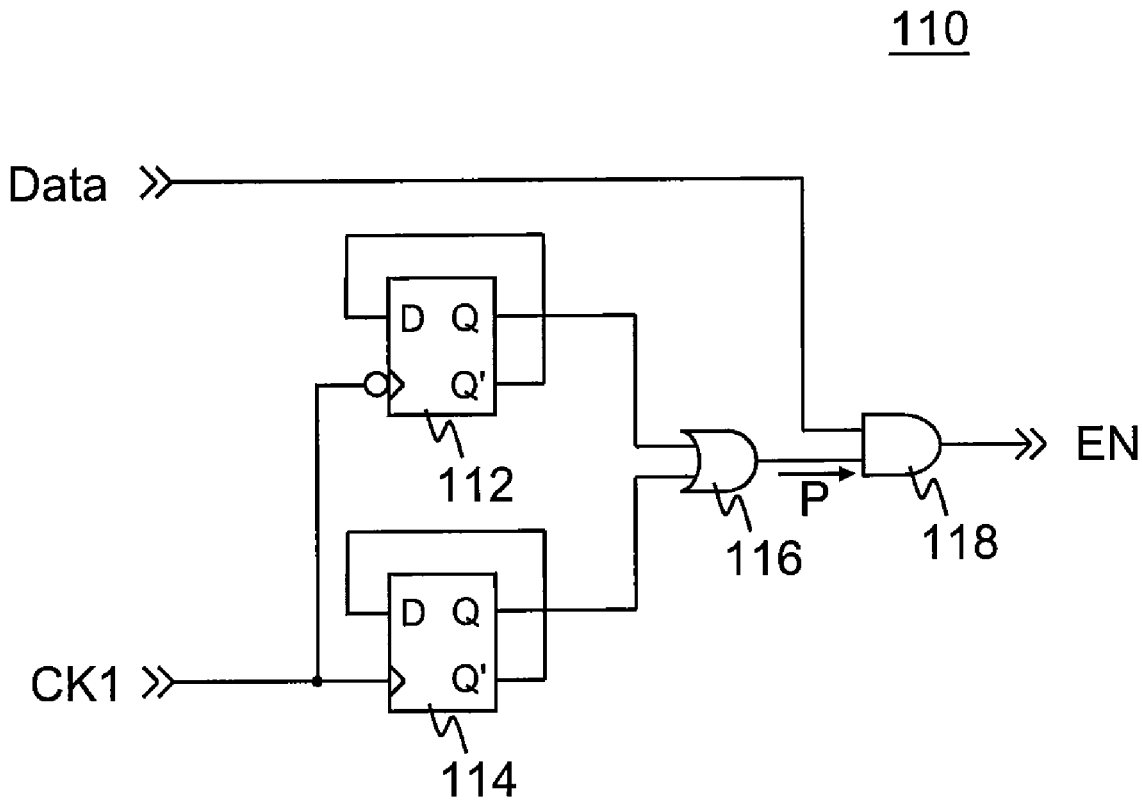
FIG. 5A is a schematic view of the first embodiment of the signal generating unit according to the circuit of a multiplexing inkjet print system of the present invention.

FIG. 5A is a schematic circuit view of an embodiment of the signal generating unit. The signal generating unit 110 includes a first D-type flip flop 112, a second D-type flip-flop 114, an OR gate logic switch 116, and an AND gate logic switch 118.

The first D-type flip-flop 112 and the second D-type flip-flop 114 are connected in parallel, and the output end Q thereof is sequentially connected in series to the OR gate logic switch 116 and the AND gate logic switch 118. That is, the output end Q of the D-type flip-flop (i.e., the first D-type flip-flop 112 and the second D-type flip-flop 114) is electrically connected to the input end of the OR gate logic switch 116. The output end of the OR gate logic switch 116 is electrically connected to the input end of the AND gate logic switch 118. In addition, the inverted output end Q' of each D-type flip-flop (i.e., the first D-type flip-flop 112 and the second D-type flip-flop 114) is fed back to the respective input end D.

The enable signal EN is input into the trigger end of the first D-type flip-flop 112 and the second D-type flip-flop 114, wherein the first D-type flip-flop 112 is of negative-edge trigger and the second D-type flip-flop 114 is of positive-edge trigger. The data Data is input into the AND gate logic switch 118.

Figure 5B:
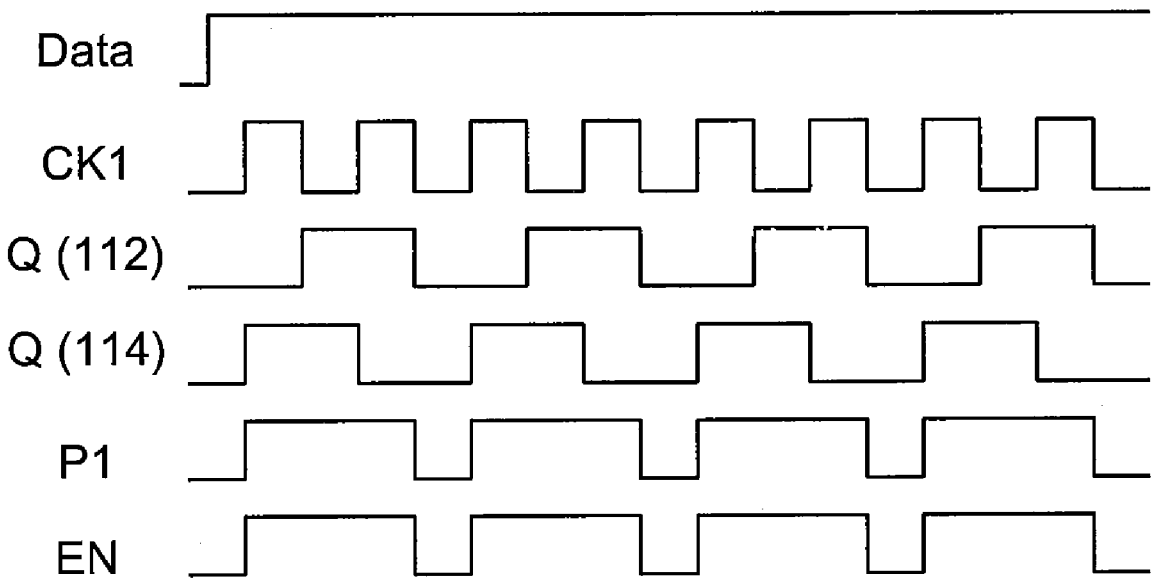
FIG. 5B is a timing diagram of the signal generating unit in FIG. 5A.

After going through the negative-edge trigger of the first D-type flip-flop 112 and the positive-edge trigger of the second D-type flip-flop 114, the first clock signal CK1 is subjected to the logic operation of the OR gate logic switch 116 to obtain a signal P. The signal P and the data Data are subjected to the logic operation of the AND gate logic switch 118 to obtain the enable signal EN, and the timing diagram thereof is shown in FIG. 5B. Referring to FIG. 5B, when the negative-edge of the first clock signal CK1 occurs, the output end Q of the first D-type flip-flop 112 is transited while the output end Q of the second D-type flip-flop 114 remains the same. Otherwise, when the positive-edge of the first clock signal CK1 occurs, the output end Q of the second D-type flip-flop 114 is transited while the output end Q of the first D-type flip-flop 112 remains the same.

Figure 6:
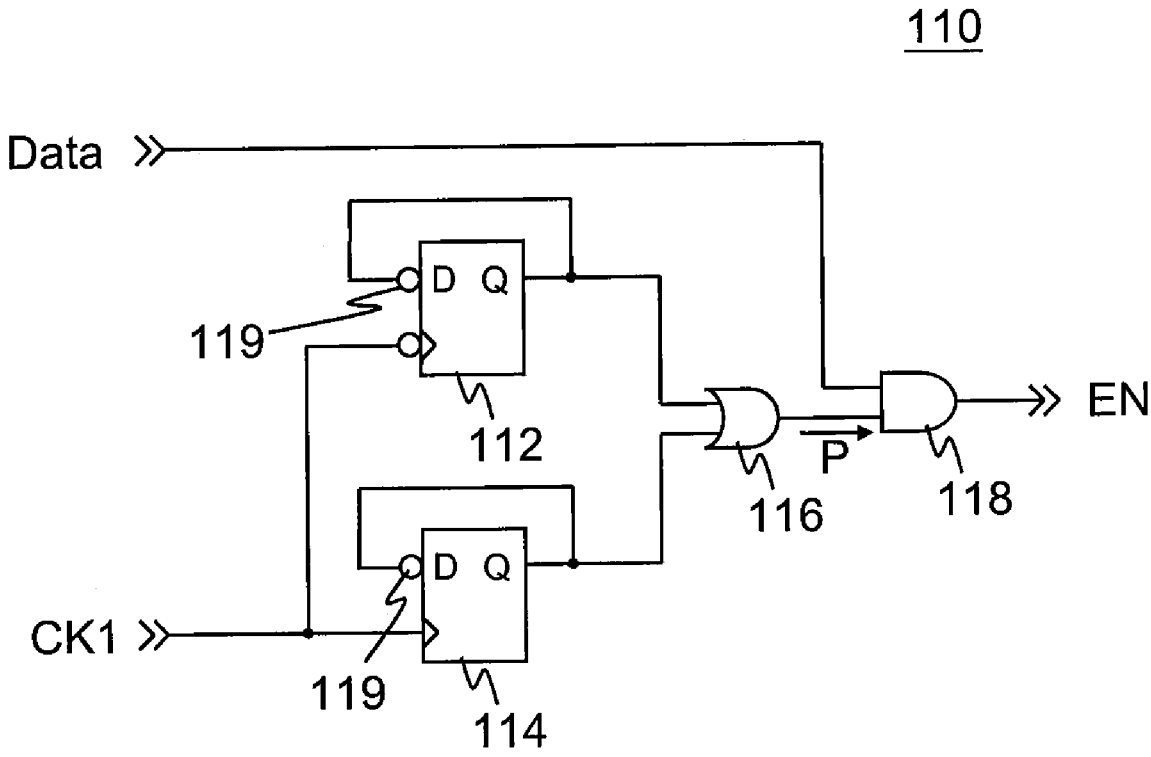
FIG. 6 is a schematic view of the second embodiment of the signal generating unit according to the circuit of a multiplexing inkjet print system of the present invention.

Further, the signal input by, each D-type flip-flop (i.e., the first D-type flip-flop 112 and the second D-type flip-flop 114) into the input end D thereof can also be fed back to the input end D through the output end Q via an inverter 119, as shown in FIG. 6. That is, the output end Q of the D-type flip-flop (i.e., the first D-type flip-flop 112 and the second D-type flip-flop 114) is electrically connected to the input end of the OR gate logic switch 116, and the output end of the OR gate logic switch 116 is electrically connected to the input end of the AND gate logic switch 118. Moreover, the output end Q of each D-type flip-flop (i.e., the first D-type flip-flop 112 and the second D-type flip-flop 114) is fed back to the respective input end D thereof via the inverter 119.

Figure 7A:
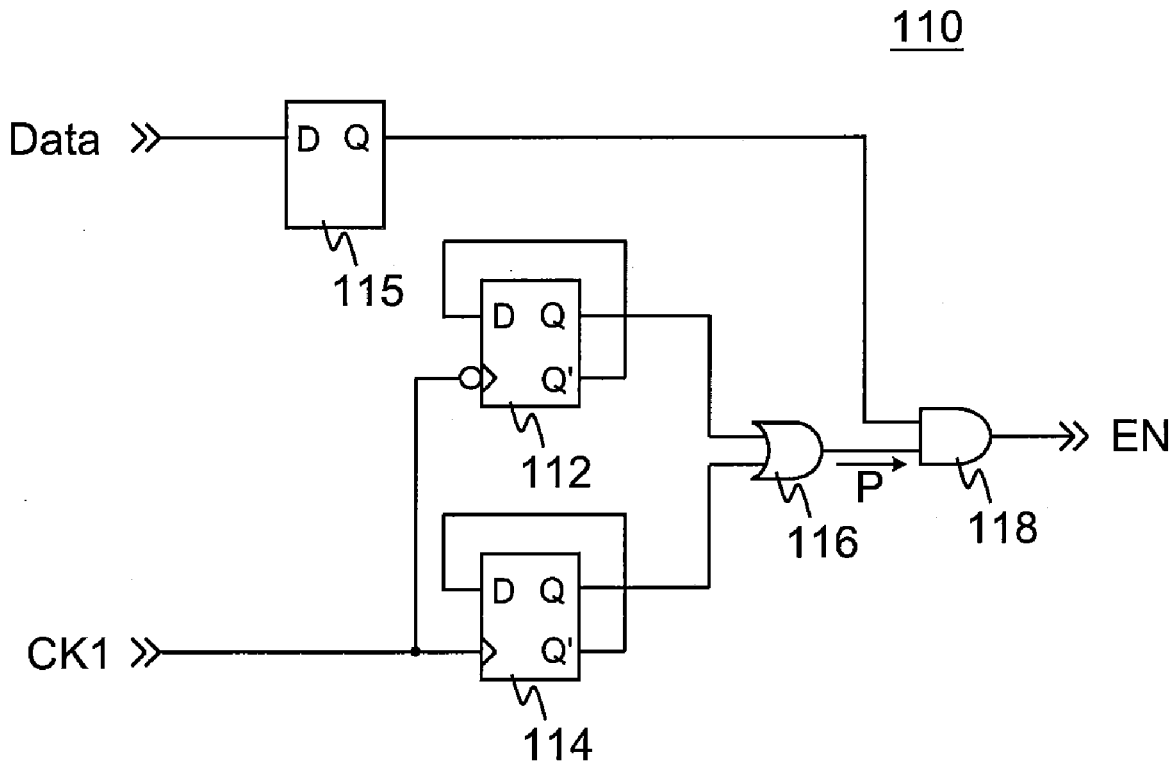
FIG. 7A is a schematic view of the third embodiment of the signal generating unit according to the circuit of a multiplexing inkjet print system of the present invention.
Figure 7B:
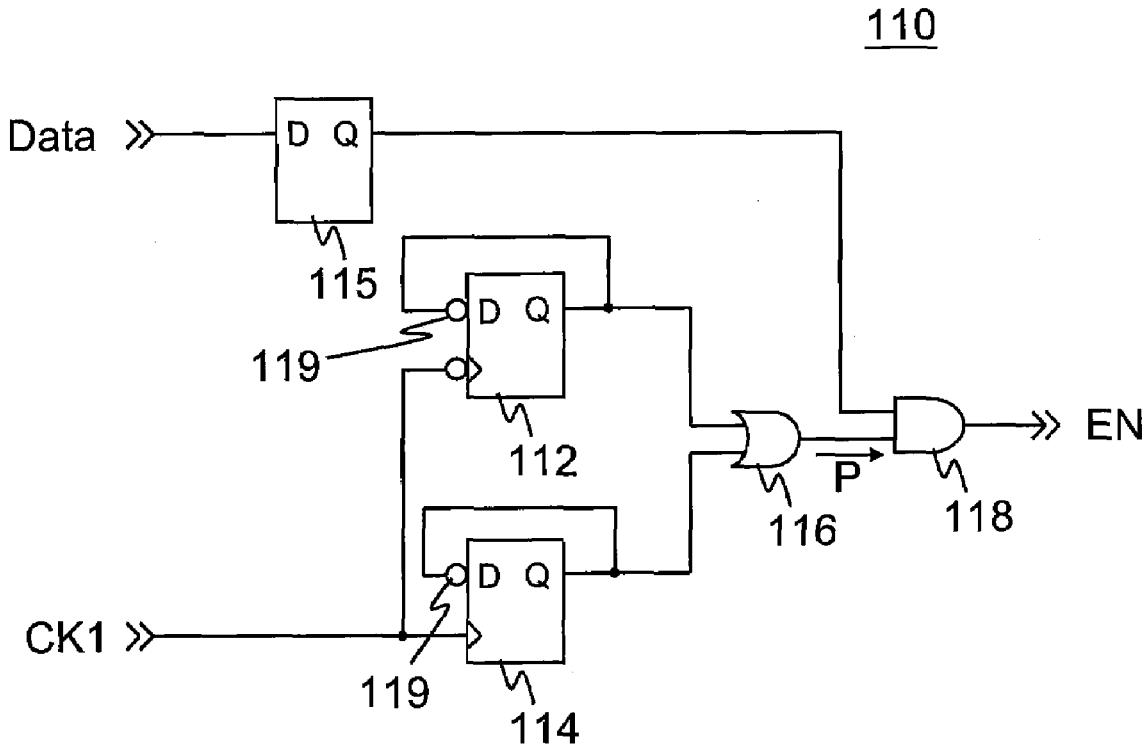
FIG. 7B is a schematic view of the fourth embodiment of the signal generating unit according to the circuit of a multiplexing inkjet print system of the present invention.

Further, an initial third D-type flip-flop 115 can also be used to control providing the data Data. That is, the data Data is input into the input end D of the initial third D-type flip-flop 115, and then connected to the input end of the OR gate logic switch 116 via the output end Q of the initial third D-type flip-flop 115, as shown in FIGS. 7A and 7B.

Figure 8:
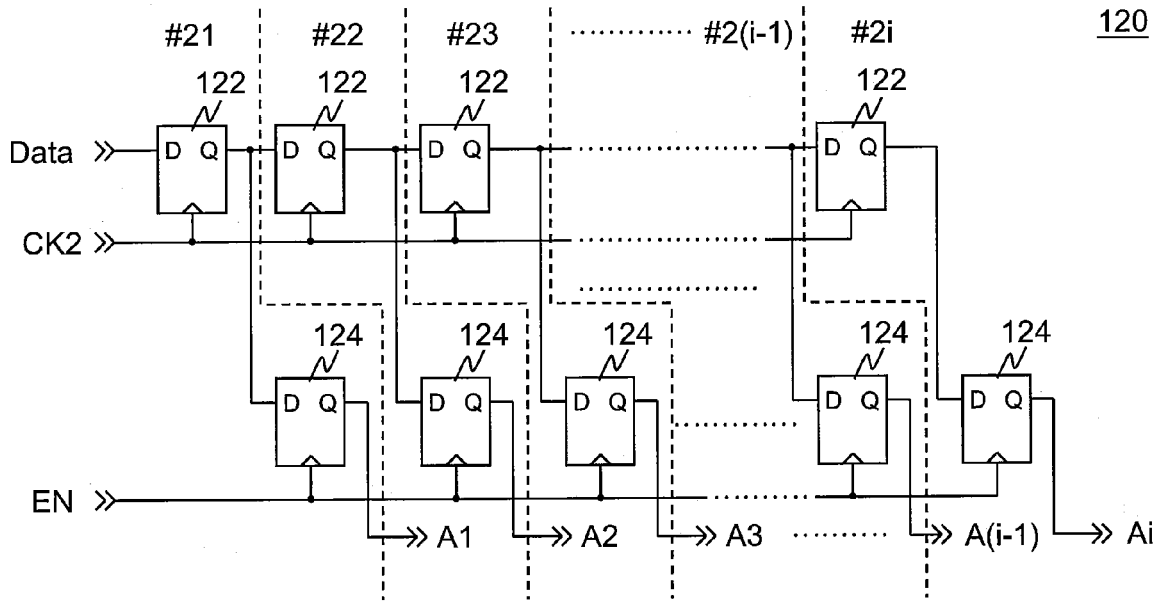
FIG. 8 is a schematic view of the first embodiment of the shift register according to the circuit of a multiplexing inkjet print system of the present invention.

The shift register 120 mainly includes flip-flops. FIG. 8 is a schematic circuit view of an embodiment of the shift register. The shift register 120 comprises i shift sub-circuits (referred to as the first shift sub-circuit to the $i^{th}$ shift sub-circuit #21~#2*i* below for the convenience of illustration). In addition, each shift sub-circuit includes two D-type flip-flops (referred to as a fourth D-type flip-flop 122 and a fifth D-type flip-flop 124 for the convenience of illustration). The fourth D-type flip-flop 122 and the fifth D-type flip-flop 124 both adopt positive-edge trigger. The second clock signal CK2 is input into the trigger end of each fourth D-type flip-flop 122 and the enable signal EN is input into the trigger end of each fifth D-type flip-flop 124. In the first shift sub-circuit #21, the input end D of the fourth D-type flip-flop 122 receives the data Data, and the output end Q thereof is electrically connected to the input end D of the fifth D-type flip-flop 124 and to the input end D of a fourth D-type flip-flop 122 of a shift sub-circuit in the next stage (i.e., the second shift sub-circuit #22). Therefore, the fifth D-type flip-flop 124 outputs the address signal A1 from the output end Q according to the output of the fourth D-type flip-flop 122 and the enable signal EN. Moreover, in the second shift sub-circuit #22, the input end D of the fourth D-type flip-flop 122 is electrically connected to the output end Q of the fourth D-type flip-flop 122 of a shift sub-circuit in the preceding stage (i.e., the first shift sub-circuit #21), and the output end Q thereof is electrically connected to the input end D of the fifth D-type flip-flop 124 and the input end D of the fourth D-type flip-flop 122 of a shift sub-circuit in the next stage (i.e., the third shift sub-circuit #23). Therefore, the fifth D-type flip-flop 124 outputs an address signal A2 from the output end Q according to the output of the fourth D-type flip-flop 122 and the enable signal EN, and so forth, until the $(i-1)^{th}$ shift sub-circuit #2(i−1). In the shift sub-circuit in the last stage (i.e., the $i^{th}$ shift sub-circuit #2*i*), the input end D of the fourth D-type flip-flop 122 is electrically connected to the output end Q of the fourth D-type flip-flop 122 of a shift sub-circuit in the preceding stage (i.e., the $(i-1)^{th}$ shift sub-circuit #2(i−1)), and the output end Q of the fourth D-type flip-flop 122 is only electrically connected to the input end D of the fifth D-type flip-flop 124. The fifth D-type flip-flop 124 outputs an address signal A1 from the output end Q according to the output of the fourth D-type flip-flop 122 and the enable signal EN.

Figure 9:
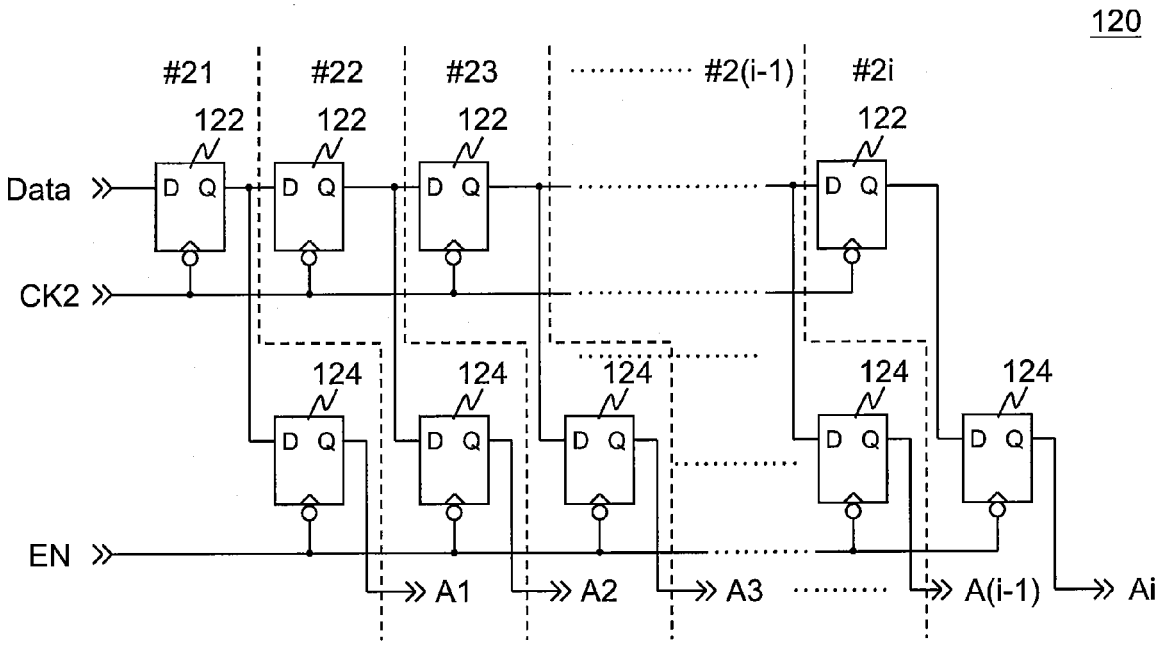
FIG. 9 is a schematic view of the second embodiment of the shift register according to the circuit of a multiplexing inkjet print system of the present invention.

Moreover, in the shift register 120, for the shift sub-circuit in each stage (i.e., the first shift sub-circuit to the $i^{th}$ shift sub-circuit #21~#2*i*), the fourth D-type flip-flop 122 and the fifth D-type flip-flop 124 can both be of negative-edge trigger, that is, the second clock signal CK2 and the enable signal EN are respectively input into the trigger ends of the fourth D-type flip-flop 122 and the fifth D-type flip-flop 124 after being inverted, as shown in FIG. 9.

The counter 130 mainly includes flip-flops and logic elements. FIGS. 10A, 10B, 10C, and 10D are schematic circuit views of an embodiment of the counter. The counter 130 includes k+j counting sub-circuits (referred to as the first counting sub-circuit to the $(k+j)^{th}$ counting sub-circuit #31~#3*k*, #3(k+1)~#3(k+j)). The second to the $(k+j)^{th}$ counting sub-circuits #32~#3(k+j) include an AND gate logic switch 132 and a D-type flip-flop (referred to as a sixth D-type flip-flop 134 for the convenience of illustration). The first counting sub-circuit #31 includes a D-type flip-flop (i.e., the sixth D-type flip-flop 134). In addition, for each counting sub-circuit (i.e., the first counting sub-circuit to the $(k+j)^{th}$ counting sub-circuit #31~#3*k*, #3(k+1), #3(k+2)~#3(k+j−1), #3(k+j)), the output end Q of the sixth D-type flip-flop 134 respectively outputs a time counting signal (i.e., time counting signals RC1, RC2~RCk, RB1, RB2~RB(j−1), RBj).

Figure 10A:
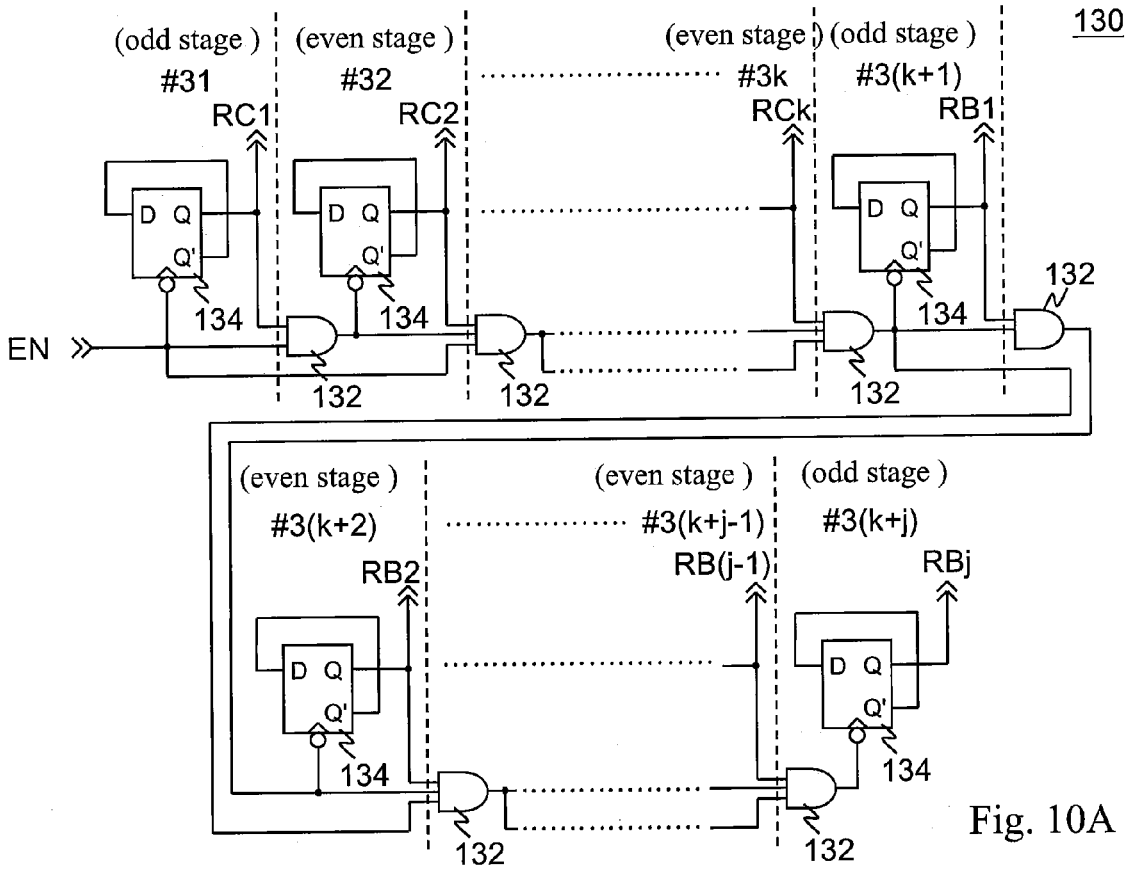
FIG. 10A is a schematic view of the first embodiment of the counter according to the circuit of a multiplexing inkjet print system of the present invention.
Figure 10B:
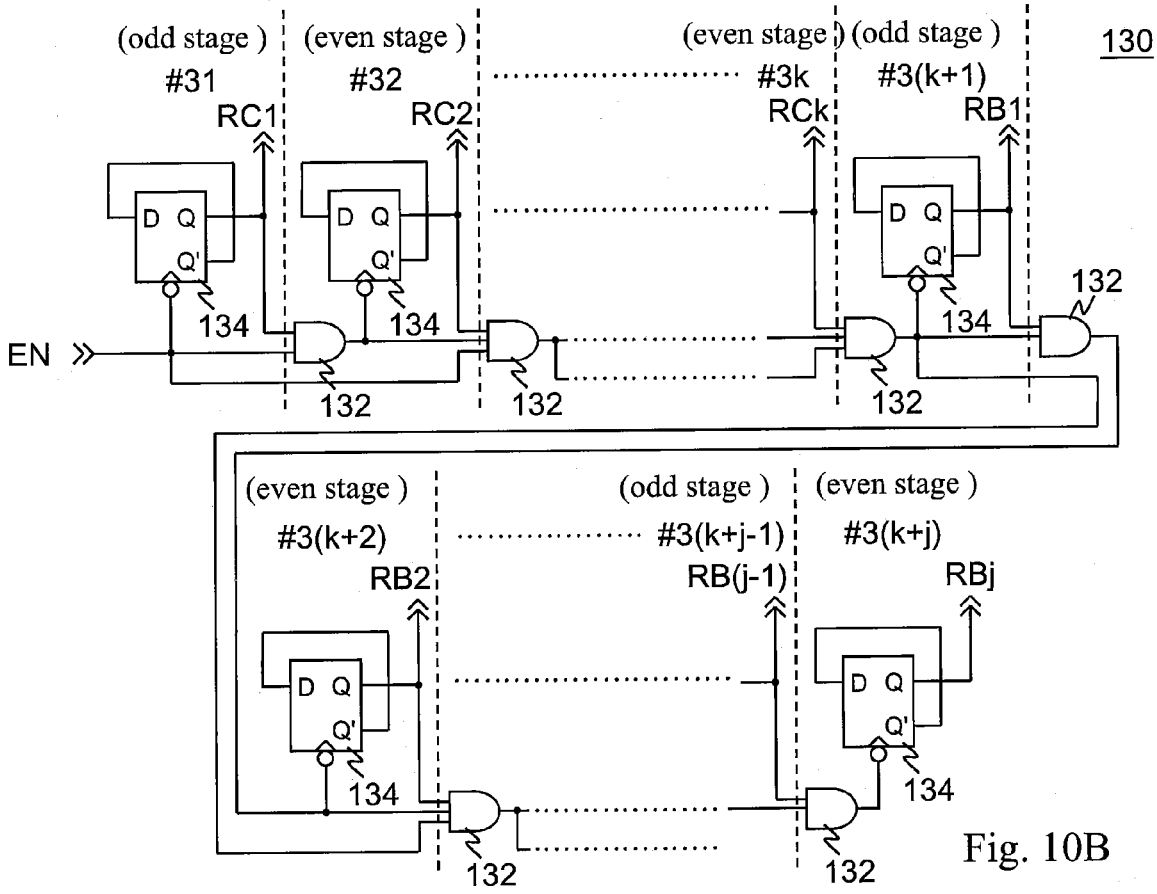
FIG. 10B is a schematic view of the second embodiment of the counter according to the circuit of a multiplexing inkjet print system of the present invention.
Figure 10C:
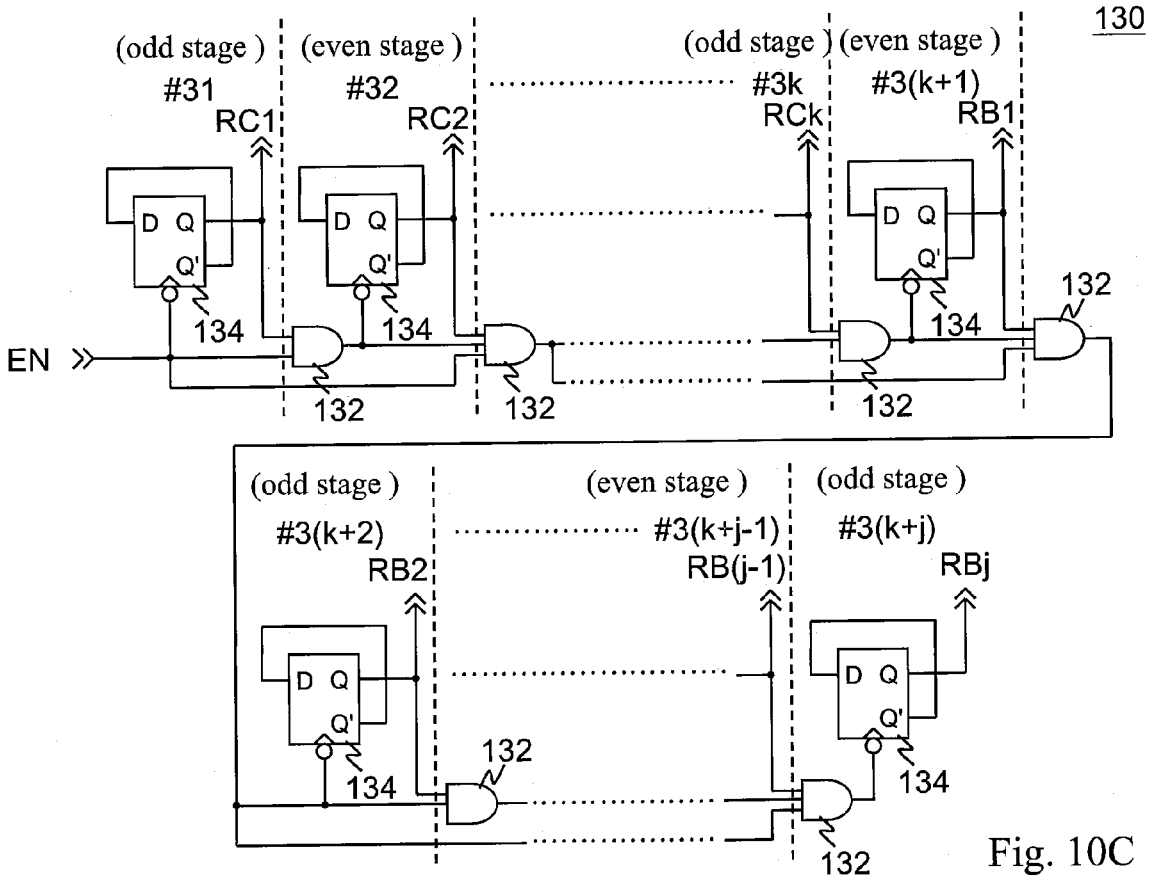
FIG. 10C is a schematic view of the third embodiment of the counter according to the circuit of a multiplexing inkjet print system of the present invention.
Figure 10D:
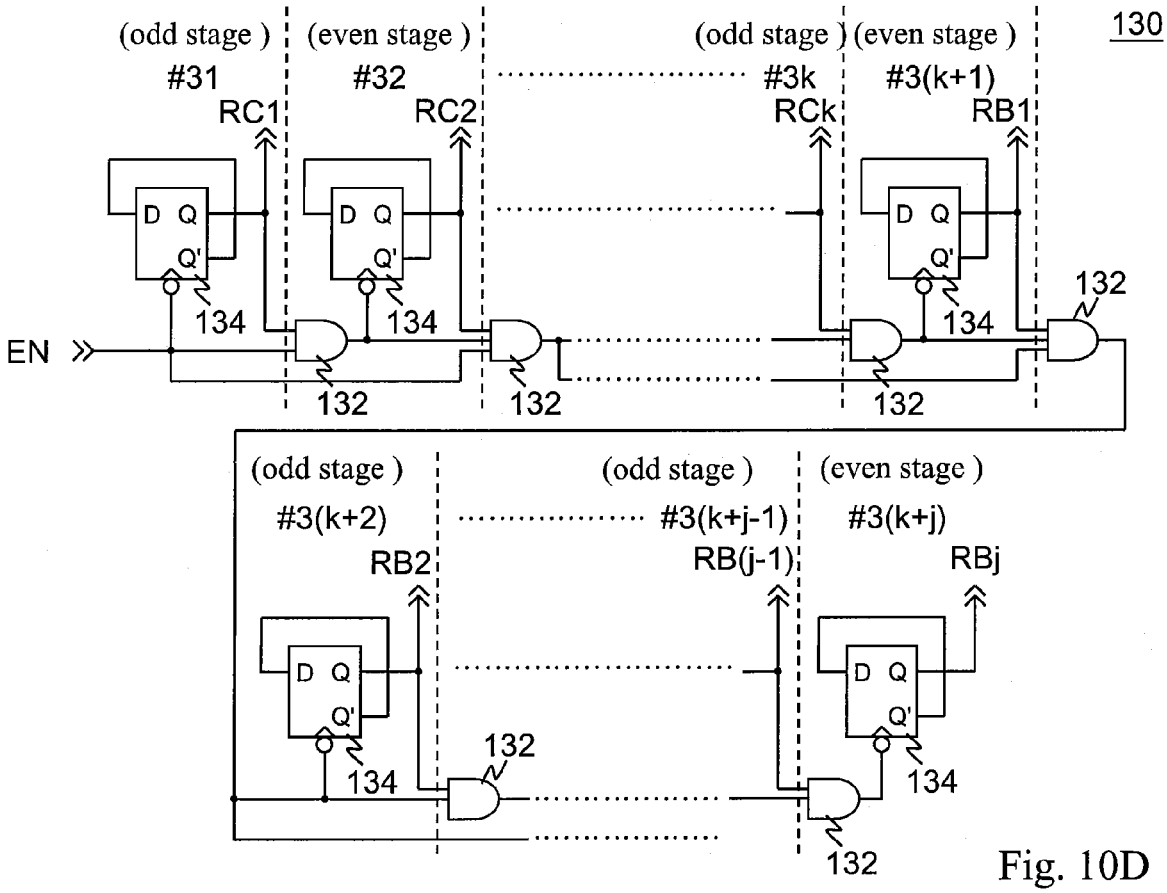
FIG. 10D is a schematic view of the fourth embodiment of the counter according to the circuit of a multiplexing inkjet print system of the present invention.
Figure 11A:
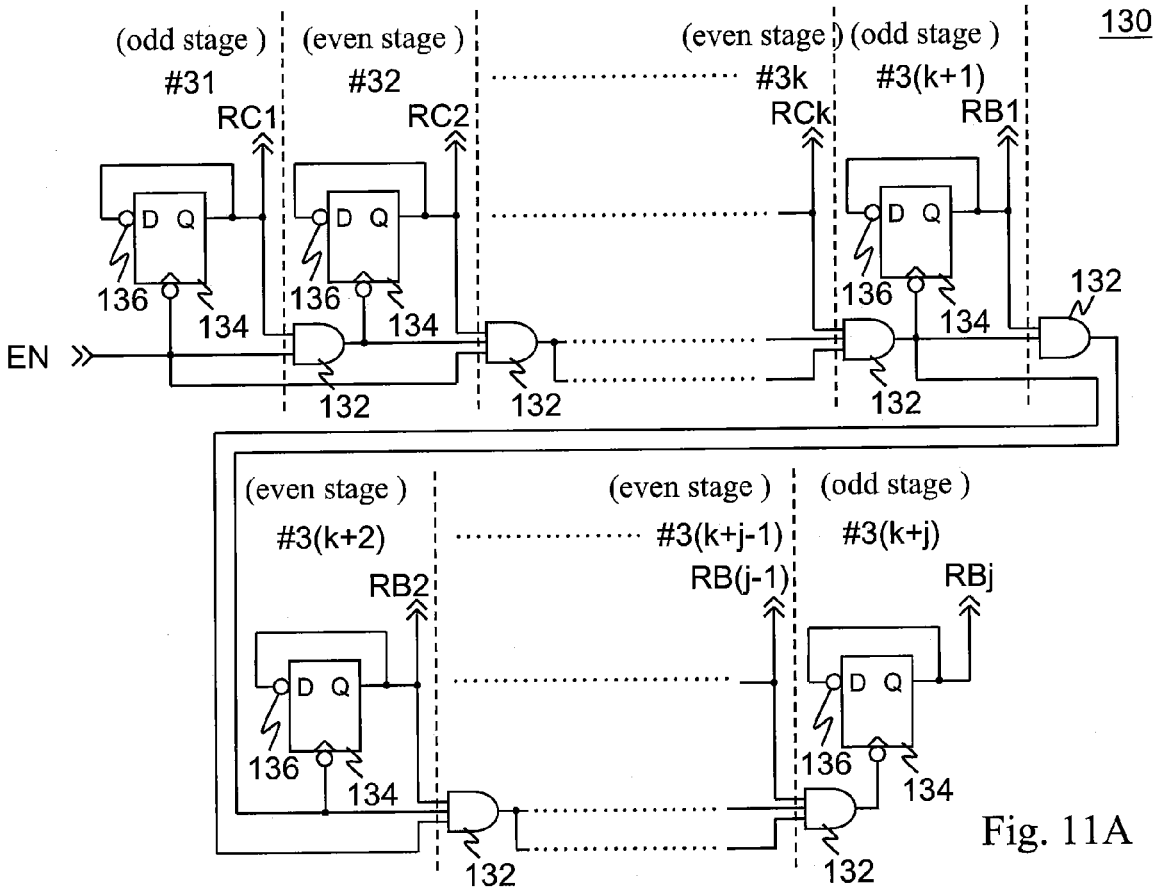
FIG. 11A is a schematic view of the fifth embodiment of the counter according to the circuit of a multiplexing inkjet print system of the present invention.
Figure 11B:
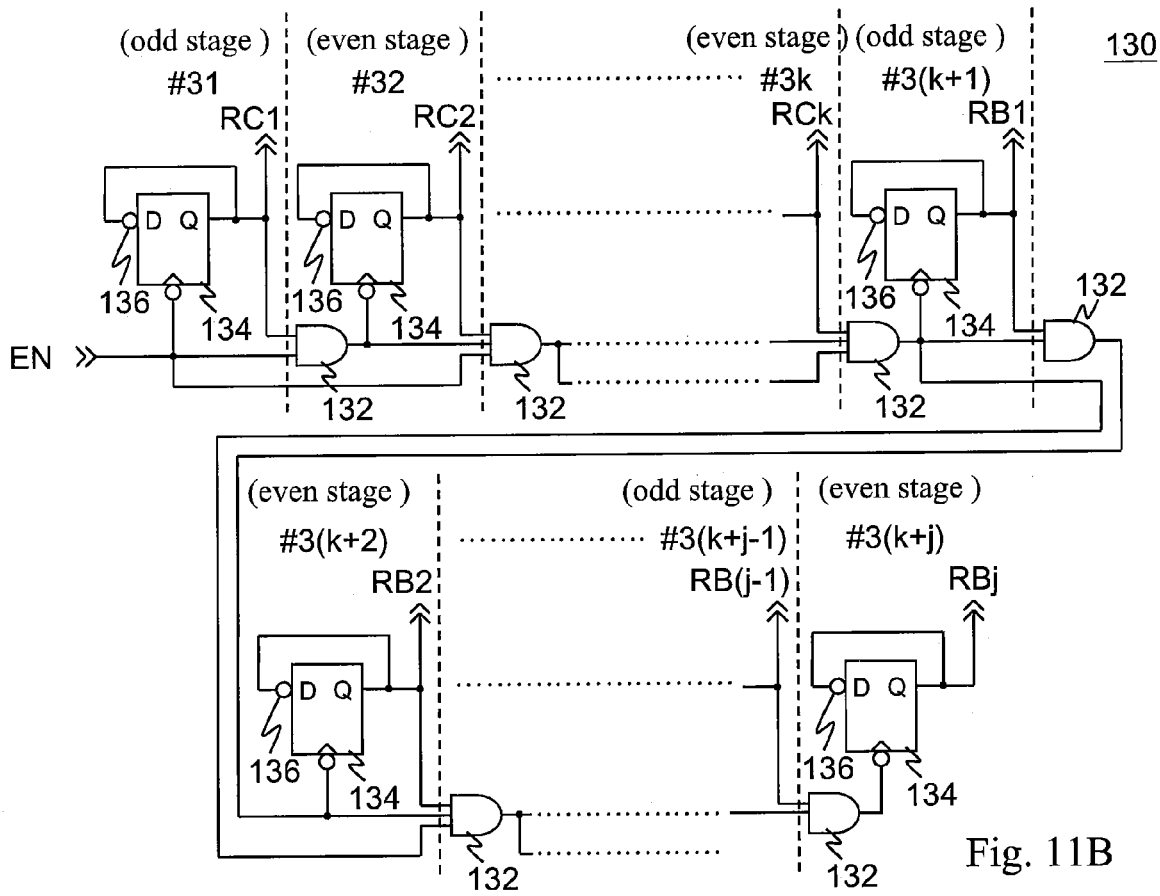
FIG. 11B is a schematic view of the sixth embodiment of the counter according to the circuit of a multiplexing inkjet print system of the present invention.
Figure 11C:
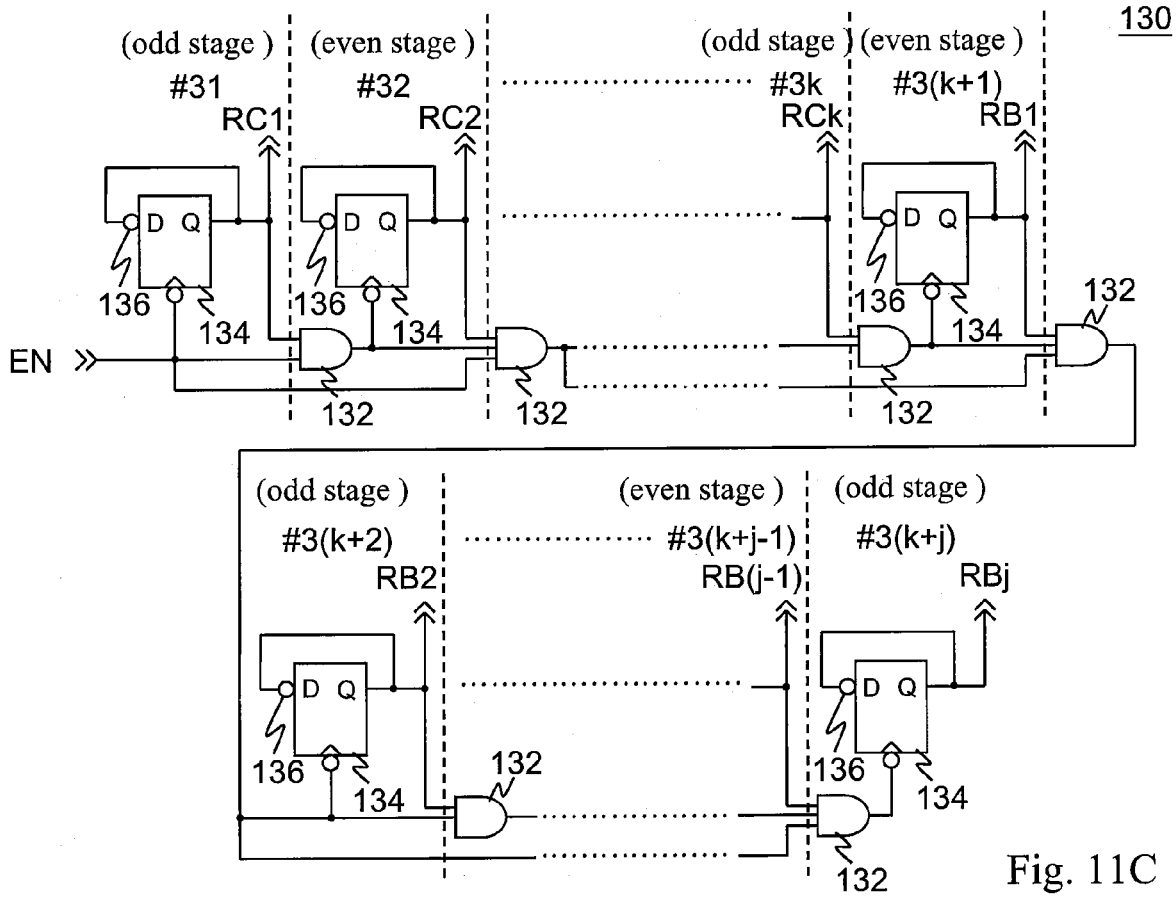
FIG. 11C is a schematic view of the seventh embodiment of the counter according to the circuit of a multiplexing inkjet print system of the present invention.
Figure 11D:
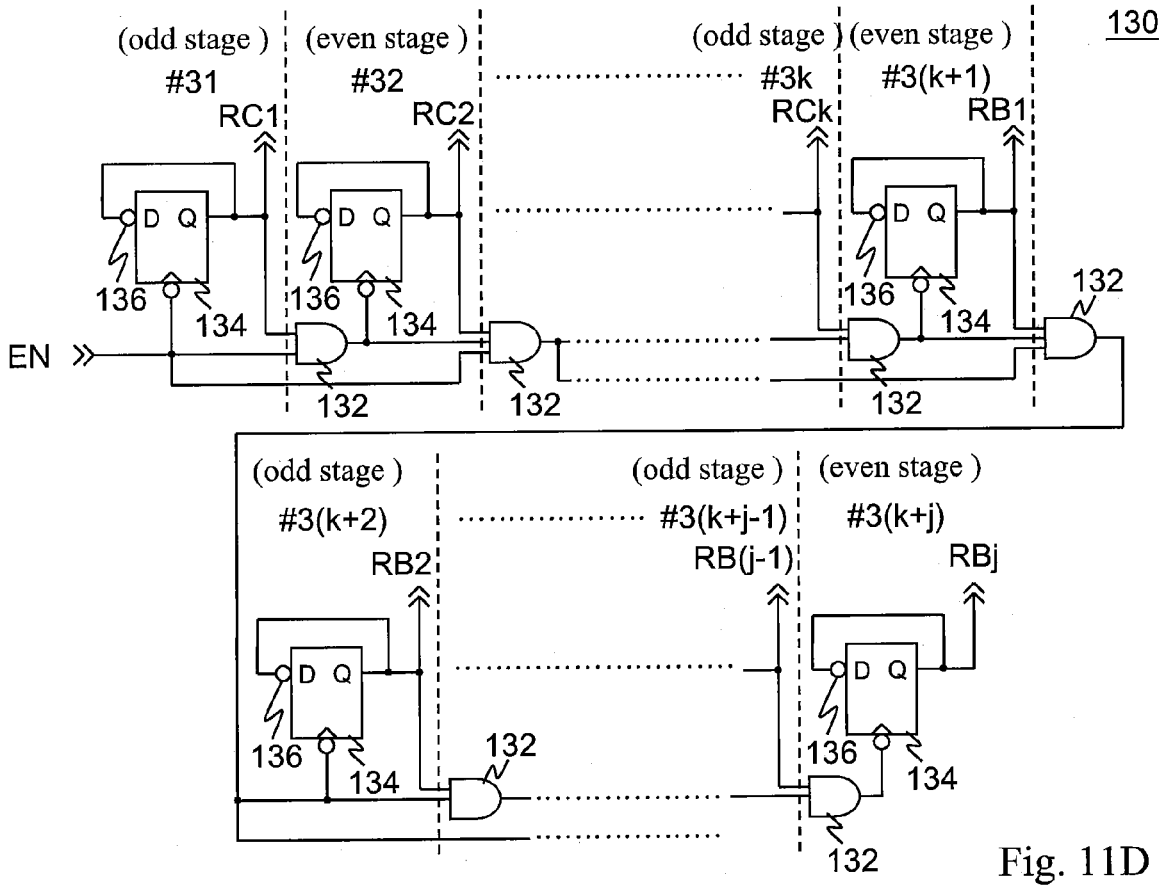
FIG. 11D is a schematic view of the eighth embodiment of the counter according to the circuit of a multiplexing inkjet print system of the present invention.

The counter 130 has an odd number of counting sub-circuits (as shown in FIGS. 10A, 10C), or has an even number of counting sub-circuits (as shown in FIGS. 10B, 10D). Moreover, no matter the shift register 120 has an odd number or even number of counting sub-circuits, wherein k can be odd or even.

Each of the sixth D-type flip-flop 134 is of negative-edge trigger and the inverted output end Q' thereof is fed back to the respective input end D. The enable signal EN is input into the trigger end of the first counting sub-circuit #31, the AND gate logic switch 132 of the second counting sub-circuit #32, and the trigger end of the sixth D-type flip-flop 134 of a counting sub-circuit in the next odd stage (i.e., the third counting sub-circuit, not shown). The sixth D-type flip-flop 134 of the first counting sub-circuit #31 outputs a time counting signal RC1 from the output end Q according to the enable signal EN and the feedback signal of the inverted output end Q'. Then, the time counting signal RC1 is input into the AND gate logic switch 132 of the second counting sub-circuit #32 for performing the logical operation (i.e., the output end of the AND gate logic switch 132 of the first counting sub-circuit #31 and the output end Q of the sixth D-type flip-flop 134 are electrically connected to the input end of the AND gate logic switch 132 of the second counting sub-circuit #32).

In the second counting sub-circuit #32, the AND gate logic switch 132 performs logic operation on the input time counting signal RC1 and the enable signal EN, and outputs the operating result to the trigger end of the sixth D-type flip-flop 134 and the input end of the AND gate logic switch 132 of the third counting sub-circuit. Therefore, the sixth D-type flip-flop 134 of the second counting sub-circuit #32 outputs a time counting signal RC2 from the output end Q according to the output of the AND gate logic switch 132 and the feedback signal of the inverted output end Q', and inputs the time counting signal RC2 and the output of the AND gate logic switch 132 to the AND gate logic switch 132 of the third counting sub-circuit, so as to perform the logical operation with the enable signal EN (i.e., the output end of the AND gate logic switch 132 of the second counting sub-circuit #32 and the output end Q of the sixth D-type flip-flop 134 are electrically connected to the input end of the AND gate logic switch 132 of the third counting sub-circuit).

As for the fourth counting sub-circuit (not shown) to the $(k+j-1)^{th}$ counting sub-circuit, in a counting sub-circuit in the even stage, the input end of the AND gate logic switch 132 is electrically connected to the output end of the AND gate logic switch 132 of the counting sub-circuit in the preceding stage and to the output end Q of the sixth D-type flip-flop 134 of the counting sub-circuit in the preceding stage. That is, the AND gate logic switch 132 receives the output of the AND gate logic switch 132 of the counting sub-circuit in the preceding stage and the output of the sixth D-type flip-flop 134 (i.e., the time counting signal output by the counting sub-circuit in the preceding stage), so as to perform the logical operation. The output end of the AND gate logic switch 132 is electrically connected to the trigger end of the sixth D-type flip-flop 134. The output end of the AND gate logic switch 132 and the output end Q of the sixth D-type flip-flop 134 are electrically connected to the input end of the AND gate logic switch 132 of the counting sub-circuit in the next stage. Further, in a counting sub-circuit in an odd stage, the AND gate logic switch 132 receives the output of the AND gate logic switch 132 of the counting sub-circuit in the preceding stage, the output of the sixth D-type flip-flop 134 (i.e., the time counting signal output by the counting sub-circuit in the preceding stage), and the output of the AND gate logic switch 132 of the counting sub-circuit in the preceding odd stage, so as to perform the logical operation. The output end of the AND gate logic switch 132 is electrically connected to the trigger end of the sixth D-type flip-flop 134, and the output end of the AND gate logic switch 132, and the output end Q of the sixth D-type flip-flop 134 are electrically connected to the input end of the AND gate logic switch 132 of the counting sub-circuit in the next stage, and so forth, until the $(k+j-1)^{th}$ counting sub-circuit #3(k+j−1).

Moreover, in the third counting sub-circuit (not shown), the AND gate logic switch 132 receives the enable signal EN, the output of the AND gate logic switch 132 of the counting sub-circuit in the preceding stage and the output of the sixth D-type flip-flop 134 of the counting sub-circuit in the preceding stage (i.e., the time counting signal output by the counting sub-circuit in the preceding stage), so as to perform the logical operation (i.e., the input end of the AND gate logic switch 132 is electrically-connected to the output end of the signal generating unit (not shown), the output end of the AND gate logic switch 132 of the counting sub-circuit in the preceding stage and the output end of the sixth D-type flip-flop 134 of the counting sub-circuit in the preceding stage). Besides that, the structure and the operating principle are similar to those of the counting sub-circuit in an odd stage mentioned above, and the details will not be described herein again.

As for the counting sub-circuit in the last stage (i.e., the $(k+j)^{th}$ counting sub-circuit #3(k+j)), when the shift register 120 has an odd number of counting sub-circuits (as shown in FIGS. 10A, 10C), the AND gate logic switch 132 of the $(k+j)^{th}$ counting sub-circuit #3(k+j) receives the output of the AND gate logic switch 132 of the counting sub-circuit in the preceding stage(i.e., the $(k+j-1)^{th}$ counting sub-circuit #3(k+j−1)), the output (i.e., the time counting signal RB(j−1)) of the sixth D-type flip-flop 134 and the output of the AND gate logic switch 132 of the counting sub-circuit in the preceding odd stage (i.e., the $(k+j-2)^{th}$ counting sub-circuit, not shown), so as to perform the logical operation. Moreover, the output end of the AND gate logic switch 132 is electrically connected to the trigger end of the sixth D-type flip-flop 134. Otherwise, when the shift register 120 has an even number of counting sub-circuits (as shown in FIGS. 10B, 10D), the AND gate logic switch 132 of the $(k+j)^{th}$ counting sub-circuit #3(k+j) receives the output of the AND gate logic switch 132 of the counting sub-circuit in the preceding stage (i.e., the $(k+j-1)^{th}$ counting sub-circuit #3(k+j−1)) and the output (i.e., the time counting signal RB(j−1)) of the sixth D-type flip-flop 134, so as to perform the logical operation. Moreover, the output end of the AND gate logic switch 132 is electrically connected to the trigger end of the sixth D-type flip-flop 134.

Further, the signal input by the sixth D-type flip-flop 134 to the input end D thereof can also be fed back to the input end D through the output end Q via an inverter 136, as shown in FIGS. 11A, 11B, 11C and 11D. That is, the output end Q of the sixth D-type flip-flop 134 is electrically connected to the input end of the AND gate logic switch 132 of the counting sub-circuit in the next stage (except the counting sub-circuit in the last stage), and the output end Q of the sixth D-type flip-flop 134 is fed back to the respective input end D via the inverter 136.

Figure 12:
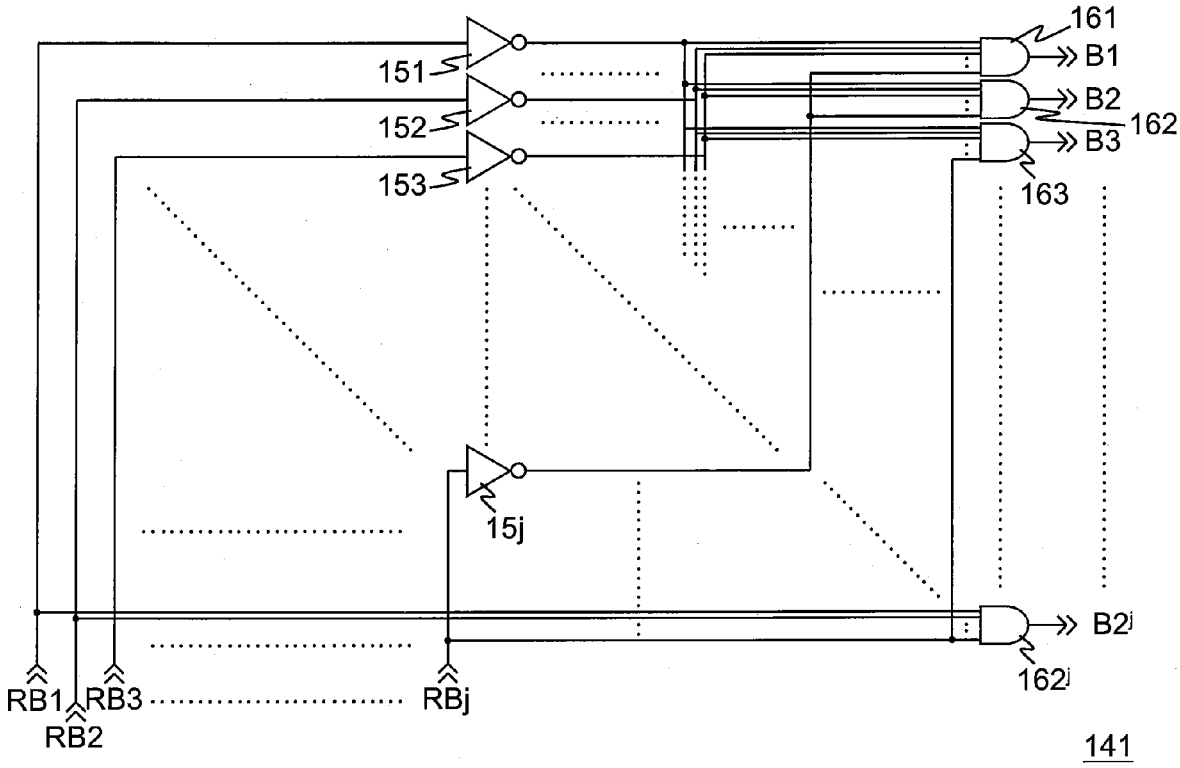
FIG. 12 is a schematic view of the first embodiment of the first decoder according to the circuit of a multiplexing inkjet print system of the present invention.
Figure 13:
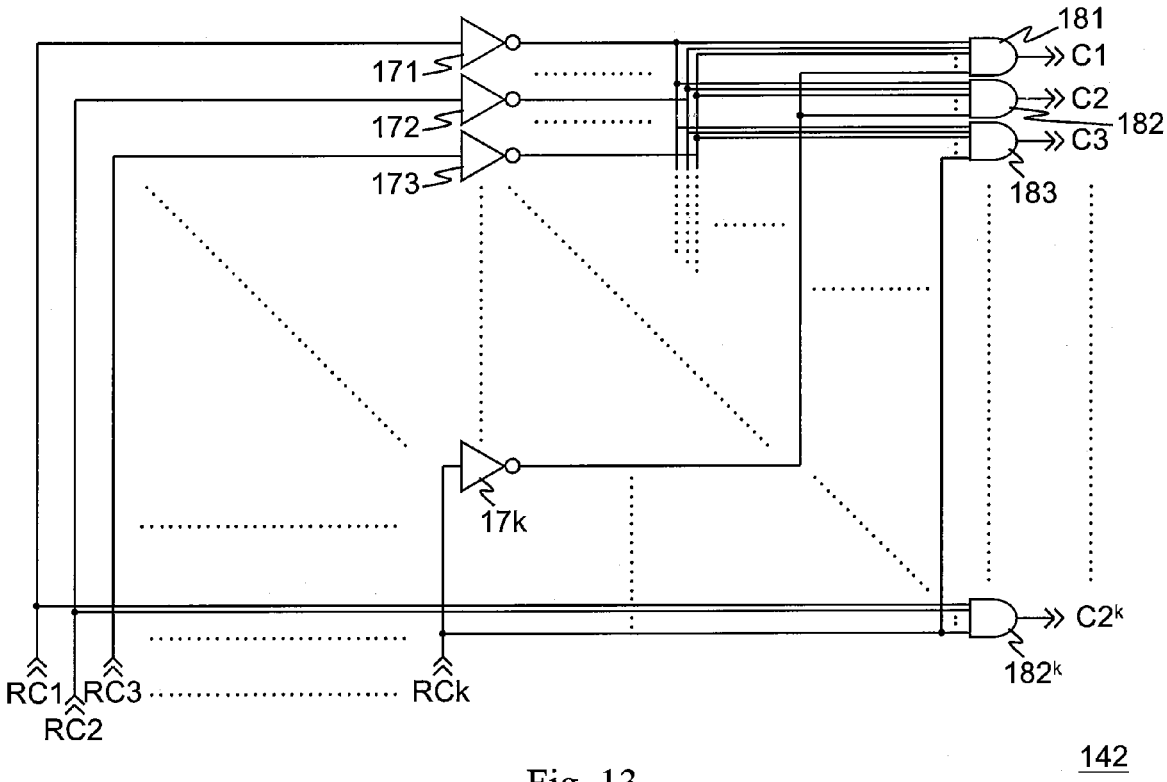
FIG. 13 is a schematic view of the first embodiment of the second decoder according to the circuit of a multiplexing inkjet print system of the present invention.

The first decoder 141 is a j-to-$2^j$ decoder, which includes j inverters 151, 152, 153~15*j* and $2^j$ AND gate logic switches 161, 162, 163~162$^j$. Through the combination of the inverters 151, 152, 153~15*j* and the AND gate logic switches 161, 162, 163~162$^j$, $2^j$ first start signals B1~B2$^j$ are generated according to j time counting signals RB1~RBj, as shown in FIG. 12. The second decoder 142 is a k-to-$2^k$decoder, which includes k inverters 171, 172, 173~17*k l and* $2^k$ AND gate logic switches 181, 182, 183~182$^k$. Through the combination of the inverters 171, 172, 173~17*k* and the AND gate logic switches 181, 182, 183~182$^k$, $2^k$ second start signals C1~C2$^k$ are generated according to k time counting signals RC1~RCk, as shown in FIG. 13. As the structures and operating principles of the j-to-$2^j$ decoder and the k-to-$2^k$ decoder are known to those skilled in the art, and the details will not be described herein again.

Figure 14:
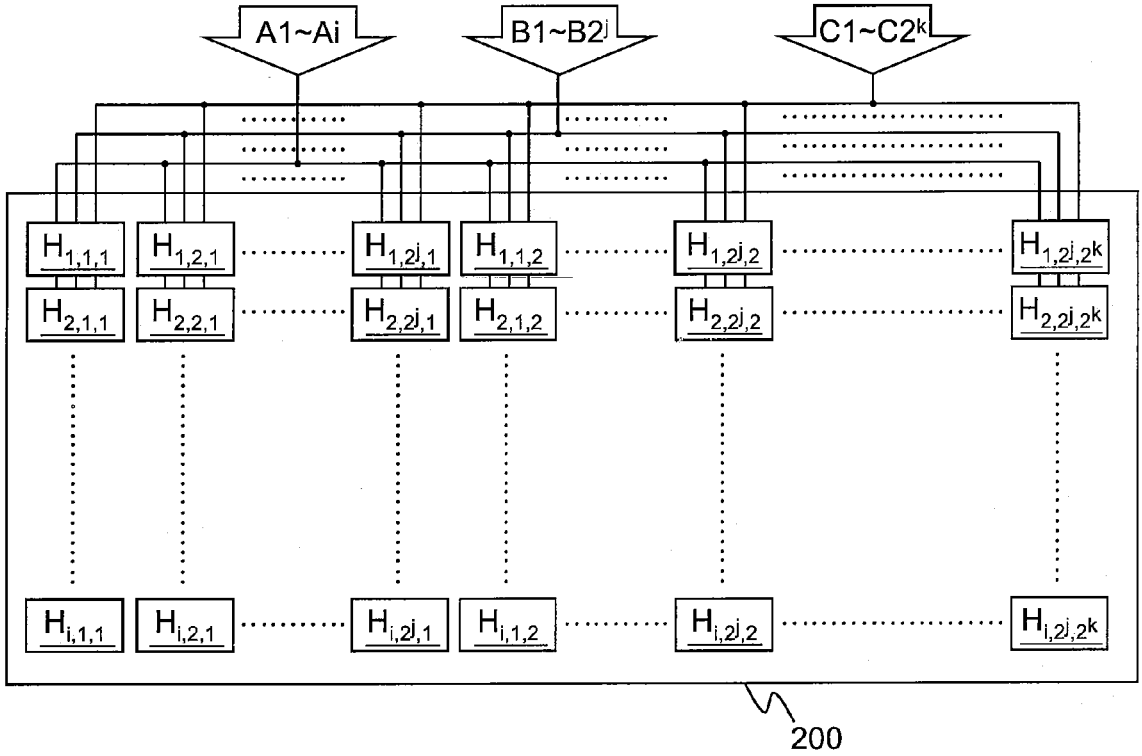
FIG. 14 is a schematic view of the first embodiment of the inkjet module according to the circuit of a multiplexing inkjet print system of the present invention.

Finally, the address signals A1~Ai, the first start signals B1~B$2^j$, and the second start signals C1~C$2^k$ are input into the inkjet module 200 for controlling the operation thereof. That is, the drive control of $i\times2^j\times2^k$ heater circuits $H_{1,1,1}$, $H_{2,1,1}$~$H_{i,1,1}$, $H_{1,2,1}$, $H_{2,2,1}$~$H_{i,2,1}$~$H_{1,2^j,1}$, $H_{2,2^j,1}$~$H_{i,2^j,1}$, $H_{1,1,2}$, $H_{2,1,2}$~$H_{i,1,2}$~$H_{1,2^j,2}$, $H_{2,2^j,2}$~$H_{i,2^j,2}$~$H_{1,2^j,2^k}$, $H_{2,2^j,2^k}$~$H_{i,2^j,2^k}$ is achieved through the random combinations of the address signals A1~Ai, the first start signals B1~B$2^j$, and the second start signals C1~C$2^k$, thus further controlling the operation of $i\times2^j\times2^k$ jet orifices, as shown in FIG. 14, wherein i, j and k are all positive integers.

Figure 15:
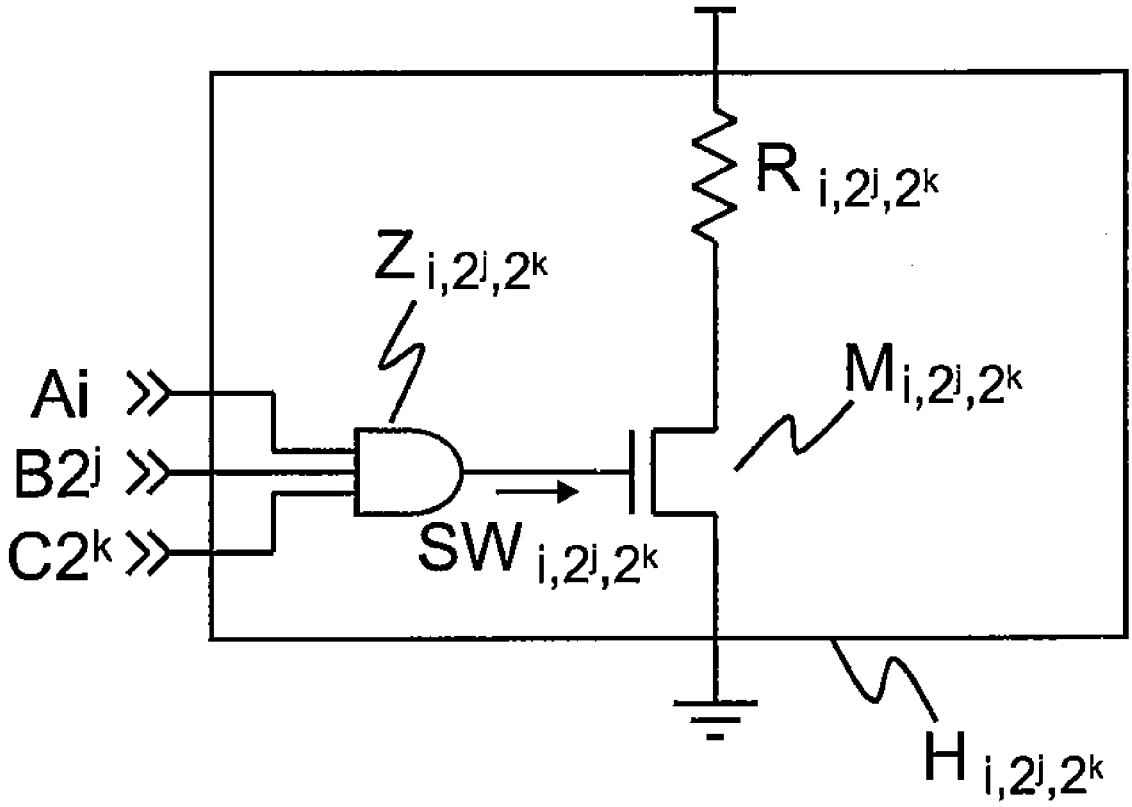
FIG. 15 is a schematic view of an embodiment of the heater circuit in the inkjet module in FIG. 14.

FIG. 15 is a schematic circuit view of an embodiment of the heater circuit. The heater circuit $H_{i,2^j,2^k}$ comprises an AND gate logic switch $Z_{i,2^j,2^k}$, a transistor switch $M_{i,2^j,2^k}$, and a resistance element $R_{i,2^j,2^k}$.

The input end of the AND gate logic switch $Z_{i,2^j,2^k}$ is electrically connected to the shift register 120, the first decoder 141, and the second decoder 142, so as to receive an address signals Ai from the shift register 120, a first start signals B$2^j$ from the first decoder 141, and a second start signals C$2^k$ from the second decoder 142, and the input end of the AND gate logic switch $Z_{i,2^j,2^k}$ is electrically connected to the gate of the transistor switch $M_{i,2^j,2^k}$. That is, the AND gate logic switch $Z_{i,2^j,2^k}$ performs logical operation according to the address signals Ai, the first start signals B$2^j$, and the second start signals C$2^k$ to output a drive signal $SW_{i,2^j,2^k}$ to control the on/off of the transistor switch $M_{i,2^j,2^k}$. In addition, the source of the transistor switch $M_{i,2^j,2^k}$ is grounded, and the drain thereof is electrically connected to one end of the resistance element $R_{i,2^j,2^k}$, and a proper voltage or current is applied to the other end of the resistance element $R_{i,2^j,2^k}$.

When the address signals Ai, the first start signals B$2^j$, and the second start signals C$2^k$ are all of logic high signal "1", the drive signal $SW_{i,2^j,2^k}$ of logic high signal "1" is generated after the operation of the AND gate logic switch $Z_{i,2^j,2^k}$ so as to turn on the transistor switch $M_{i,2^j,2^k}$. At this time, the resistance element $R_{i,2^j,2^k}$ starts operating to generate heat, thereby driving the corresponding orifices to jet ink for printing. Thus, a small number of control signals are used to greatly increase the jet orifices without greatly increasing the number of the external contacts. Moreover, the jet orifices corresponding to the section of data can be directly selected according to the data required to be printed.

Figure 16:
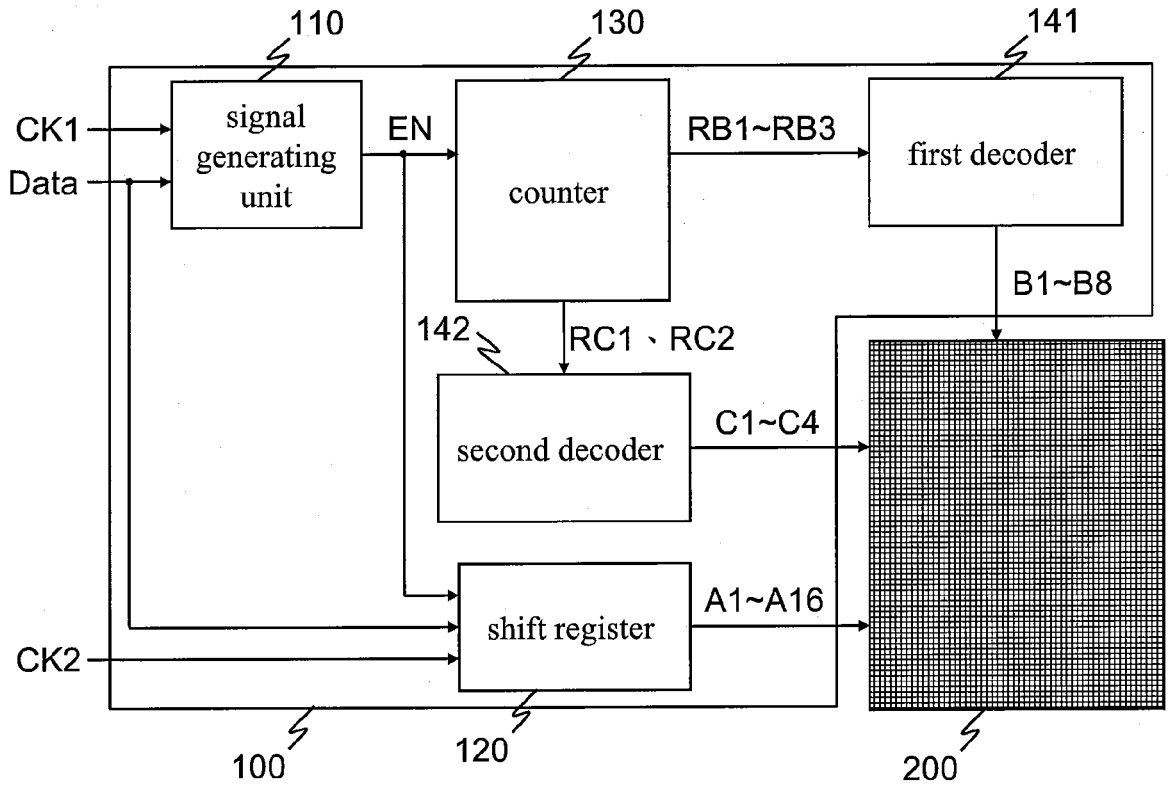
FIG. 16 is a schematic view of the circuit of a multiplexing inkjet print system according to the second embodiment of the present invention.

For example, when it is intended to control the drive of 512 jet orifices, i=16, j=3 and k=2 as shown in FIG. 16. Referring to FIG. 16, the counter 130 counts according to the enable signal EN, so as to generate five time counting signals RB1~RB3, RC1, RC2. The above signals are divided into two portions, wherein the time counting signals RB1~RB3 of one portion are input into the first decoder 141 to be decoded to generate $2^3$(=8) first start signals B1~B8; while the time counting signals RC1, RC2 of the other portion are input into the second decoder 142 to be decoded to generate $2^2$(=4) second start signals C1~C4. The shift register 120 shifts the data Data according to the enable signal EN and the second clock signal CK2, so as to generate 16 address signals A1~A16. Further, the operation of the inkjet module 200 is controlled by the address signals A1~A16, the first start signals B1~B8, and the second start signals C1~C4. That is, the drive control of $16\times2^3\times2^2$(=16×8×4=512) heater circuits is achieved through the random combinations of the address signals A1~A16, the first start signals B1~B8, and the second start signals C1~C4, thereby controlling the operation of 512 jet orifices.

The signal generating unit 110 can adopt the structure as shown in FIG. 5A and the operating principle thereof is the same as those mentioned above, and the details will not be described herein again.

Figure 17:
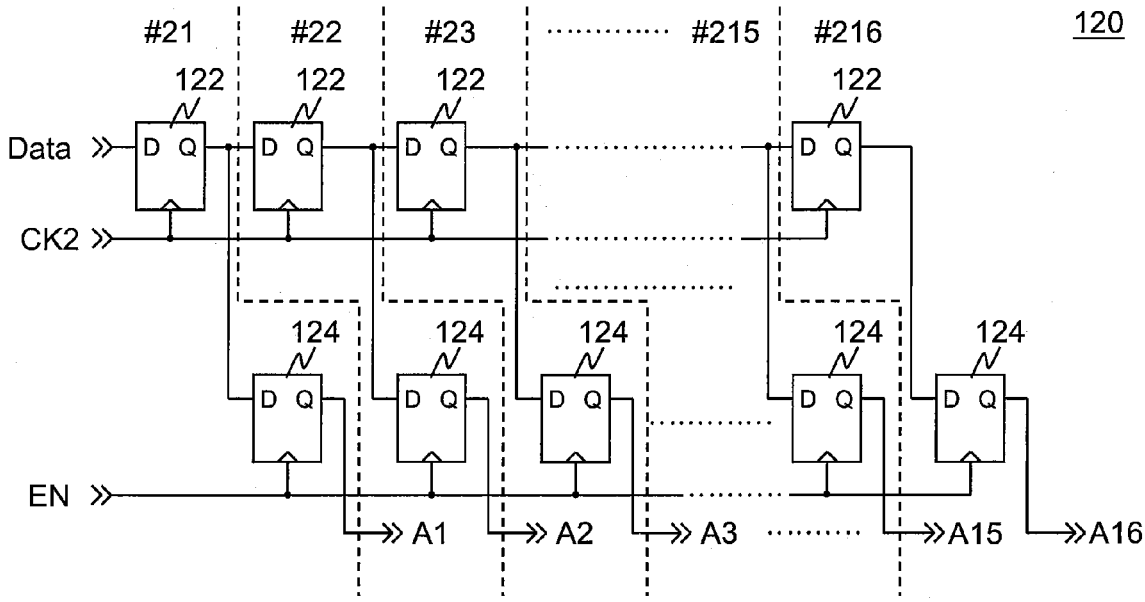
FIG. 17 is a schematic view of the third embodiment of the shift register according to the circuit of a multiplexing inkjet print system of the present invention.

The structure of the shift register 120 is similar to that in FIG. 8, wherein i=16, as shown in FIG. 17. Referring to FIG. 17, the shift register 120 includes 16 shift sub-circuits (referred to as the first shift sub-circuit to the sixteenth shift sub-circuit #21, #22, #23~#215, #216 for the convenience of illustration). Each shift sub-circuit includes two D-type flip-flops (referred to as the fourth D-type flip-flop 122 and the fifth D-type flip-flop 124 for the convenience of illustration). The fourth D-type flip-flop 122 and the fifth D-type flip-flop 124 both adopt positive-edge trigger. The second clock signal CK2 is input into the trigger end of the fourth D-type flip-flop 122 of each shift sub-circuit, and the enable signal EN is input into the trigger end of the fifth D-type flip-flop 124 of each shift sub-circuit. In the first shift sub-circuit #21, the input end D of the fourth D-type flip-flop 122 receives the data Data, and the output end Q thereof is electrically connected to the input end D of the fifth D-type flip-flop 124 and to the input end D of the fourth D-type flip-flop 122 of the second shift sub-circuit #22, so the fifth D-type flip-flop 124 further outputs the address signals A1 from the output end Q according to the output of the fourth D-type flip-flop 122 and the enable signal EN. Moreover, in the second shift sub-circuit #22, the input end D of the fourth D-type flip-flop 122 is electrically connected to the output end Q of the fourth D-type flip-flop 122 of the first shift sub-circuit #21, and the output end Q thereof is electrically connected to the input end D of the fifth D-type flip-flop 124 and the input end D of the fourth D-type flip-flop 122 of the third shift sub-circuit #23, so the fifth D-type flip-flop 124 further outputs the address signals A2 from the output end Q according to the output of the fourth D-type flip-flop 122 and the enable signal EN. Likewise, the address signals A4~A15 are output from the fourth shift sub-circuit to the fifteenth shift sub-circuit. In the sixteenth shift sub-circuit #216, the input end D of the fourth D-type flip-flop 122 is electrically connected to the output end Q of the fourth D-type flip-flop 122 of the fifteenth shift sub-circuit #215, and the output end Q of the fourth D-type flip-flop 122 is electrically connected to the input end D of the fifth D-type flip-flop 124. Thus, the address signal A16 is output from the output end Q by the fifth D-type flip-flop 124 according to the output of the fourth D-type flip-flop 122 and the enable signal EN.

Figure 18:
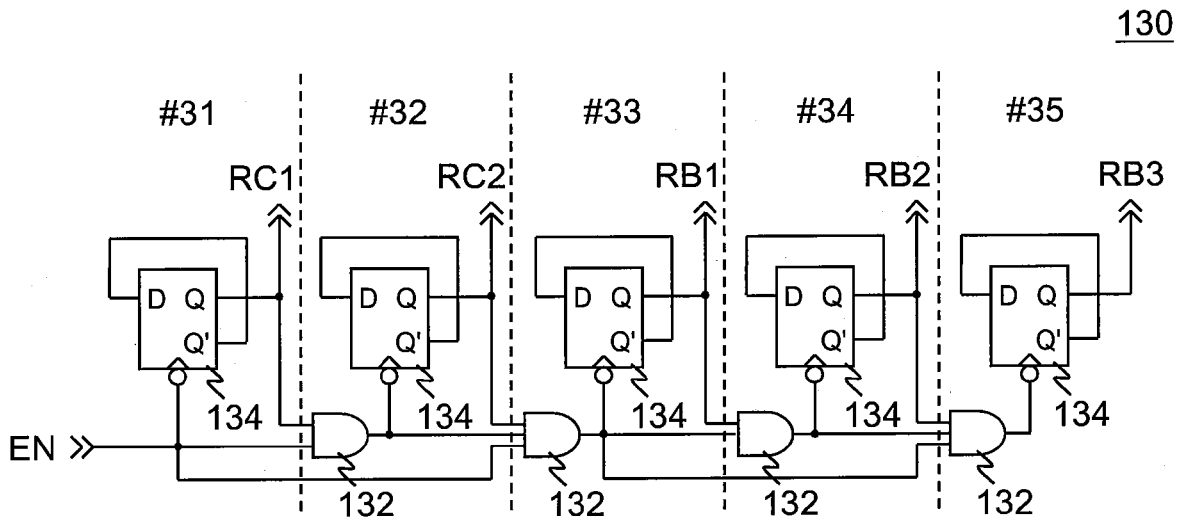
FIG. 18 is a schematic view of the ninth embodiment of the counter according to the circuit of a multiplexing inkjet print system of the present invention.

The structure of the counter 130 is similar to that in FIG. 10A, wherein j=3 and k=2, as shown in FIG. 18. Referring to FIG. 18, the shift register 120 includes five counting sub-circuits (referred to as the first counting sub-circuit to the fifth counting sub-circuit #31, #32, #33, #34, #35 for the convenience of illustration). The first counting sub-circuit #31 includes the sixth D-type flip-flop 134, while the second to the fifth counting sub-circuits #32~#35 include the AND gate logic switch 132 and the sixth D-type flip-flop 134. In addition, for each of the counting sub-circuits (i.e., the first counting sub-circuit to the fifth counting sub-circuit #31~#35), the output end Q of the sixth D-type flip-flop 134 respectively outputs the time counting signals RC1, RC2, RB1, RB2, RB3. Here, the sixth D-type flip-flop 134 of each counting sub-circuit is of negative-edge trigger, wherein the inverted output end Q' is fed back to the respective input end D, and the output end Q is electrically connected to the input end of the AND gate logic switch 132 of the counting sub-circuit in the next stage.

The enable signal EN is input into the trigger end of the first counting sub-circuit #31, the AND gate logic switch 132 of the second counting sub-circuit #32, and the trigger end of the sixth D-type flip-flop 134 of the third counting sub-circuit #33. The sixth D-type flip-flop 134 of the first counting sub-circuit #31 outputs the time counting signal RC1 from the output end Q according to the enable signal EN and the feedback signal of the inverted output end. Further, the time counting signal RC1 is input into the AND gate logic switch 132 of the second counting sub-circuit #32, so as to perform the logical operation (i.e., the output end Q of the sixth D-type flip-flop 134 of the first counting sub-circuit #31 is electrically connected to the input end of the AND gate logic switch 132 of the second counting sub-circuit #32).

In the second counting sub-circuit #32, the input end of the AND gate logic switch 132 is electrically connected to the output end of the signal generating unit (not shown) and the output end Q of the sixth D-type flip-flop 134 of the first counting sub-circuit #32. That is, the AND gate logic switch 132 receives the time counting signal RC1 and the enable signal EN to perform the logical operation, and outputs the operating result to the trigger end of the sixth D-type flip-flop 134 and the AND gate logic switch 132 of the third counting sub-circuit #33. Therefore, the sixth D-type flip-flop 134 of the second counting sub-circuit #32 outputs the time counting signal RC2 from the output end Q according to the output of the AND gate logic switch 132 and the feedback signal of the inverted output end Q'. The time counting signal RC2 is output from the output end Q, and the time counting signal RC2 together with the output of the AND gate logic switch 132 are then input into the AND gate logic switch 132 of the third counting sub-circuit #33, so as to perform the logical operation with the enable signal EN (i.e., the output end of the AND gate logic switch 132 of the second counting sub-circuit #32 and the output end Q of the sixth D-type flip-flop 134 are electrically connected to the input end of the AND gate logic switch 132 of the third counting sub-circuit #33).

In the third counting sub-circuit #33, the input end of the AND gate logic switch 132 is electrically connected to the output end of the signal generating unit (not shown), the output end of the AND gate logic switch 132 of the second counting sub-circuit #32, and the output end Q of the sixth D-type flip-flop 134 of the second counting sub-circuit #32, so as to receive the enable signal EN, the output of the AND gate logic switch 132 of the second counting sub-circuit #32, and the time counting signal RC2 for performing the logical operation. Then, the operating result is output to the trigger end of the sixth D-type flip-flop 134, the AND gate logic switch 132 of the fourth counting sub-circuit #33, and the AND gate logic switch 132 of the fifth counting sub-circuit #35. The sixth D-type flip-flop 134 of the third counting sub-circuit #33 outputs the time counting signal RB1 from the output end Q according to the output of the AND gate logic switch 132 and the feedback signal of the inverted output end Q'. The time counting signal RB1 and the output of the AND gate logic switch 132 are input into the AND gate logic switch 132 of the fourth counting sub-circuit #34, so as to perform the logical operation (i.e., the output end of the AND gate logic switch 132 of the third counting sub-circuit #33 and the output end Q of the sixth D-type flip-flop 134 are electrically connected to the input end of the AND gate logic switch 132 of the fourth counting sub-circuit #34).

In the fourth counting sub-circuit #34, the input end of the AND gate logic switch 132 is electrically connected to the output end of the AND gate logic switch 132 of the third counting sub-circuit #33 and the output end Q of the sixth D-type flip-flop 134 of the third counting sub-circuit #33. That is, the AND gate logic switch 132 receives the output of the AND gate logic switch 132 of the third counting sub-circuit #33 and the time counting signal RB1, so as to perform the logical operation. Then, the operating result is input into the trigger end of the sixth D-type flip-flop 134 and the AND gate logic switch 132 of the fifth counting sub-circuit #35. That is, the output end of the AND gate logic switch 132 of the fourth counting sub-circuit #34 is electrically connected to the trigger end of the sixth D-type flip-flop 134 and the input end of the AND gate logic switch 132 of the fifth counting sub-circuit #35. The sixth D-type flip-flop 134 of the fourth counting sub-circuit #34 outputs the time counting signal RB2 from the output end Q according to the output of the AND gate logic switch 132 and the feedback signal of the inverted output end Q'. The time counting signal RB2 and the output of the AND gate logic switch 132 are input into the AND gate logic switch 132 of the fifth counting sub-circuit #35, so as to perform the logical operation (i.e., the output end of the AND gate logic switch 132 of the fourth counting sub-circuit #34 and the output end Q of the sixth D-type flip-flop 134 are electrically connected to the input end of the AND gate logic switch 132 of the fifth counting sub-circuit #35).

In the counting sub-circuit in the last stage, i.e., the fifth counting sub-circuit #35, the input end of the AND gate logic switch 132 is electrically connected to the output end of the AND gate logic switch 132 of the third counting sub-circuit #33, the output end of the AND gate logic switch 132 of the fourth counting sub-circuit #34, and the output end Q of the sixth D-type flip-flop 134 of the fourth counting sub-circuit #34, so as to receive the output of the AND gate logic switches 132 of the third and the fourth counting sub-circuits #33 #34 and the time counting signal RB2, so as to perform the logical operation. Then, the operating result is output to the trigger end of the sixth D-type flip-flop 134. Thus, the sixth D-type flip-flop 134 of the fifth counting sub-circuit #35 outputs the time counting signal RB3 from the output end Q according to the output of the AND gate logic switch 132 and the feedback signal of the inverted output end Q'.

Figure 19:
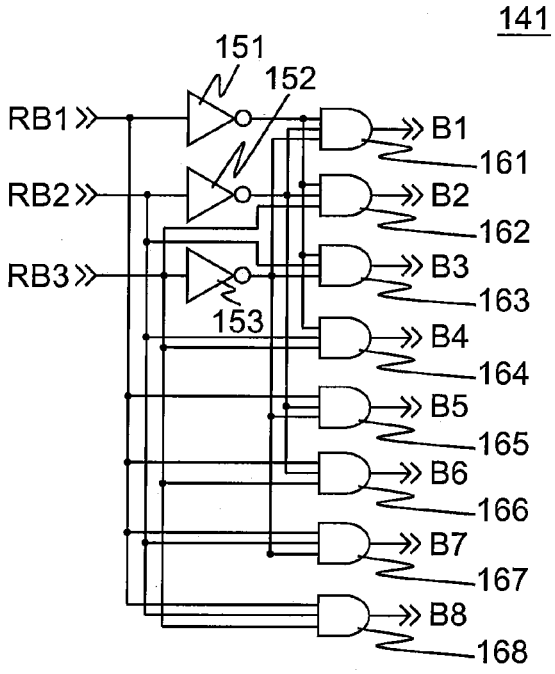
FIG. 19 is a schematic view of the second embodiment of the first decoder according to the circuit of a multiplexing inkjet print system of the present invention.

The structure of the first decoder 141 is similar to that in FIG. 12, wherein j=3, as shown in FIG. 19. Referring to FIG. 19, the first decoder 141 is a 3-to-8 decoder, which includes three inverters 151, 152, 153 and $2^3$(=8) AND gate logic switches 161, 162, 163, 164, 165, 166, 167, 168. The time counting signals RB1, RB2, RB3 are respectively input into the inverters 151, 152, 153. The time counting signal RB1 is inverted and then input into the AND gate logic switches 161, 162, 163, 164. The time counting signal RB2 is inverted and then input into the AND gate logic switches 161, 162, 165, 166. The time counting signal RB3 is inverted and then input into the AND gate logic switches 161, 163, 165, 167. In addition, the AND gate logic switch 161 performs the logic operation on the inverted time counting signals RB1, RB2, RB3 to generate the first start signal B1. The AND gate logic switch 162 performs the logic operation on the inverted time counting signals RB1, RB2 and the time counting signal RB3 to generate the first start signal B2. The AND gate logic switch 163 performs the logic operation on the inverted time counting signals RB1, RB3 and the time counting signal RB2 to generate the first start signal B3. The AND gate logic switch 164 performs the logic operation on the inverted time counting signals RB1 and the time counting signals RB2, RB3 to generate the first start signal B4. The AND gate logic switch 165 performs the logic operation on the inverted time counting signal RB2, RB3 and the time counting signal RB1 to generate the first start signal B5. The AND gate logic switch 166 performs the logic operation on the inverted time counting signal RB2 and the time counting signals RB1, RB3 to generate the first start signal B6. The AND gate logic switch 167 performs the logic operation on the inverted time counting signal RB3 and the time counting signals RB1, RB2 to generate the first start signal B7. The AND gate logic switch 168 performs the logic operation on the time counting signals RB1, RB 2, RB3 to generate the first start signal B8.

Figure 20:
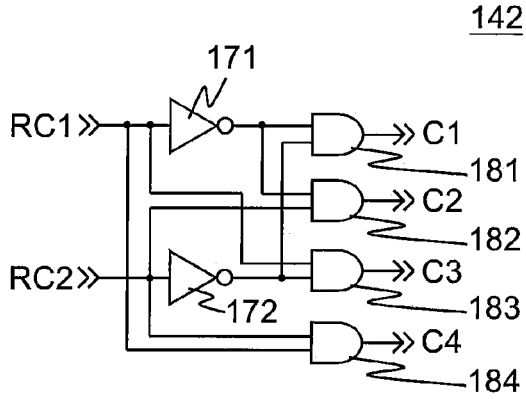
FIG. 20 is a schematic view of the second embodiment of the second decoder according to the circuit of a multiplexing inkjet print system of the present invention.

The structure of the second decoder 142 is similar to that in FIG. 13, wherein k=2, as shown in FIG. 20. Referring to FIG. 20, the second decoder 142 is a 2-to-4 decoder, which includes two inverters 171, 172 and $2^2$(=4) AND gate logic switches 181, 182, 183, 184. The time counting signals RC1, RC2 are respectively input into the inverters 171, 172. The time counting signal RC1 is inverted and then input into the AND gate logic switches 181, 182. The time counting signal RC2 is inverted and then input into the AND gate logic switches 181, 183. Moreover, the AND gate logic switch 181 performs the logic operation on the inverted time counting signals RC1, RC2 to generate the second start signal C1. The AND gate logic switch 182 performs the logic operation on the inverted time counting signal RC1 and the time counting signal RC2 to generate the second start signal C2. The AND gate logic switch 183 performs the logic operation on the inverted time counting signal RC2 and the time counting signal RC1 to generate the second start signal C3. The AND gate logic switch 184 performs the logic operation on the time counting signals RC1, RC2 to generate the second start signal C4.

Figure 21A:
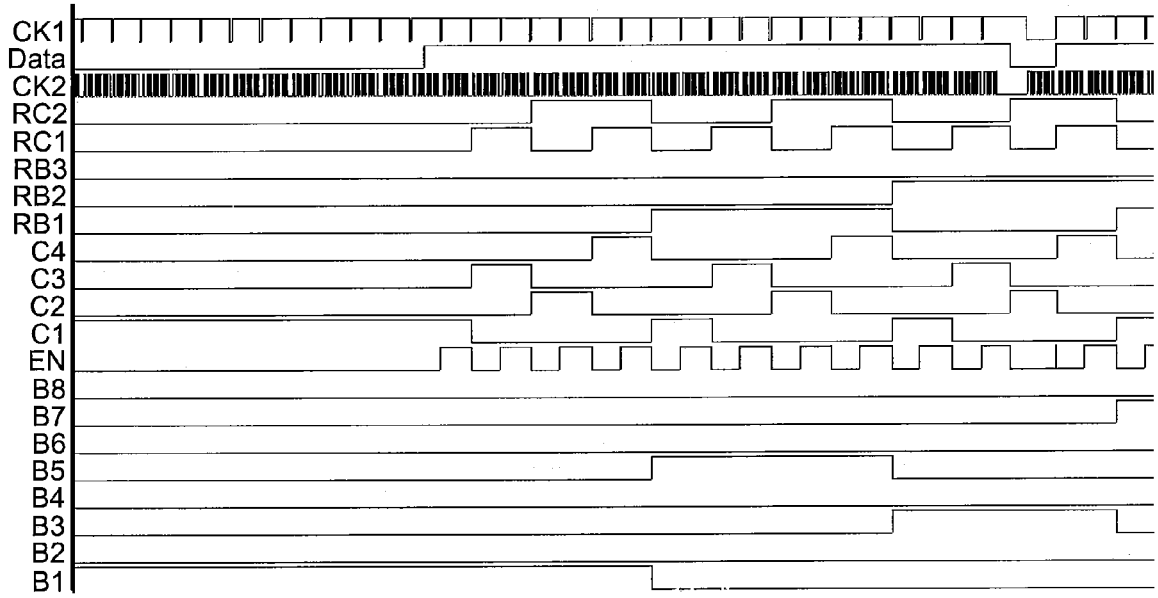
FIGS. 21A, 21B are timing diagrams of each signal according to the circuit of a multiplexing inkjet print system of the second embodiment of the present invention.
Figure 21B:
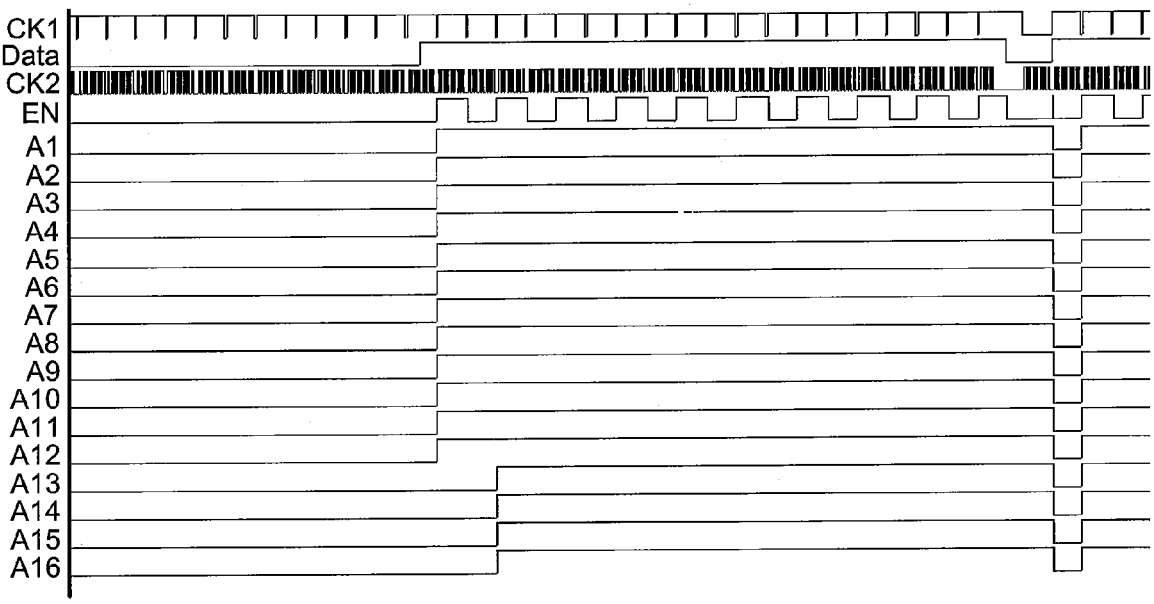

In the above architecture, the timing diagram of each signal is as shown in FIGS. 21A, 21B.

Figure 22:
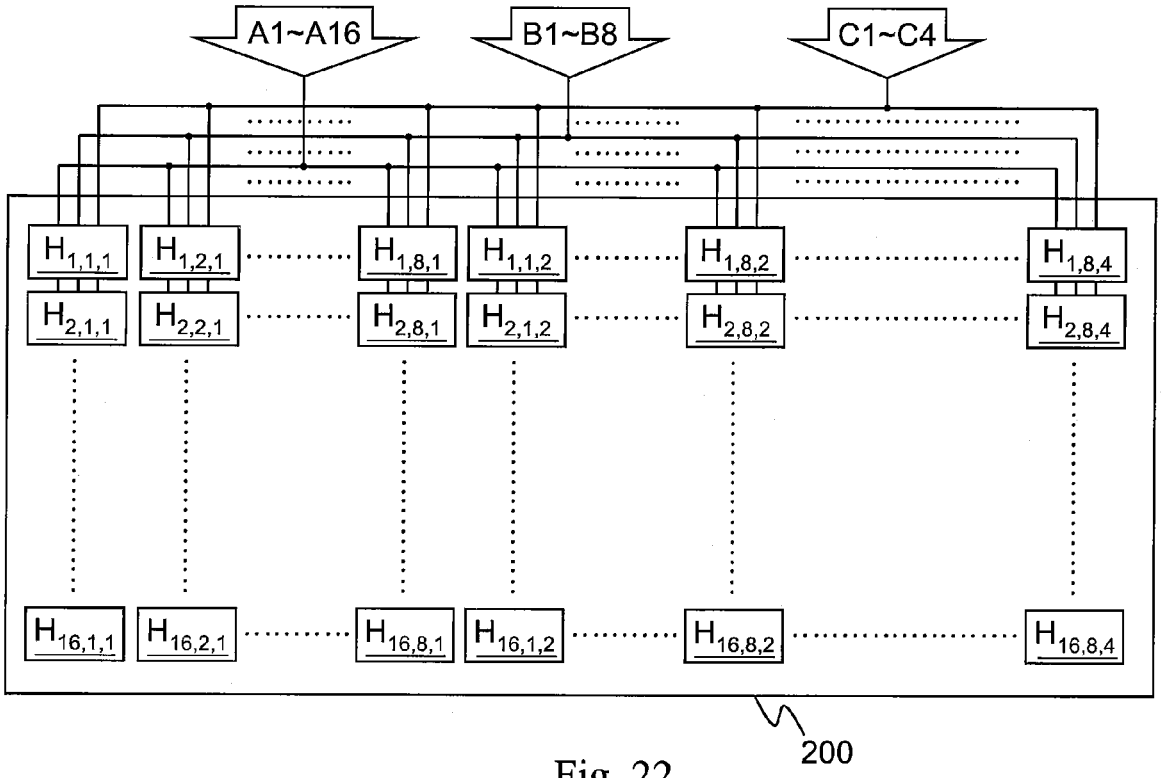
FIG. 22 is a schematic view of the second embodiment of the inkjet module according to the circuit of a multiplexing inkjet print system of the present invention.

Finally, the address signals A1~A16, the first start signals B1~B8, and the second start signals C1~C4 are input into the inkjet module 200, so as to control the drive of $16\times2^3\times2^2$ (=16×8×4=512) heater circuits $H_{1,1,1}$, $H_{2,1,1}$~$H_{16,1,1}$, $H_{1,2,1}$, $H_{2,2,1}$~$H_{16,2,1}$~$H_{1,8,1}$, $H_{2,8,1}$~$H_{16,8,1}$, $H_{1,1,2}$, $H_{2,1,2}$~$H_{16,1,2}$~$H_{1,8,2}$, $H_{2,8,2}$~$H_{16,8,2}$~$H_{1,8,4}$, $H_{2,8,4}$~$H_{16,8,4}$, thus further controlling the operation of 512 jet orifices, as shown in FIG. 22.

Figure 23:
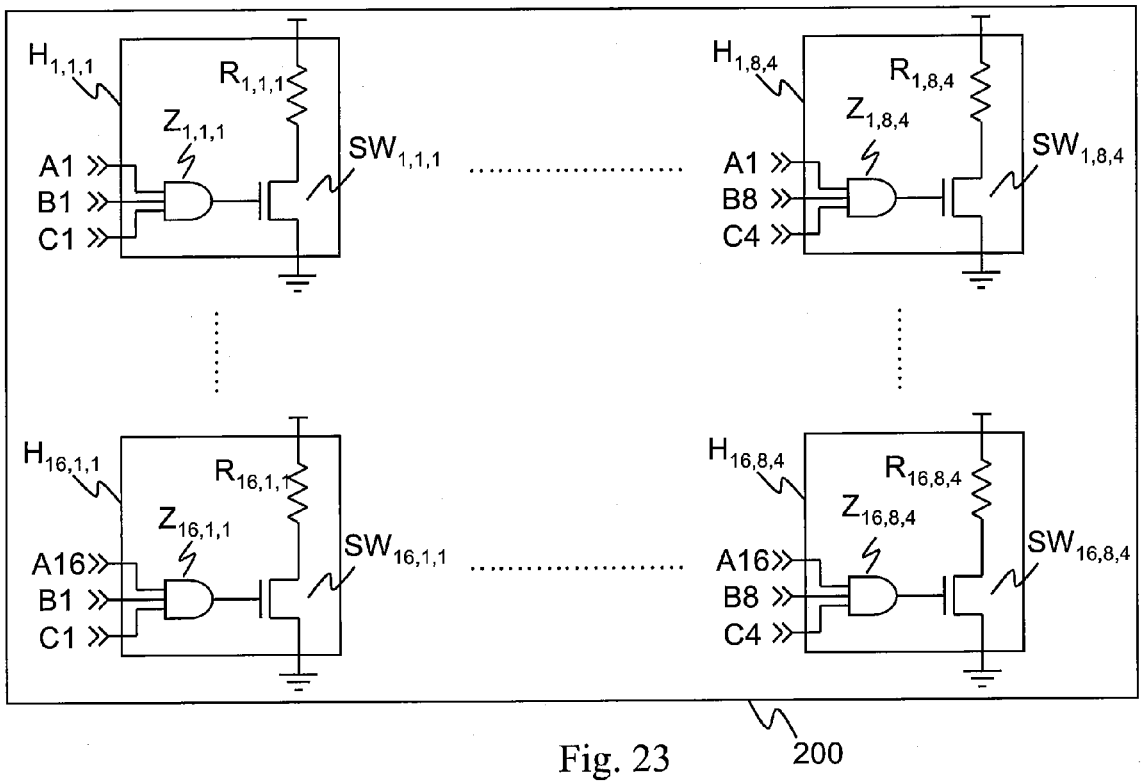
FIG. 23 is a schematic view of an embodiment of the heater circuit in the inkjet module in FIG. 22.

Further, each of the heater circuits (heater circuits $H_{1,1,1}$~$H_{16,1,1}$~$H_{1,8,4}$~$H_{16,8,4}$ respectively) includes an AND gate logic switch (AND gate logic switches $Z_{1,1,1}$~$Z_{16,1,1}$~$Z_{1,8,4}$~$Z_{16,8,4}$ respectively), a transistor switch (transistor switches $M_{1,1,1}$~$M_{16,1,1}$~$M_{1,8,4}$~$M_{16,8,4}$ respectively), and a resistance element (resistance elements $R_{1,1,1}$~$R_{16,1,1}$~$R_{1,8,4}$~$R_{16,8,4}$ respectively), as shown in FIG. 23. The structure of each of the heater circuits is similar to that in FIG. 15, and the details will not be described herein again.

For the heater circuit $H_{1,1,1}$, the AND gate logic switch $Z_{1,1,1}$ receives the address signal A1, the first start signal B1, and the second start signal C1, so as to perform the logical operation. In other words, the heater circuit $H_{1,1,1}$ is driven under the control of the address signal A1, the first start signal B1, and the second start signal C1. For the heater circuit $H_{1,2,1}$, the AND gate logic switch $Z_{1,2,1}$ receives the address signal A1, the first start signal B2, and the second start signal C1, so as to perform the logical operation. In other words, the heater circuit $H_{1,2,1}$ is driven under the control of the address signal A1, the first start signal B2, and the second start signal C1. Likewise, for the heater circuit $H_{16,8,4}$, the AND gate logic switch $Z_{16,8,4}$ receives the address signal A16, the first start signal B8, and the second start signal C4, so as to perform the logical operation. In other words, the heater circuit $H_{16,8,4}$ is driven under the control of the address signal A16, the first start signal B8, and the second start signal C4, so as to control the operation of 512 jet orifices.

Figure 24:
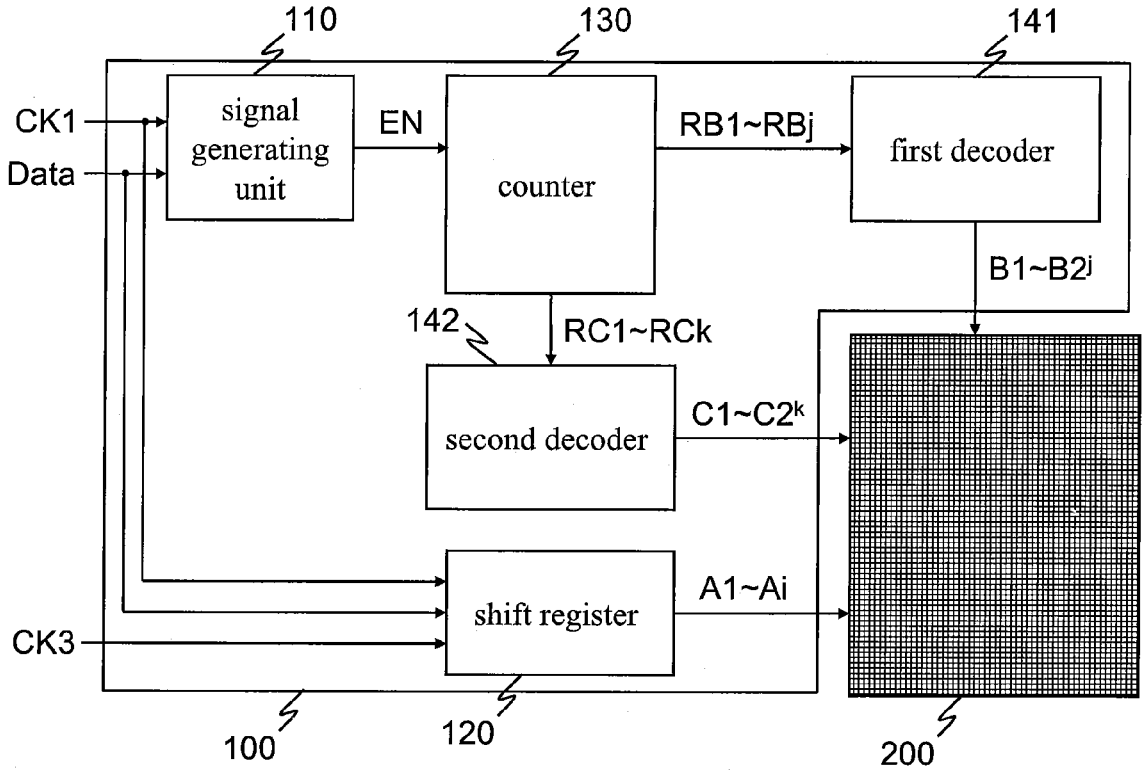
FIG. 24 is a schematic view of the circuit of a multiplexing inkjet print system according to the third embodiment of the present invention.

In another embodiment, the shift register 120 shifts the data Data to generate a group of address signals A1~Ai according to the first clock signal CK1 and the third clock signal CK3, as shown in FIG. 24. The third clock signal CK3 is half of the first clock signal CK1. The structures of the signal generating unit 110, the counter 130, the first decoder 141, the second decoder 142, and the inkjet module 200 can be the same as those mentioned above, and the details will not be described herein again.

Figure 25A:
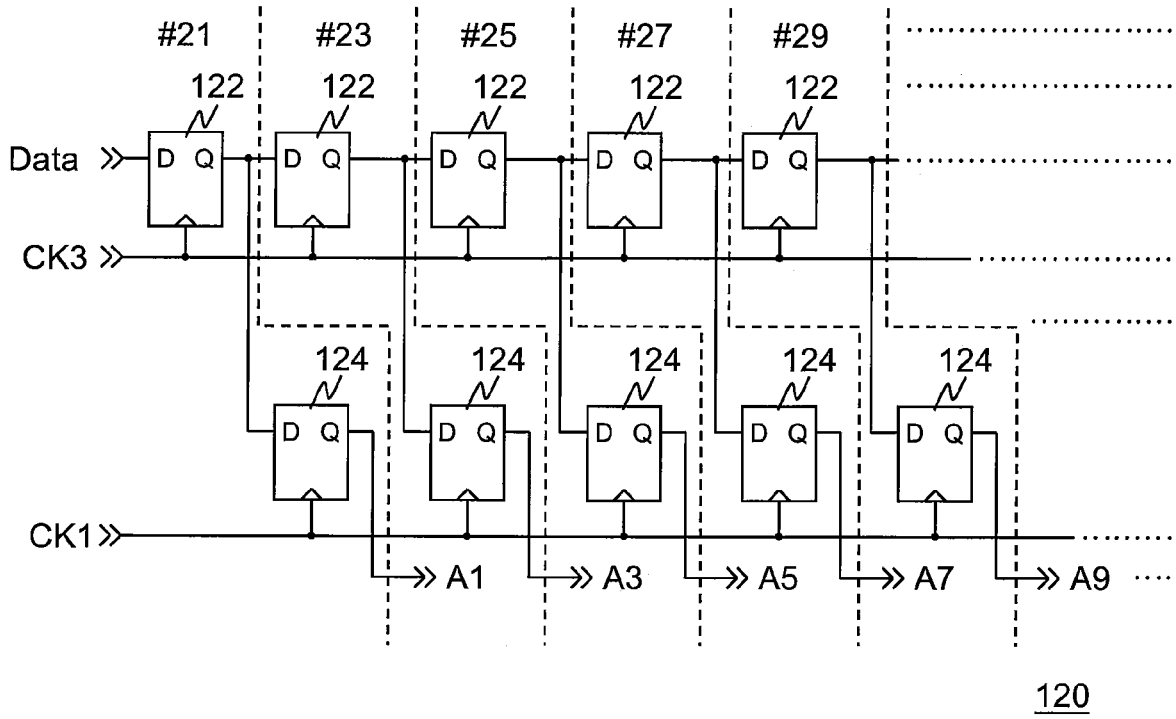
FIGS. 25A, 25B are schematic views of the fourth embodiment of the shift register according to the circuit of a multiplexing inkjet print system of the present invention.
Figure 25B:
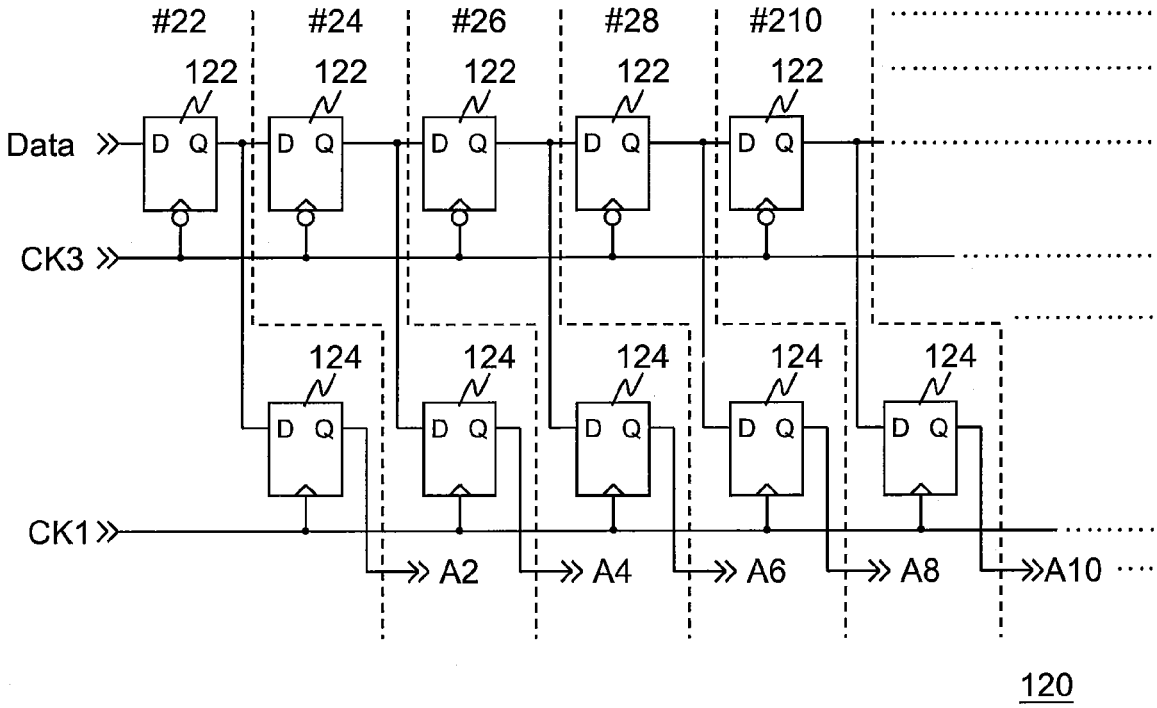

FIGS. 25A, 25B are schematic circuit views of an embodiment of the shift register. The shift register 120 includes i shift sub-circuits (referred to as the first shift sub-circuit to the $i^{th}$ shift sub-circuit for the convenience of illustration, only the tenth shift sub-circuit #210 is shown and the rest are similar). In addition, each shift sub-circuit includes two D-type flip-flops (referred to as the fourth D-type flip-flop 122 and the fifth D-type flip-flop 124 for the convenience of illustration).

In each shift sub-circuit in an odd stage, the fourth D-type flip-flop 122 is of positive-edge trigger; while in each shift sub-circuit in an even stage, the fourth D-type flip-flop 122 is of negative-edge trigger. Moreover, in each shift sub-circuit, the fifth D-type flip-flop 124 is of positive-edge trigger.

The shift register 120 inputs the third clock signal CK3 into the trigger end of each fourth D-type flip-flop 122 and inputs the first clock signal CK1 into the trigger end of each fifth D-type flip-flop 124.

In the first shift sub-circuit #21, the input end D of the fourth D-type flip-flop 122 receives the data Data, and the output end Q thereof is electrically connected to the input end D of the fifth D-type flip-flop 124 and to the input end D of the fourth D-type flip-flop 122 of the shift sub-circuit in the next odd stage (i.e., the third shift sub-circuit #23). Therefore, the fifth D-type flip-flop 124 of the first shift sub-circuit #21 outputs the address signals A1 from the output end Q according to the output of the fourth D-type flip-flop 122 and the first clock signal CK1.

In the second shift sub-circuit #22, the input end D of the fourth D-type flip-flop 122 receives the data Data, and the output end Q thereof is electrically connected to the input end D of the fifth D-type flip-flop 124 and to the input end D of the fourth D-type flip-flop 122 of the shift sub-circuit in the next even stage (i.e., the fourth shift sub-circuit #24). Therefore, the fifth D-type flip-flop 124 of the second shift sub-circuit #22 outputs the address signals A2 from the output end Q according to the output of the fourth D-type flip-flop 122 and the first clock signal CK1.

Then, in the shift sub-circuit in an odd stage (i.e., from the third shift sub-circuit #23), the input end D of the fourth D-type flip-flop 122 is electrically connected to the output end Q of the fourth D-type flip-flop 122 of the shift sub-circuit in the preceding odd stage, and the output end Q thereof is electrically connected to the input end D of the fifth D-type flip-flop 124 and the input end D of the fourth D-type flip-flop 122 of the shift sub-circuit in the next odd stage. Thus, the fifth D-type flip-flop 124 outputs the address signal from the output end Q according to the output of the fourth D-type flip-flop 122 and the first clock signal CK1, and so forth, until the shift sub-circuit in the last odd stage. In the shift sub-circuit in the last odd stage, the input end D of the fourth D-type flip-flop 122 is electrically connected to the output end Q of the fourth D-type flip-flop 122 of the shift sub-circuit in the preceding odd stage, the output end Q of the fourth D-type flip-flop 122 is only electrically connected to the input end D of the fifth D-type flip-flop 124, so the fifth D-type flip-flop 124 outputs the address signal from the output end Q according to the output of the fourth D-type flip-flop 122 and the first clock signal CK1.

Similarly, in the following shift sub-circuit in an even stage (i.e., from the fourth shift sub-circuit #24), the input end D of the fourth D-type flip-flop 122 is electrically connected to the output end Q of the fourth D-type flip-flop 122 of the shift sub-circuit in the preceding stage, and the output end Q thereof is electrically connected to the input end D of the fifth D-type flip-flop 124 and the input end D of the fourth D-type flip-flop 122 of the shift sub-circuit in the next even stage. Thus, the fifth D-type flip-flop 124 outputs the address signal from the output end Q according to the output of the fourth; D-type flip-flop 122 and the first clock signal CK1, and so forth, until the shift sub-circuit in the last even stage. In the shift sub-circuit in the last even stage, the input end D of the fourth D-type flip-flop 122 is electrically connected to the output end Q of the fourth D-type flip-flop 122 of the shift sub-circuit in the preceding stage, the output end Q of the fourth D-type flip-flop 122 is only electrically connected to the input end D of the fifth D-type flip-flop 124, so the fifth D-type flip-flop 124 outputs the address signal from the output end Q according to the output of the fourth D-type flip-flop 122 and the first clock signal CK1.

Figure 26A:
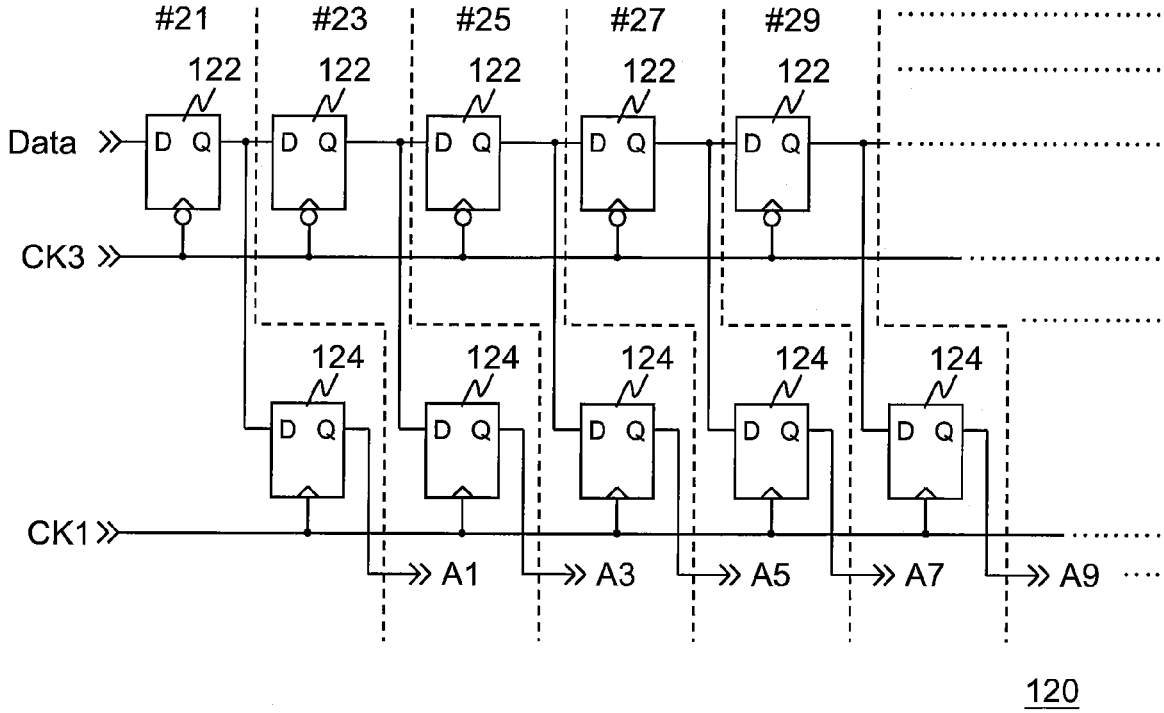
FIGS. 26A, 26B are schematic views of the fifth embodiment of the shift register according to the circuit of a multiplexing inkjet print system of the present invention.
Figure 26B:
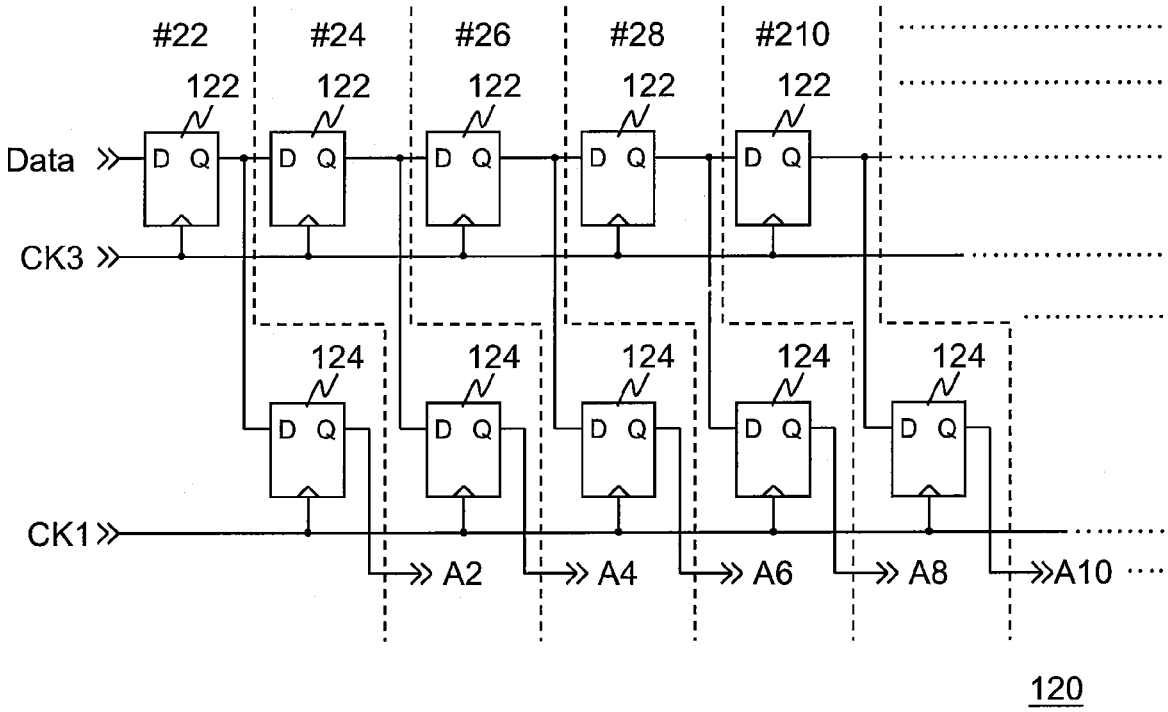

Further, in the shift register 120, the fourth D-type flip-flop 122 in each shift sub-circuit in an odd stage is of negative-edge trigger and the fourth D-type flip-flop 122 in each shift sub-circuit in an even stage is of positive-edge trigger. The fifth D-type flip-flop 124 in each shift sub-circuit is of positive-edge trigger, as shown in FIGS. 26A, 26B.

As such, the number of the jet orifices can be greatly increased by changing the above i, j and k together with the data required to be printed and/or the designed number of the jet orifices, without greatly raising the number of the external contacts.

In other words, the number of the shift sub-circuits and/or the number of the counting sub-circuits can be designed according to the data to be printed and/or the number of the designed jet orifices, so as to generate the desired number of the address signals and time counting signals, and to decode the time counting signals via proper decoders for generating desired number of the address signals, first start signals, and second start signals, thereby controlling the operation of a large number of jet orifices.

Though two decoders (i.e., the first decoder and the second decoder) are adopted above, the first decoder and the second decoder can also be combined to be a single decoder in the circuit design.

Figure 27A:
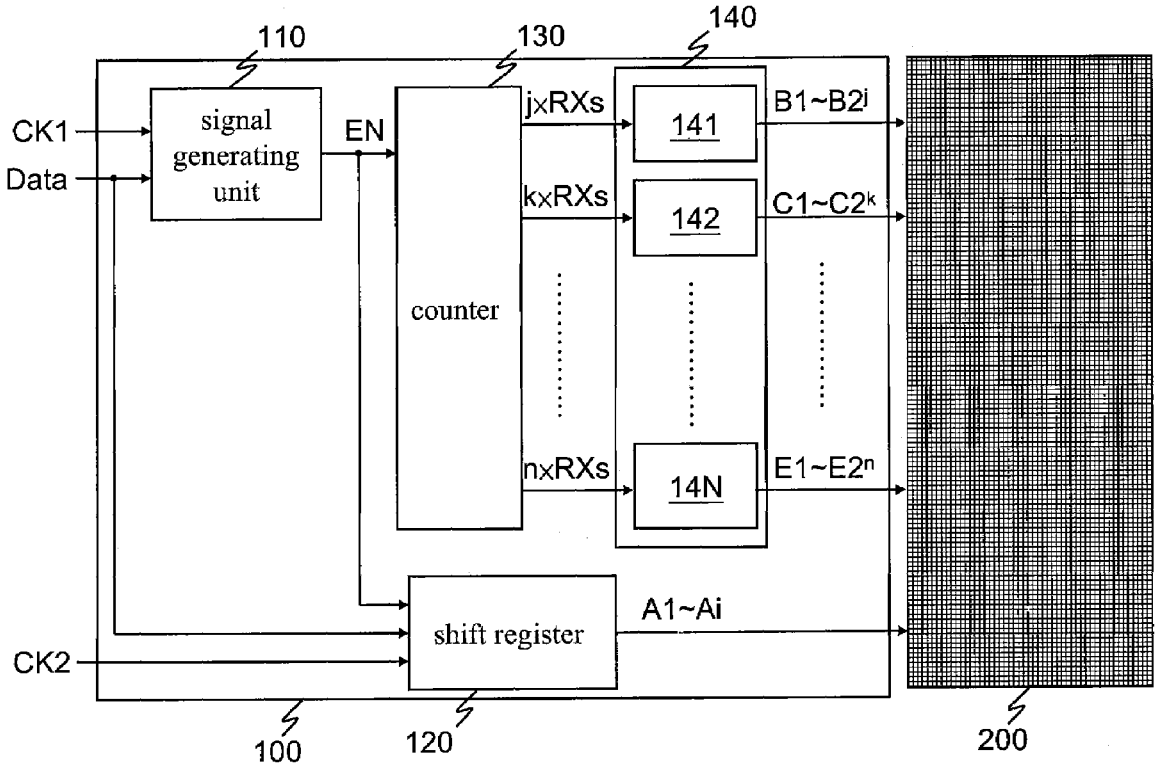
FIG. 27A is a schematic view of the circuit of a multiplexing inkjet print system according to the fourth embodiment of the present invention.
Figure 27B:
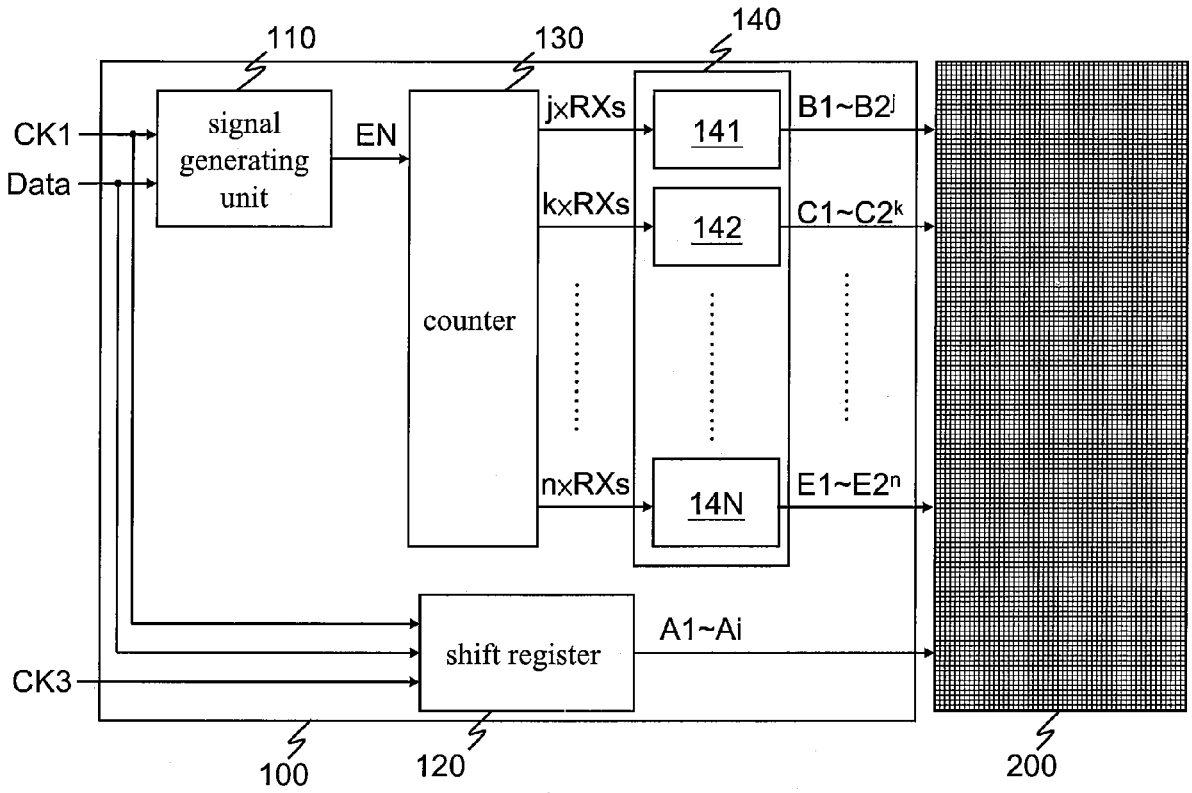
FIG. 27B is a schematic view of the circuit of a multiplexing inkjet print system according to the fifth embodiment of the present invention.

In order to further reduce the number of the external contacts, the time counting signals generated by the counter 130 are divided into three, four, or more groups, and are decoded by a decoder respectively. Referring to FIGS. 27A, 27B, the circuit of a multiplexing inkjet print system includes a control circuit 100 and an inkjet module 200. The control circuit 100 includes a signal generating unit 110, a shift register 120, a counter 130, and a decoding module 140. In addition, the decoding module 140 includes N decoders (i.e., the first decoder 141, the second decoder to the $N^{th}$ decoder 142~14N). The structures and operating principles of the signal generating unit 110, shift register 120, and inkjet module 200 are similar to those mentioned above, and the details will not be described herein again.

Figure 28:
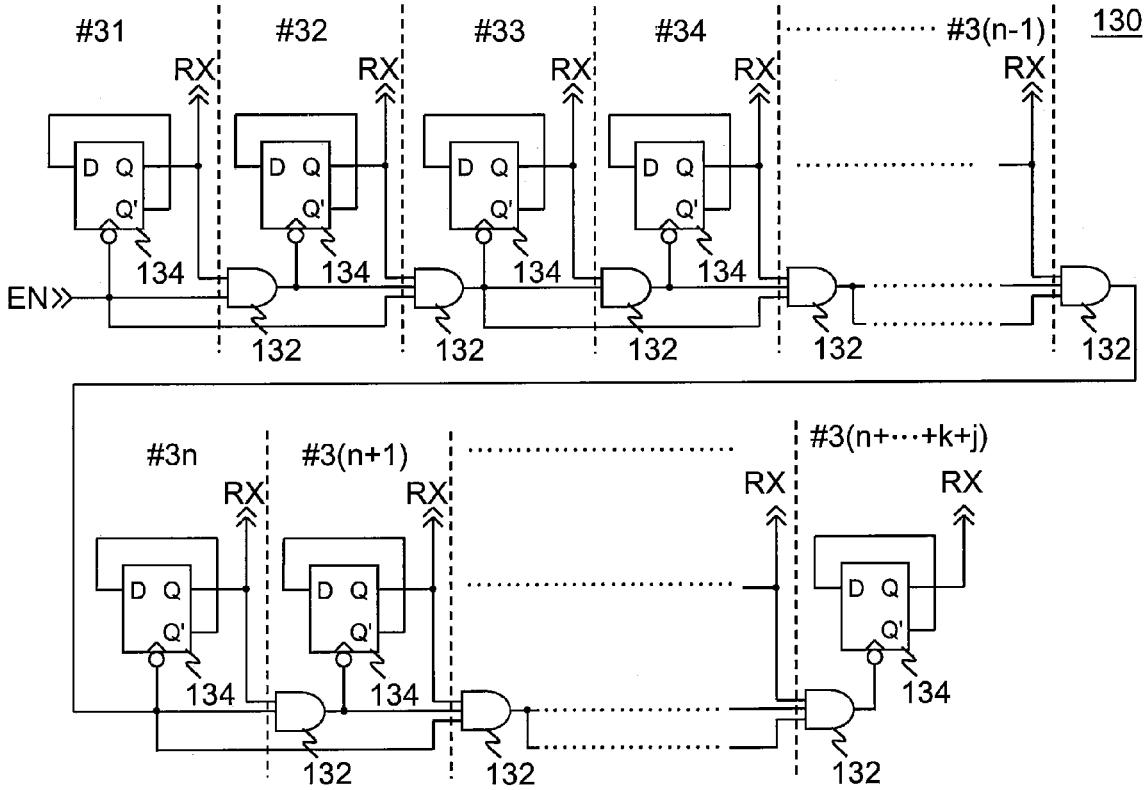
FIG. 28 is a schematic view of the tenth embodiment of the counter according to the circuit of a multiplexing inkjet print system of the present invention.

Further, the structure of the counter 130 is similar to that mentioned above, which includes a plurality of counting sub-circuits (referred to as the first counting sub-circuit to the $(n+\ldots+k+j)^{th}$ counting sub-circuit #31, #32, #33, #34~#3(n−1), #3*n*, #3(n+1)~#3(n+ . . . +k+j) for the convenience of illustration). The first counting sub-circuit #31 includes a sixth D-type flip-flop 134, and the second to the $(n+\ldots+k+j)_{th}$ counting sub-circuit #32~#3(n+ . . . +k+j) include an AND gate logic switch 132 and a sixth D-type flip-flop 134, so as to generate N groups of time counting signals RX (i.e., the first group of time counting signals j×RXs, the second group of time counting signals k×RXs to the $N^{th}$ group of time counting signals n×RXs as shown in FIGS. 27A, 27B) according to the enable signal EN, and output each group of the time counting signal R to the corresponding decoder (i.e., the first decoder to the $N^{th}$ decoder 141~14N), as shown in FIG. 28.

Figure 29:
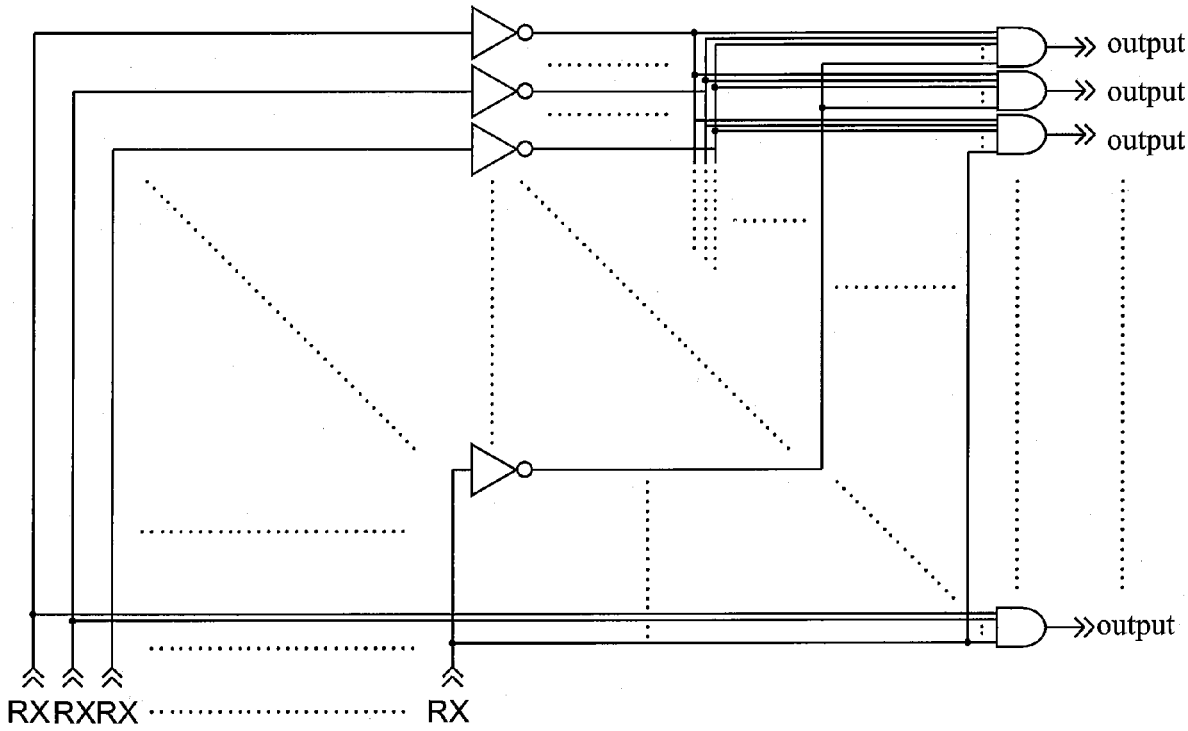
FIG. 29 is a schematic view of an embodiment of the decoder in the circuit of a multiplexing inkjet print system in FIG. 27A or FIG. 27B.

Each decoder includes a plurality of inverters and a plurality of gate logic switches, as shown in FIG. 29, wherein the structure and operating principle are known to those skilled in the art, and the details will not be described herein again. Each decoder (i.e., the first decoder to the $N^{th}$ decoder 141~14N) respectively receives and then decodes a group of time counting signals R (i.e., the first group of time counting signals j×Rs, the second group of time counting signals k×Rs to the $N_{th}$ group of time counting signals n×Rs), so as to respectively output a group of start signals (i.e., the first start signals B1~B2$^j$, the second start signals C1~C2$^k$ to the $N^{th}$ start signals E1~E2$^n$), as shown in FIGS. 27A, 27B.

Finally, the address signals A1~Ai and N groups of start signals (i.e., the first start signals B1~B2$^j$, the second start signals C1~C2$^k$ to the $N_{th}$ start signals E1~E2$^n$) are input into the inkjet module 200 to control the operation thereof. That is, the drive control of $i\times 2^j\times 2^k\times\ldots\times 2^n$ heater circuits can be achieved by the random combinations of the address signals A1~Ai and N groups of start signals (i.e., the first start signals B1~B2$^j$, the second start signals C1~C2$^k$ to the $N_{th}$ start signals E1~E2$^n$), thereby controlling the operation of $i\times 2^j\times 2^k\times\ldots\times 2^n$ jet orifices, wherein i, j, k, and n are all positive integers.

Figure 30:
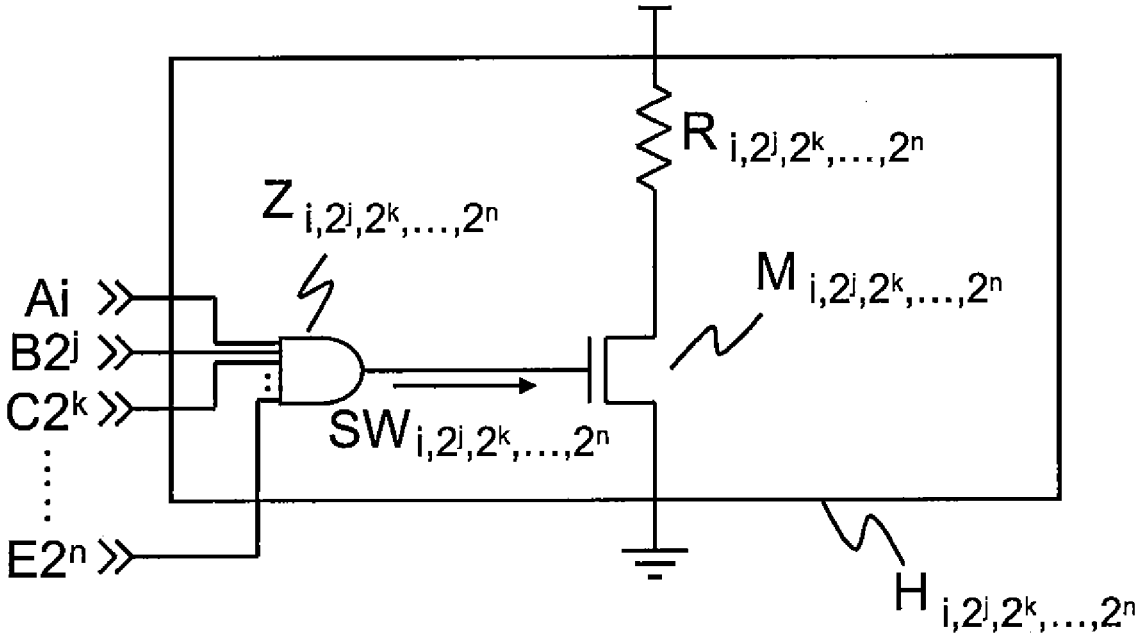
FIG. 30 is a schematic view of an embodiment of the heater circuit constituting the inkjet module in the circuit of a multiplexing inkjet print system in FIG. 27A or FIG. 27B.

FIG. 30 is a schematic circuit view of an embodiment of the heater circuit. The heater circuit $H_{i,2^j,2^k,\ldots,2^n}$ includes an AND gate logic switch $Z_{i,2^j,2^k,\ldots,2^n}$ a transistor switch $M_{i,2^j,2^k,\ldots,2^n}$ and a resistance element $R_{i,2^j,2^k,\ldots,2^n}$.

The input end of the AND gate logic switch $Z_{i,2^j,2^k,\ldots,2^n}$ is electrically connected to the shift register 120 and each decoder in the decoding module 140 (i.e., the first decoder to the $N_{th}$ decoder 141~14N), so as to receive an address signal Ai from the shift register 120 and a start signal (i.e., the first start signal B2$^j$, the second start signal C2$^k$ to the $N^{th}$ start signal E2$^n$) from each decoder (i.e., the first decoder to the $N^{th}$ decoder 141~14N) respectively. The input end of the AND gate logic switch $Z_{i,2^j,2^k,\ldots,2^n}$ is electrically connected to the gate of the transistor switch $M_{i,2^j,2^k,\ldots,2^n}$ That is, the AND gate logic switch $Z_{i,2^j,2^k,\ldots,2^n}$ performs the logic operation on the received address signal Ai and the start signals (i.e., the first start signals B2$^j$, the second start signals C2$^k$ to the $N^{th}$ start signal E2$^n$), so as to output a drive signal $SW_{i,2^j,2^k,\ldots,2^n}$ to control the on/off of the transistor switch $M_{i,2^j,2^k,\ldots,2^n}$. Moreover, the source of the transistor switch $M_{i,2^j,2^k,\ldots,2^n}$ is grounded, the drain thereof is electrically connected to one end of the resistance element $R_{i,2^j,2^k,\ldots,2^n}$ and a proper voltage is applied to the other end of the resistance element $R_{i,2^j,2^k,\ldots,2^n}$.

When the address signal Ai and each start signal (i.e., the first start signal B2$^j$, the second start signal C2$^k$ to the $N^{th}$ start signal E2$^n$) are both logic high signals "1", the drive signal $SW_{i,2^j,2^k,\ldots,2^n}$ of logic high signal "1" is generated after the operation of the AND gate logic switch $Z_{i,2^j,2^k,\ldots,2^n}$, so as to turn on the transistor switch $M_{i,2^j,2^k,\ldots,2^n}$. At this time, the resistance element $R_{i,2^j,2^k,\ldots,2^n}$ starts operating to generate heat, thereby driving the corresponding number of orifices to jet ink for printing. As such, a few of control signals are used to significantly increase the number of the jet orifices without greatly increasing the number of the external contacts. Moreover, the jet orifices corresponding to the section data can be directly selected according to the data required to be printed.

Figure 31A:
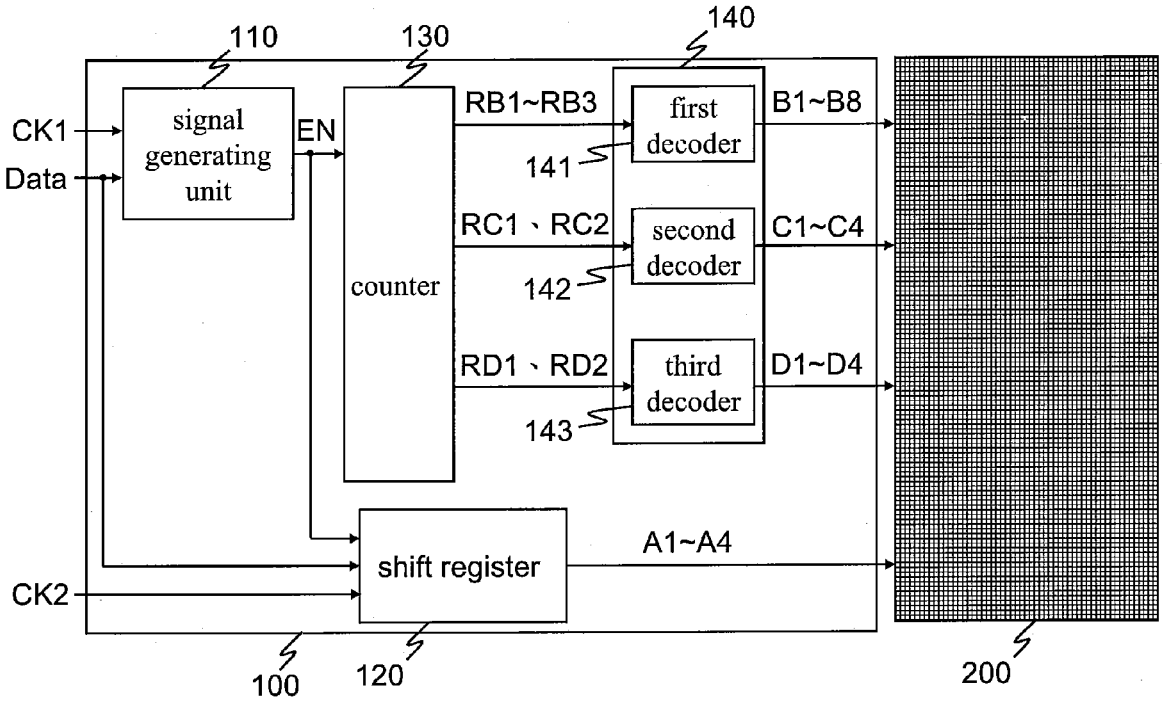
FIG. 31A is a schematic view of the circuit of a multiplexing inkjet print system according to the sixth embodiment of the present invention.
Figure 31B:
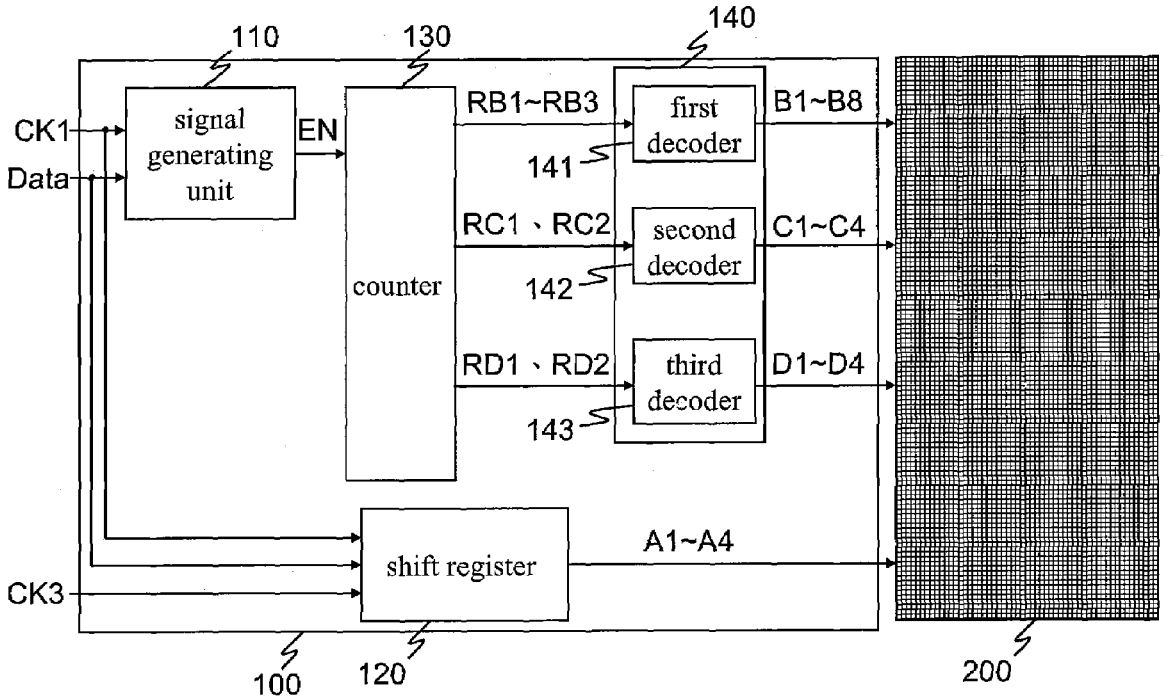
FIG. 31B is schematic view of the circuit of a multiplexing inkjet print system according to the seventh embodiment of the present invention.

For the convenience of illustration, three decoders are used to control the drive of 512 jet orifices. Referring to FIGS. 31A, 31B, the circuit of a multiplexing inkjet print system includes a control circuit 100 and an inkjet module 200. The control circuit 100 includes a signal generating unit 110, a shift register 120, a counter 130, and a decoding module 140. The decoding module 140 includes a first decoder 141, a second decoder 142, and a third decoder 143. The structures and operating principles of the signal generating unit 110, shift register 120, and inkjet module 200 are similar to those described above, and the details will not be described herein again.

Figure 32A:
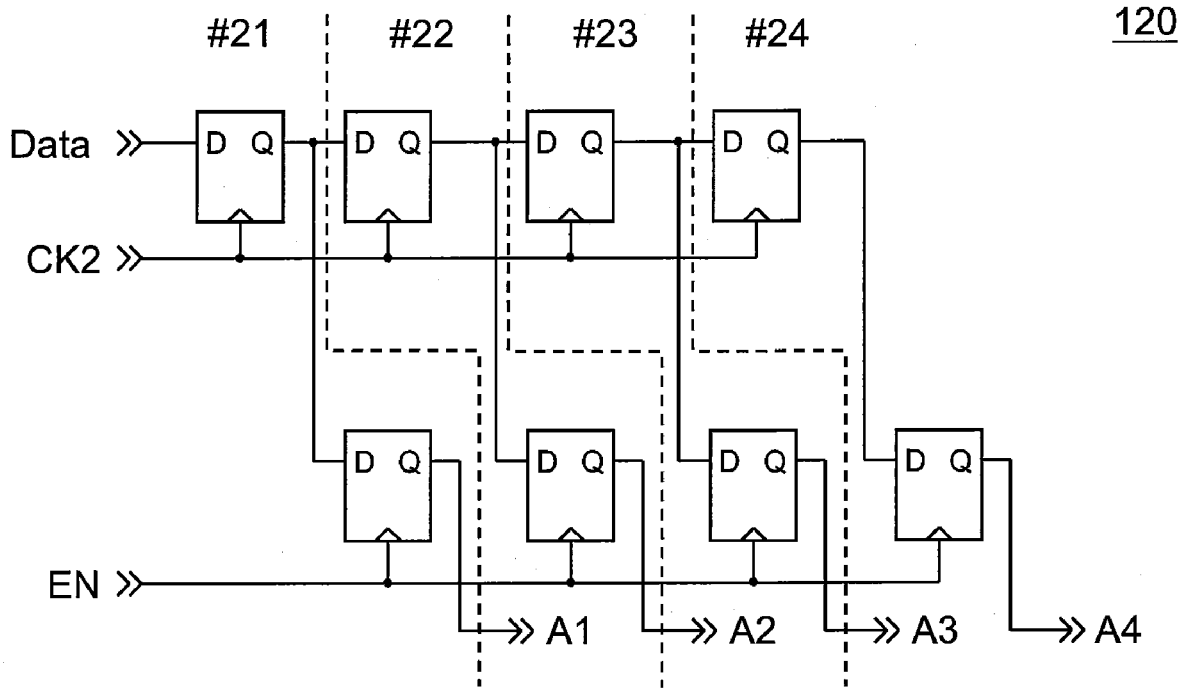
FIG. 32A is a schematic view of the sixth embodiment of the shift register according to the circuit of a multiplexing inkjet print system of the present invention.
Figure 32B:
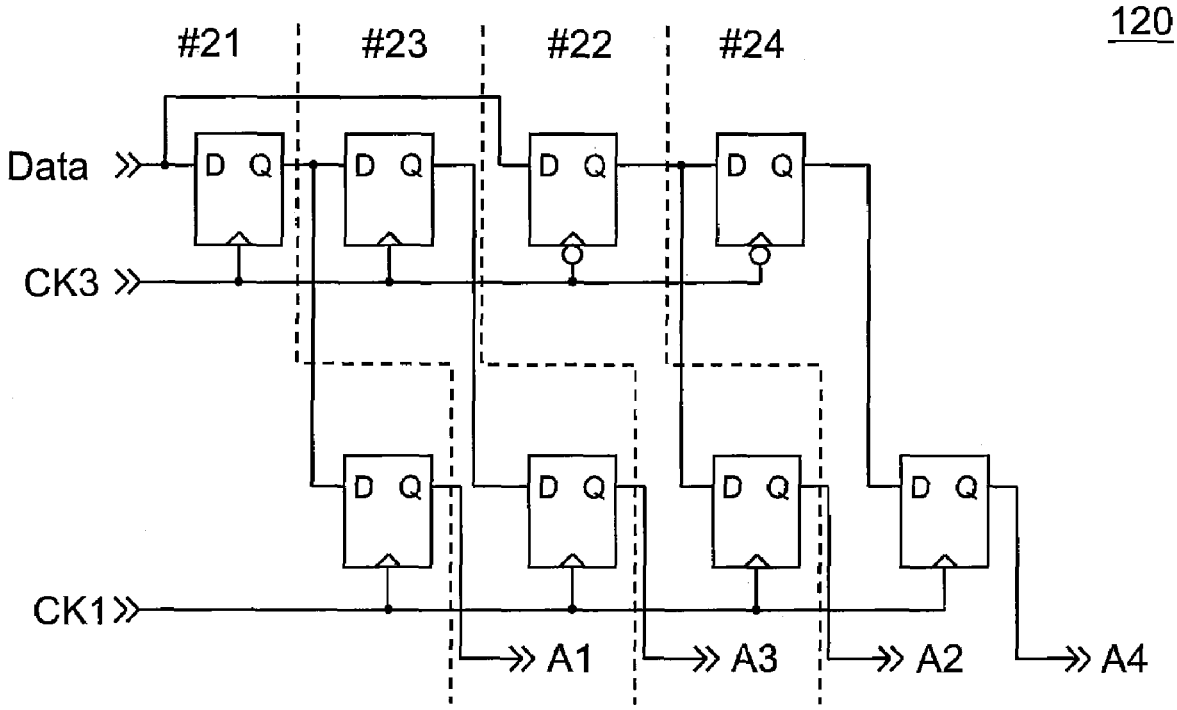
FIG. 32B is a schematic view of the seventh embodiment of the shift register according to the circuit of a multiplexing inkjet print system of the present invention.
Figure 32C:
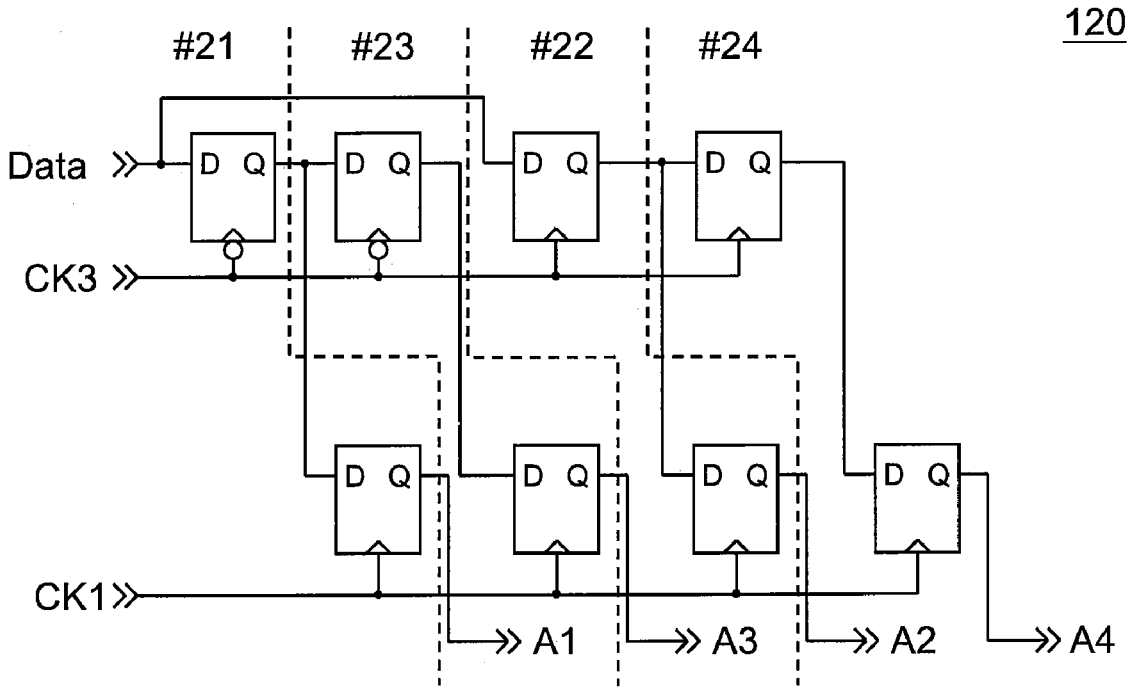
FIG. 32C is a schematic view of the eighth embodiment of the shift register according to the circuit of a multiplexing inkjet print system of the present invention.
Figure 33:
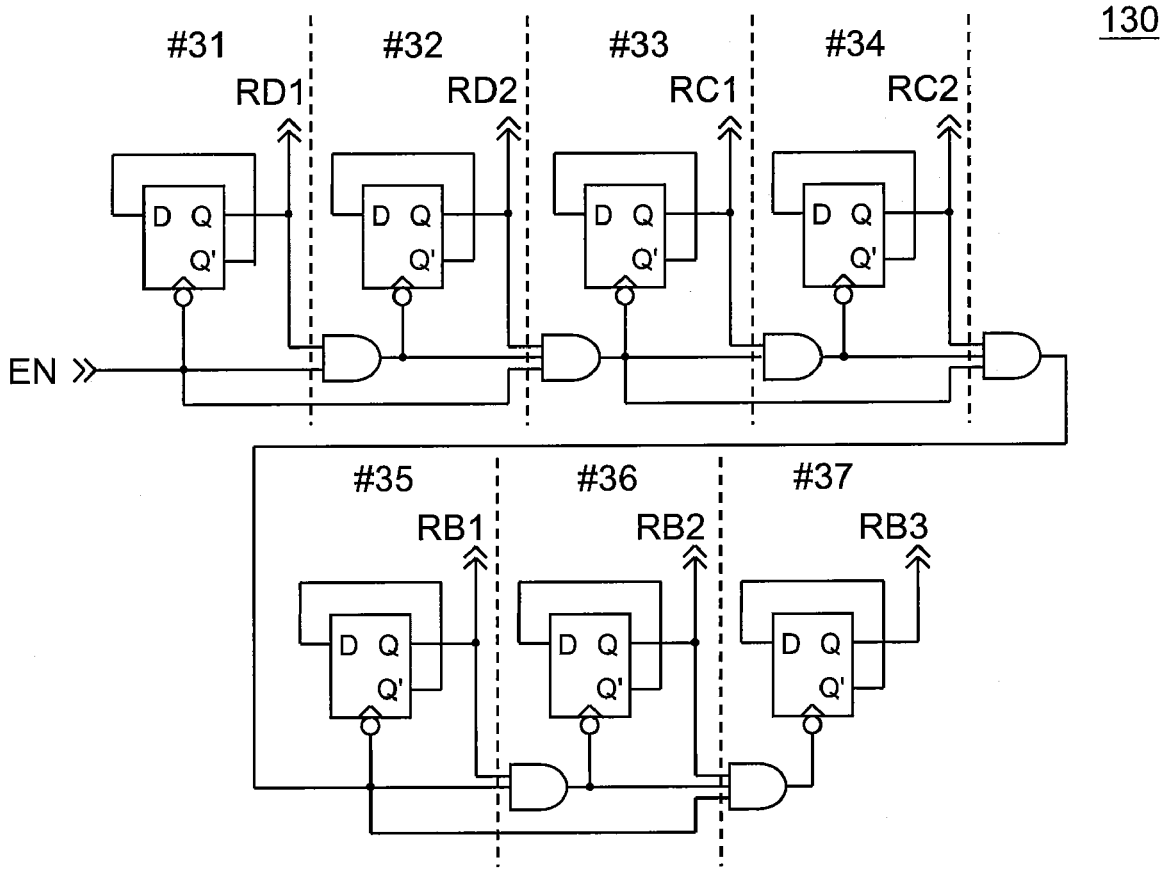
FIG. 33 is a schematic view of the eleventh embodiment of the counter according to the circuit of a multiplexing inkjet print system of the present invention.
Figure 34:
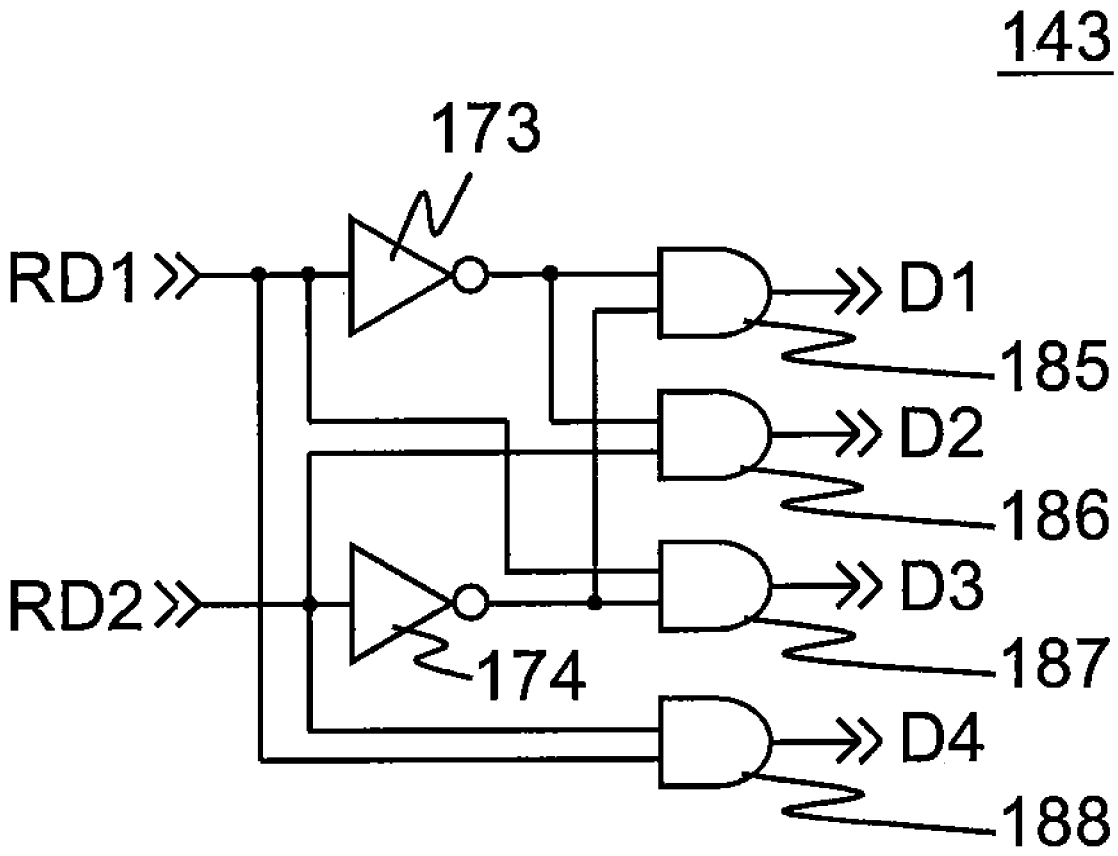
FIG. 34 is a schematic view of an embodiment of the third decoder according to the circuit of a multiplexing inkjet print system of the present invention.

The shift register 120 has four shift sub-circuits (i.e., the first shift sub-circuit #21, the second shift sub-circuit #22, the third shift sub-circuit #23, and the fourth shift sub-circuit #24 respectively), so as to generate four address signals A1~A4 (as shown in FIGS. 32A, 32B, 32C) according to the data Data, the second clock signal CK2, and the enable signal EN (or according to the data Data, the first clock signal CK1, and the third clock signal CK3). The counter 130 has seven shift sub-circuits (i.e., the first shift sub-circuit #31, the second shift sub-circuit #32, the third shift sub-circuit #33, the fourth shift sub-circuit #34, the fifth shift sub-circuit #35, the sixth shift sub-circuit #36, and the seventh shift sub-circuit #37), so as to count to generate seven time counting signals RB1~RB3, RC1, RC2, RD1, RD2 (as shown in FIG. 33) according to the enable signal EN. Then, the time counting signals RB1~RB3, RC1, RC2, RD1, RD2 are divided into three groups and respectively output to the first decoder 141, the second decoder 142, and the third decoder 143. The first decoder 141 is a 3-to-8($=2^3$) decoder, which includes three inverters 151, 152, 153 and 8 AND gate logic switches 161~168. $2^3$(=8) first start signals B1~B8 are generated according to the time counting signals RB1~RB3 through the combinations of the inverters 151, 152, 153 and the AND gate logic switches 161~168, as shown in FIG. 19. The second decoder 142 is a 2-to-4($=2^2$) decoder, which includes two inverters 171, 172 and 4 AND gate logic switches 181, 182, 183, 184. $2^2$(=4) second start signals C1~C4 are generated according to the time counting signals RC1, RC2 through the combinations of the inverters 171, 172 and the AND gate logic switches 181~184, as shown in FIG. 20. The third decoder 143 is a 2-to-4($=2^2$) decoder, which includes two inverters 173, 174 and four AND gate logic switches 185, 186, 187, 188. $2^2$(=4) third start signals D1~D4 are generated according to the time counting signals RD1, RD2 through the combinations of the inverters 173, 174 and the AND gate logic switches 185~188, as shown in FIG. 34.

Figure 35:
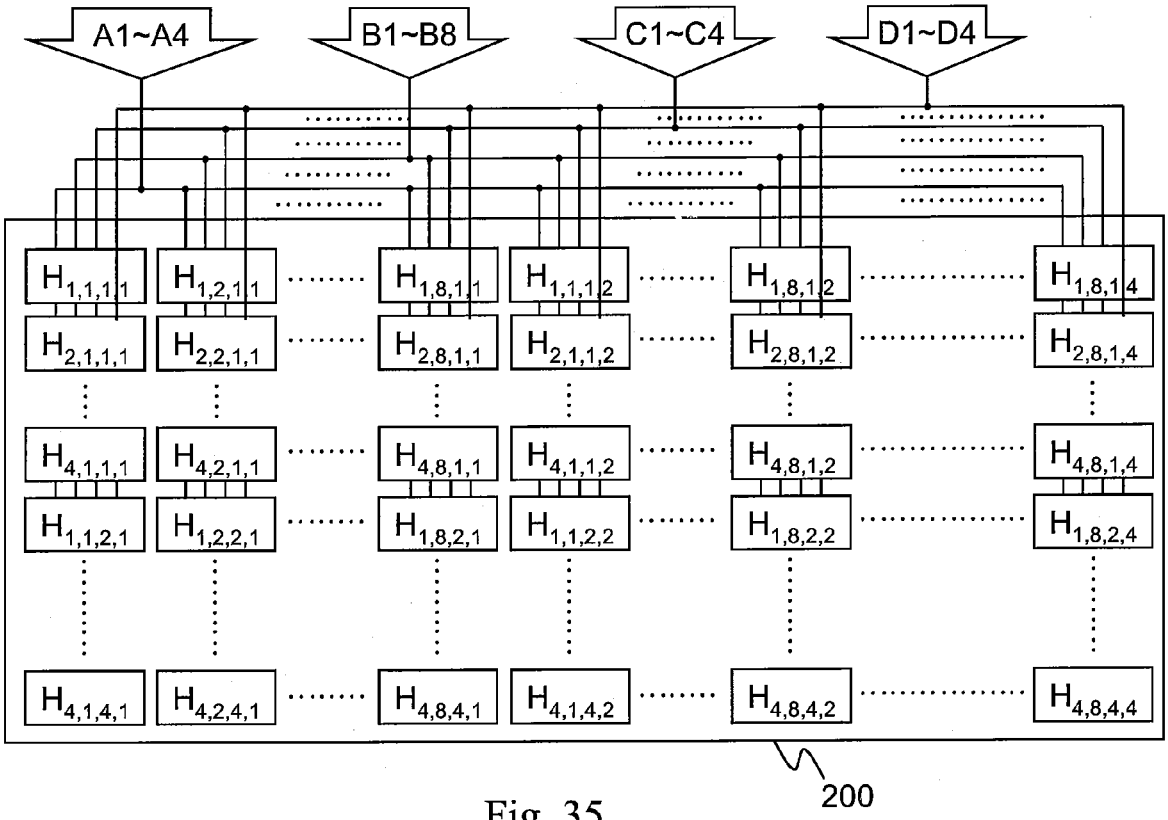
FIG. 35 is a schematic view of the third embodiment of the inkjet module according to the circuit of a multiplexing inkjet print system of the present invention.

Finally, the address signals A1~A4, the first start signals B1~B8, the second start signals C1~C4, and the third start signals D1~D4 are input into the inkjet module 200 to control the operation thereof. The drive control of $4\times2^3\times2^2\times2^2$(=4×8×4×4=512) heater circuits $H_{1,1,1,1}$, $H_{2,1,1,1}$~$H_{4,1,1,1}$, $H_{1,1,2,1}$~$H_{4,1,4,1}$, $H_{1,2,1,1}$, $H_{2,2,1,1}$~$H_{4,2,1,1}$, $H_{1,2,2,1}$~$H_{4,2,4,1}$~$H_{1,8,1,1}$, $H_{2,8,1,1}$~$H_{4,8,1,1}$, $H_{1,8,2,1}$~$H_{4,8,4,1}$, $H_{1,1,1,2}$, $H_{2,1,1,2}$~$H_{4,1,1,2}$, $H_{1,1,2,2}$~$H_{4,1,4,2}$~$H_{1,8,1,2}$, $H_{2,8,1,2}$~$H_{4,8,1,2}$, $H_{2,8,1,2}$~$H_{4,8,1,2}$, $H_{1,8,2,2}$~$H_{4,8,4,2}$~$H_{1,8,1,4}$, $H_{2,8,1,4}$~$H_{4,8,1,4}$, $H_{1,8,2,4}$~$H_{4,8,4,4}$ is achieved through the random combinations of the address signals A1~A4, the first start signals B1~B8, the second start signals C1~C4, and the third start signals D1~D4, so as to control the operation of $4\times2^3\times2^2\times2^2$ (=4×8×4×4=512)jet orifices, as shown in FIG. 35.

Figure 36:
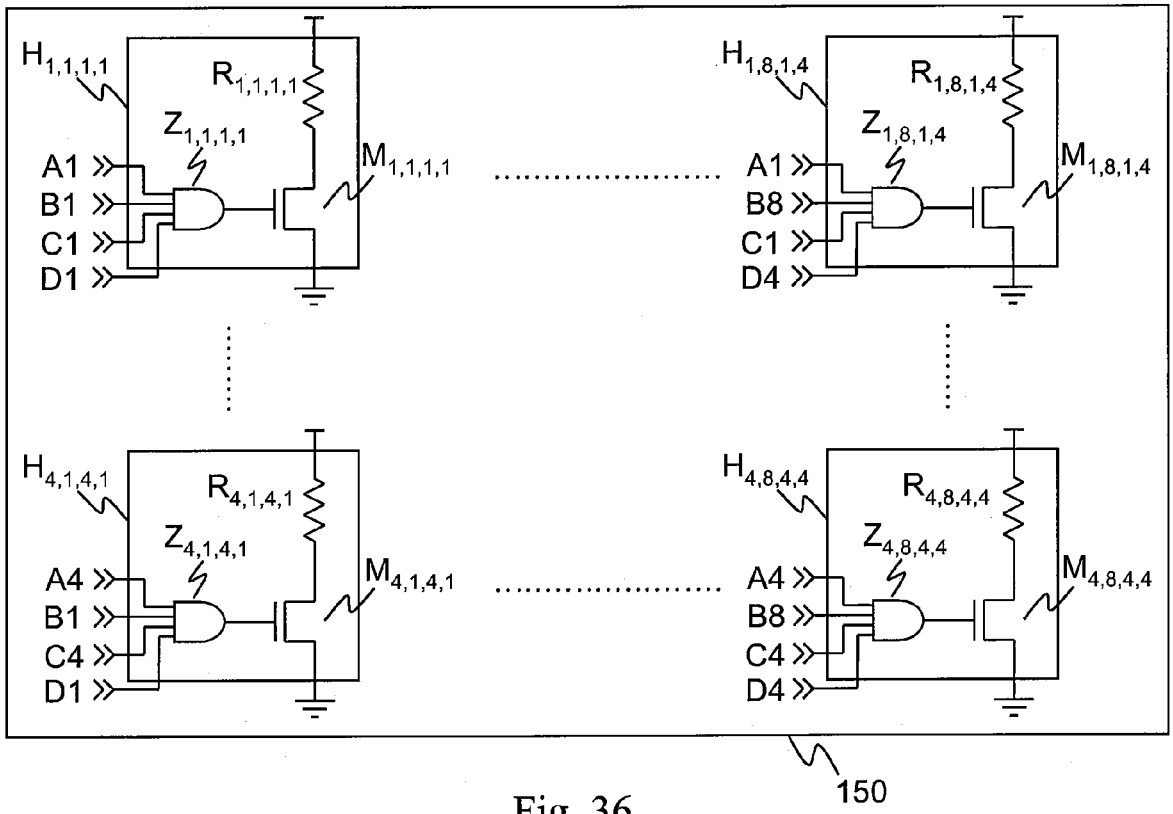
FIG. 36 is a schematic view of an embodiment of the heater circuit in the inkjet module in FIG. 35.

Moreover, each of the heater circuits (i.e., heater circuits $H_{1,1,1,1}$~$H_{4,1,4,1}$~$H_{1,8,1,4}$~$H_{4,8,4,4}$ respectively) includes an AND gate logic switch (i.e., AND gate logic switches $Z_{1,1,1,1}$~$Z_{4,1,4,1}$~$H_{1,8,1,4}$~$Z_{4,8,4,4}$ respectively), a transistor switch (i.e., transistor switches $M_{1,1,1,1}$~$M_{4,1,4,1}$~$M_{1,8,1,4}$~$M_{4,8,4,4}$ respectively) and a resistance element (i.e., resistance elements $R_{1,1,1,1}$~$R_{4,1,4,1}$~$R_{1,8,1,4}R_{4,8,4,4}$ respectively), as shown in FIG. 36. The structure of each of the heater circuits is similar to that in FIG. 15, so the operating principle thereof will not be described herein again.

For the heater circuit $H_{1,1,1,1}$, the AND gate logic switch $Z_{1,1,1,1}$ receives the address signal A1, the first start signal B1, the second start signal C1, and the third start signal D1 to perform logical operation. That is, the heater circuit $H_{1,1,1,1}$ is driven under the control of the address signal A1, the first start signal B1, the second start signal C1, and the third start signal D1. Likewise, for the heater circuit $H_{4,8,4,4}$, the AND gate logic switch $Z_{4,8,4,4}$ receives the address signal A4, the first start signal B8, the second start signal C4, and the third start signal D4 to perform logical operation. That is, the heater circuit $H_{4,8,4,4}$ is driven under the control of the address signal A4, the first start signal B8, the second start signal C4, and the third start signal D4, so as to control the operation of 512 jet orifices.

The transistor switch can be an FET with a high channel width-to-length ratio, so as to reduce the parasitic resistance of series connection, thereby concentrating the power on the thermal resistance. The FET can be a high-power device with a high channel width-to-length ratio. Moreover, directed to an inkjet printhead of small droplets, as the printhead requires a low power to spurt out a single drop, the power generated by the resistance element can be reduced by increasing the resistance of the resistance element without increasing the voltage provided by the host.

Further, the transistor switch can also be an asymmetric MOSFET for getting low driving transistor resistance and small transistor area. In addition, the drain of the asymmetric MOSFET is a DDD, and the source thereof is of a low voltage N+ type diffuse structure, so as to reduce the parasitic resistance.

Moreover, the flip-flop in use can be constituted of CMOS-FET, so as to reduce the power consumption and correspondingly reduce the power consumption of the control circuit of the whole inkjet chip to the minimum. In fact, for quite a long time of printing, the element mainly affecting the temperature of the inkjet chip is the resistance element inside the inkjet module. When the power consumption of the control circuit in operation is reduced, the heat generated is reduced to the minimum. As such, the temperature control element can preciously read the heat generated due to the power consumption of the thermal resistance (i.e., the resistance element inside the inkjet module).

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A control circuit of a multiplexing inkjet print system, for driving at least one heater circuit, comprising:

a signal generating unit, for generating an enable signal according to a first clock signal and a data;

a shift register, electrically connected to the signal generating unit, for shifting the data according to the enable signal and a second clock signal, so as to generate i address signals, wherein i is a positive integer;

a counter, electrically connected to the signal generating unit, for counting according to the enable signal, so as to generate a plurality of time counting signals; and N decoders, electrically connected to the counter, for respectively receiving a portion of the time counting signals, wherein each of the decoders is used to decode the received time counting signals to generate a plurality of start signals, and N is a positive integer equal to or greater than 2;

wherein the drive control of the heater circuit is achieved through the address signals and N groups of the start signals.

2. The control circuit of a multiplexing inkjet print system according to claim 1, wherein the signal generating unit comprises:

a first D-type flip-flop, the inverted output end of the first D-type flip-flop being fed back to the input end of the first D-type flip-flop, and the trigger end of the first D-type flip-flop receiving the first clock signal;

a second D-type flip-flop, connected in parallel with the first D-type flip-flop, the inverted output end of the second D-type flip-flop being fed back to the input end of the second D-type flip-flop, and the trigger end of the second D-type flip-flop receiving the first clock signal;

an OR gate logic switch, the input end of the OR gate logic switch being electrically connected to the output end of the first D-type flip-flop and the output end of the second D-type flip-flop; and an AND gate logic switch, for outputting the enable signal according to the data and the output of the OR gate logic switch.

3. The control circuit of a multiplexing inkjet print system according to claim 1, wherein the signal generating unit comprises:

a plurality of inverters;

a first D-type flip-flop, the output end of the first D-type flip-flop being fed back to the input end of the first D-type flip-flop via one of the inverters, and the trigger end of the first D-type flip-flop receiving the first clock signal;

a second D-type flip-flop, connected in parallel with the first D-type flip-flop, the output end of the second D-type flip-flop being fed back to the input end of the second D-type flip-flop via another inverter, and the trigger end of the second D-type flip-flop receiving the first clock signal;

an OR gate logic switch, the input end of the OR gate logic switch being electrically connected to the output end of the first D-type flip-flop and the output end of the second D-type flip-flop; and an AND gate logic switch, for outputting the enable signal according to the data and the output of the OR gate logic switch.

4. The control circuit of a multiplexing inkjet print system according to claim 1, wherein the signal generating unit comprises:

a first D-type flip-flop, the inverted output end of the first D-type flip-flop being fed back to the input end of the first D-type flip-flop, and the trigger end of the first D-type flip-flop receiving the first clock signal;

a second D-type flip-flop, connected in parallel with the first D-type flip-flop, the inverted output end of the second D-type flip-flop being fed back to the input end of the second D-type flip-flop, and the trigger end of the second D-type flip-flop receiving the first clock signal;

an OR gate logic switch, the input end of the OR gate logic switch being electrically connected to the output end of the first D-type flip-flop and the output end of the second D-type flip-flop;

a third D-type flip-flop, the input end of the third D-type flip-flop being used to receive the data; and an AND gate logic switch, the input end of the AND gate logic switch being electrically connected to the output end of the OR gate logic switch and the output end of the third D-type flip-flop, for outputting the enable signal according to the output of the OR gate logic switch and the output of the third D-type flip-flop.

5. The control circuit of a multiplexing inkjet print system according to claim 1, wherein the signal generating unit comprises:

a plurality of inverters;

a first D-type flip-flop, the output end of the first D-type flip-flop being fed back to the input end of the first D-type flip-flop via one of the inverters, and the trigger end of the first D-type flip-flop receiving the first clock signal;

a second D-type flip-flop, connected in parallel with the first D-type flip-flop, the output end of the second D-type flip-flop being fed back to the input end of the second D-type flip-flop via another inverter, and the trigger end of the second D-type flip-flop receiving the first clock signal;

an OR gate logic switch, the input end of the OR gate logic switch being electrically connected to the output end of the first D-type flip-flop and the output end of the second D-type flip-flop;

a third D-type flip-flop, the input end of the third D-type flip-flop being used to receive the data; and an AND gate logic switch, the input end of the AND gate logic switch being electrically connected to the output end of the OR gate logic switch and the output end of the third D-type flip-flop, for outputting the enable signal according to the output of the OR gate logic switch and the output of the third D-type flip-flop.

6. The control circuit of a multiplexing inkjet print system according to claim 1, wherein the shift register comprises:

i shift sub-circuits, each of the shift sub-circuits comprises:

a fourth D-type flip-flop, the trigger end of the fourth D-type flip-flop receiving the second clock signal; and a fifth D-type flip-flop, the input end of the fifth D-type flip-flop being electrically connected to the output end of the fourth D-type flip-flop, and the trigger end of the fifth D-type flip-flop being used to receive the enable signal, so as to output the address signal according to the output of the fourth D-type flip-flop and the enable signal;

wherein in the first shift sub-circuit, the input end of the fourth D-type flip-flop is used to receive the data; and in the second shift sub-circuit to the $(i-1)^{th}$ shift sub-circuit, the output end of the fourth D-type flip-flop is electrically connected to the input end of the fourth D-type flip-flop of the next shift sub-circuit.

7. The control circuit of a multiplexing inkjet print system according to claim 1, wherein the counter comprises:

a plurality of counting sub-circuits, each of the counting sub-circuits comprising:

a sixth D-type flip-flop, the inverted output end of the sixth D-type flip-flop being fed back to the input end of the sixth D-type flip-flop;

wherein in the first counting sub-circuit, the trigger end of the sixth D-type flip-flop is used to receive the enable signal and accordingly output the time counting signal; and wherein in the second counting sub-circuit to the counting sub-circuit in the last stage, each of the counting sub-circuit further comprises:

an AND gate logic switch, the output end of the AND gate logic switch being electrically connected to the trigger end of the sixth D-type flip-flop; and the sixth D-type flip-flop being used to output the time counting signal according to the output of the AND gate logic switch and the input of the sixth D-type flip-flop;

wherein in the second counting sub-circuit, the input end of the AND gate logic switch is electrically connected to the signal generating unit for receiving the enable signal, and is electrically connected to the output end of the sixth D-type flip-flop of the first counting sub-circuit for receiving the time counting signal;

wherein in the third counting sub-circuit, the input end of the AND gate logic switch is electrically connected to the signal generating unit for receiving the enable signal, and is electrically connected to the output end of the sixth D-type flip-flop of the second counting sub-circuit and the output end of the AND gate logic switch for receiving the time counting signal and the output of the AND gate logic switch; and wherein in the fourth counting sub-circuit to the counting sub-circuit in the last stage, the input end of each of the AND gate logic switches is electrically connected to the output end of the sixth D-type flip-flop of the counting sub-circuit in the preceding stage and the output end of the AND gate logic switch, so as to receive the time counting signal and the output of the AND gate logic switch; and the input end of each of the AND gate logic switches of the shift sub-circuit in an odd stage is further electrically connected to the output end of the AND gate logic switch of the counting sub-circuit in the preceding odd stage and to the output of the AND gate logic switch.

8. The control circuit of a multiplexing inkjet print system according to claim 1, wherein the counter comprises:

a plurality of counting sub-circuits, each of the counting sub-circuits comprises:

an inverter;

a sixth D-type flip-flop, the output end of the sixth D-type flip-flop being fed back to the input end of the sixth D-type flip-flop via the inverter;

wherein in the first counting sub-circuit, the trigger end of the sixth D-type flip-flop is used to receive the enable signal, so as to output the time counting signal; and wherein in the second counting sub-circuit to the counting sub-circuit in the last stage, each of the counting sub-circuits further comprises:

an AND gate logic switch, the output end of the AND gate logic switch being electrically connected to the trigger end of the sixth D-type flip-flop; and the sixth D-type flip-flop being used to output the time counting signal according to the output of the AND gate logic switch and the input of the sixth D-type flip-flop;

wherein in the second counting sub-circuit, the input end of the AND gate logic switch is electrically connected to the signal generating unit for receiving the enable signal, and is electrically connected to the output end of the sixth D-type flip-flop of the first counting sub-circuit for receiving the time counting signal;

wherein in the third counting sub-circuit, the input end of the AND gate logic switch is electrically connected to the signal generating unit for receiving the enable signal, and is electrically connected to the output end of the sixth D-type flip-flop of the second counting sub-circuit and the output end of the AND gate logic switch for receiving the time counting signal and the output of the AND gate logic switch; and wherein in the fourth counting sub-circuit to the counting sub-circuit in the last stage, the input end of each of the AND gate logic switches is electrically connected to the output end of the sixth D-type flip-flop of the counting sub-circuit in the preceding stage and to the output end of the AND gate logic switch, so as to receive the time counting signal and the output of the AND gate logic switch; and the input end of each of the AND gate logic switches of the shift sub-circuit in an odd stage is further electrically connected to the output end of the AND gate logic switch of the counting sub-circuit in the preceding odd stage and to the output of the AND gate logic switch.

9. The control circuit of a multiplexing inkjet print system according to claim 1, further comprising:

at least one AND gate logic switch, electrically connected to the shift register and the decoders, each of the AND gate logic switches being used to perform a logic operation on one of the address signals and one of the start signals of each group, so as to generate a drive signal, thereby driving the corresponding heater circuit.

10. The control circuit of a multiplexing inkjet print system according to claim 9, wherein the number of the AND gate logic switches is the product of the number of the address signals and the number of the start signals of each group.

11. A control circuit of a multiplexing inkjet print system, for driving at least one heater circuit, comprising:

a signal generating unit, for generating an enable signal according to a first clock signal and a data;

a shift register, for shifting the data according to the first clock signal and a third clock signal, so as to generate i address signals, wherein i is a positive integer;

a counter, electrically connected to the signal generating unit, for counting according to the enable signal, so as to generate a plurality of time counting signals; and N decoders, electrically connected to the counter, for respectively receiving a portion of the time counting signals, wherein each of the decoders is used to decode the received time counting signals to generate a plurality of start signals, and N is a positive integer equal to or greater than 2;

wherein the drive control of the heater circuit is achieved through the address signals and N groups of the start signals.

12. The control circuit of a multiplexing inkjet print system according to claim 11, wherein the signal generating unit comprises:

a first D-type flip-flop, the inverted output end of the first D-type flip-flop being fed back to the input end of the first D-type flip-flop, and the trigger end of the first D-type flip-flop receiving the first clock signal;

a second D-type flip-flop, connected in parallel with the first D-type flip-flop, the inverted output end of the second D-type flip-flop being fed back to the input end of the second D-type flip-flop, and the trigger end of the second D-type flip-flop receiving the first clock signal;

an OR gate logic switch, the input end of the OR gate logic switch being electrically connected to the output end of the first D-type flip-flop and the output end of the second D-type flip-flop; and an AND gate logic switch, for outputting the enable signal according to the date and the output of the OR gate logic switch.

13. The control circuit of a multiplexing inkjet print system according to claim 11, wherein the signal generating unit comprises:

a plurality of inverters;

a first D-type flip-flop, the output end of the first D-type flip-flop being fed back to the input end of the first D-type flip-flop via one of the inverters, and the trigger end of the first D-type flip-flop receiving the first clock signal;

a second D-type flip-flop, connected in parallel with the first D-type flip-flop, the output end of the second D-type flip-flop being fed back to the input end of the second D-type flip-flop via another inverter, and the trigger end of the second D-type flip-flop receiving the first clock signal;

an OR gate logic switch, the input end of the OR gate logic switch being electrically connected to the output end of the first D-type flip-flop and the output end of the second D-type flip-flop; and an AND gate logic switch, for outputting the enable signal according to the data and the output of the OR gate logic switch.

14. The control circuit of a multiplexing inkjet print system according to claim 11, where in the signal generating unit comprises:

a first D-type flip-flop, the inverted output end of the first D-type flip-flop being fed back to the input end of the first D-type flip-flop, and the trigger end of the first D-type flip-flop receiving the first clock signal;

a second D-type flip-flop, connected in parallel with the first D-type flip-flop, the inverted output end of the second D-type flip-flop being fed back to the input end of the second D-type flip-flop, and the trigger end of the second D-type flip-flop receiving the first clock signal;

an OR gate logic switch, the input end of the OR gate logic switch being electrically connected to the output end of the first D-type flip-flop and the output end of the second D-type flip-flop;

a third D-type flip-flop, the input end of the third D-type flip-flop being used to receive the data; and an AND gate logic switch, the input end of the AND gate logic switch being electrically connected to the output end of the OR gate logic switch and the output end of the third D-type flip-flop, for outputting the enable signal according to the output of the OR gate logic switch and the output of the third D-type flip-flop.

15. The control circuit of a multiplexing inkjet print system according to claim 11, wherein the signal generating unit comprises:

a plurality of inverters;

a first D-type flip-flop, the output end of the first D-type flip-flop being fed back to the input end of the first D-type flip-flop via one of the inverters, and the trigger end of the first D-type flip-flop receiving the first clock signal;

a second D-type flip-flop, connected in parallel with the first D-type flip-flop, the output end of the second D-type flip-flop being fed back to the input end of the second D-type flip-flop via another inverter, and the trigger end of the second D-type flip-flop receiving the first clock signal;

an OR gate logic switch, the input end of the OR gate logic switch being electrically connected to the output end of the first D-type flip-flop and the output end of the second D-type flip-flop;

a third D-type flip-flop, wherein the input end of the third D-type flip-flop is used to receive the data; and an AND gate logic switch, the input end of the AND gate logic switch being electrically connected to the output end of the OR gate logic switch and the output end of the third D-type flip-flop, for outputting the enable signal according to the output of the OR gate logic switch and the output of the third D-type flip-flop.

16. The control circuit of a multiplexing inkjet print system according to claim 11, wherein the shift register comprises:

i shift sub-circuits, each of the shift sub-circuits comprises:

a fourth D-type flip-flop, the trigger end of the fourth D-type flip-flop receiving the third clock signal; and a fifth D-type flip-flop, the input end of the fifth D-type flip-flop being electrically connected to the output end of the fourth D-type flip-flop, and the trigger end of the fifth D-type flip-flop being used to receive the first clock signal, so as to output the address signal according to the output of the fourth D-type flip-flop and the first clock signal;

wherein in the first and the second shift sub-circuits, the input end of the fourth D-type flip-flop is used to receive the data; and in the third shift sub-circuit to the $(i-1)^{th}$ shift sub-circuit, the output end of the fourth D-type flip-flop of the shift sub-circuit in an odd stage is electrically connected to the input end of the fourth D-type flip-flop of the shift sub-circuit in the next odd stage, and the output end of the fourth D-type flip-flop of the shift sub-circuit in an even stage is electrically connected to the input end of the fourth D-type flip-flop of the shift sub-circuit in the next even stage.

17. The control circuit of a multiplexing inkjet print system according to claim 11, wherein the counter comprises:

a plurality of counting sub-circuits, each of the counting sub-circuits comprising:

a sixth D-type flip-flop, the inverted output end of the sixth D-type flip-flop being fed back to the input end of the sixth D-type flip-flop;

wherein in the first counting: sub-circuit, the trigger end of the sixth D-type flip-flop is used to receive the enable signal, so as to output the time counting signal; and wherein in the second counting sub-circuit to the counting sub-circuit in the last stage, each of the counting sub-circuits further comprises:

an AND gate logic switch, the output end of the AND gate logic switch being electrically connected to the trigger end of the sixth D-type flip-flop; and the sixth D-type flip-flop being used to output the time counting signal according to the output of the AND gate logic switch and the input of the sixth D-type flip-flop;

wherein in the second counting sub-circuit, the input end of the AND gate logic switch is electrically connected to the signal generating unit for receiving the enable signal, and is electrically connected to the output end of the sixth D-type flip-flop of the first counting sub-circuit for receiving the time counting signal;

wherein in the third counting sub-circuit, the input end of the AND gate logic switch is electrically connected to the signal generating unit for receiving the enable signal, and is electrically connected to the output end of the sixth D-type flip-flop of the second counting sub-circuit and the output end of the AND gate logic switch for receiving the time counting signal and the output of the AND gate logic switch; and wherein in the fourth counting sub-circuit to the counting sub-circuit in the last stage, the input end of each of the AND gate logic switches is electrically connected to the output end of the sixth D-type flip-flop of the counting sub-circuit in the preceding stage and to the output end of the AND gate logic switch, so as to receive the time counting signal and the output of the AND gate logic switch; and the input end of each of the AND gate logic switches of the shift sub-circuit in an odd stage is further electrically connected to the output end of the AND gate logic switch of the counting sub-circuit in the preceding odd stage and to-the output of the AND gate logic switch.

18. The control circuit of a multiplexing inkjet print system according to claim 11, wherein the counter comprises:

a plurality of counting sub-circuits, each of the counting sub-circuits comprising:

an inverter;

a sixth D-type flip-flop, the output end of the sixth D-type flip-flop being fed back to the input end of the sixth D-type flip-flop via the inverter;

wherein in the first counting sub-circuit, the trigger end of the sixth D-type flip-flop is used to receive the enable signal, so as to output the time counting signal; and wherein in the second counting sub-circuit to the counting sub-circuit in the last stage, each of the counting sub-circuits further comprises:

an AND gate logic switch, the output end of the AND gate logic switch being electrically connected to the trigger end of the sixth D-type flip-flop; and the sixth D-type flip-flop being used to output the time counting signal according to the output of the AND gate logic switch and the input of the sixth D-type flip-flop;

wherein in the second counting sub-circuit, the input end of the AND gate logic switch is electrically connected to the signal generating unit for receiving the enable signal, and is electrically connected to the output end of the sixth D-type flip-flop of the first counting sub-circuit for receiving the time counting signal;

wherein in the third counting sub-circuit, the input end of the AND gate logic switch is electrically connected to the signal generating unit for receiving the enable signal, and is electrically connected to the output end of the sixth D-type flip-flop of the second counting sub-circuit and the output end of the AND gate logic switch for receiving the time counting signal and the output of the AND gate logic switch; and wherein in the fourth counting sub-circuit to the counting sub-circuit in the last stage, the input end of each of the AND gate logic switches is electrically connected to the output end of the sixth D-type flip-flop of the counting sub-circuit in the preceding stage and to the output end of the AND gate logic switch, so as to receive the time counting signal and the output of the AND gate logic switch; and the input end of each of the AND gate logic switches of the shift sub-circuit in an odd stage is further electrically connected to the output end of the AND gate logic switch of the counting sub-circuit in the preceding odd stage and to the output of the AND gate logic switch.

19. The control circuit of a multiplexing inkjet print system according to claim 11, further comprising:

a plurality of AND gate logic switches, electrically connected to the shift register and the decoders, each of the AND gate logic switches being used to perform logic operation on one of the address signals and one of the start signals of each group, so as to generate a drive signal, thereby driving the corresponding heater circuit.

20. The control circuit of a multiplexing inkjet print system according to claim 11, wherein the number of the AND gate logic switches is the product of the number of the address signals and the number of the start signals of each group.

21. The control circuit of a multiplexing inkjet print system according to claim 11, wherein the third clock signal is half of the first clock signal.

22. A circuit of a multiplexing inkjet print system, for driving a plurality of jet orifices, comprising:

a control circuit, comprising:

a signal generating unit, for generating an enable signal according to a first clock signal and a data;

a shift register, electrically connected to the signal generating unit, for shifting the data according to the enable signal and a second clock signal, so as to generate i address signals, wherein i is a positive integer;

a counter, electrically connected to the signal generating unit, for counting according to the enable signal, so as to generate a plurality of time counting signals; and N decoders, electrically connected to the counter, for respectively receiving a portion of the time counting signals, wherein each of the decoders is used to decode the received time counting signals to generate a plurality of start signals, and N is a positive integer equal to or greater than 2; and an inkjet module, comprising at least one heater circuit corresponding to the jet orifices, wherein each of the heater circuits comprises:

an AND gate logic switch, electrically connected to the shift register and the decoders, for performing a logic operation on one of the address signals and one of the start signals of each group, so as to generate a drive signal;

a transistor switch, the gate of the transistor switch being electrically connected to the output end of the AND gate logic switch, so as to be turned on according to the drive signal; and a resistance element, one end of the resistance element being electrically connected to the drain of the transistor switch, and the other end being used to receive an appropriate voltage or current, so as to generate heat when the transistor switch is turned on, thereby driving the corresponding jet orifice.

23. The circuit of a multiplexing inkjet print system according to claim 22, wherein the signal generating unit comprises:

a first D-type flip-flop, the inverted output end of the first D-type flip-flop being fed back to the input end of the first D-type flip-flop, and the trigger end of the first D-type flip-flop receiving the first clock signal;

a second D-type flip-flop, connected in parallel with the first D-type flip-flop, the inverted output end of the second D-type flip-flop being fed back to the input end of the second D-type flip-flop, and the trigger end of the second D-type flip-flop receiving the first clock signal;

an OR gate logic switch, wherein the input end of the OR gate logic switch is electrically connected to the output end of the first D-type flip-flop and the output end of the second D-type flip-flop; and an AND gate logic switch, for outputting the enable signal according to the data and the output of the OR gate logic switch.

24. The circuit of a multiplexing inkjet print system according to claim 22, wherein the signal generating unit comprises:

a plurality of inverters;

a first D-type flip-flop, the output end of the first D-type flip-flop being fed back to the input end of the first D-type flip-flop via one of the inverters, and the trigger end of the first D-type flip-flop receiving the first clock signal;

a second D-type flip-flop, connected in parallel with the first D-type flip-flop, the output end of the second D-type flip-flop being fed back to the input end of the second D-type flip-flop via another inverter, and the trigger end of the second D-type flip-flop receiving the first clock signal;

an OR gate logic switch, the input end of the OR gate logic switch being electrically connected to the output end of the first D-type flip-flop and the output end of the second D-type flip-flop; and an AND gate logic switch, for outputting the enable signal according to the data and the output of the OR gate logic switch.

25. The circuit of a multiplexing inkjet print system according to claim 22, wherein the signal generating unit comprises:, a first D-type flip-flop, the inverted output end of the first D-type flip-flop being fed back to the input end of the first D-type flip-flop, and the trigger end of the first D-type flip-flop receiving the first clock signal;

a second D-type flip-flop, connected in parallel with the first D-type flip-flop, the inverted output end of the second D-type flip-flop being fed back to the input end of the second D-type flip-flop, and the trigger end of the second D-type flip-flop receiving the first clock signal;

an OR gate logic switch, the input end of the OR gate logic switch being electrically connected to the output end of the first D-type flip-flop and the output end of the second D-type flip-flop;

a third D-type flip-flop, the input end of the third D-type flip-flop being used to receive the data; and an AND gate logic switch, the input end of the AND gate logic switch being electrically connected to the output end of the OR gate logic switch and the output end of the third D-type flip-flop, for outputting the enable signal according to the output of the OR gate logic switch and the output of the third D-type flip-flop.

26. The circuit of a multiplexing inkjet print system according to claim 22, wherein the signal generating unit comprises:

a plurality of inverters;

a first D-type flip-flop, the inverted output end of the first D-type flip-flop being fed back to the input end of the first D-type flip-flop, and the trigger end of the first D-type flip-flop receiving the first clock signal;

a second D-type flip-flop, connected in parallel with the first D-type flip-flop, the output end of the second D-type flip-flop being fed back to the input end of the second D-type flip-flop via another inverter, and the trigger end of the second D-type flip-flop receiving the first clock signal;

an OR gate logic switch, the input end of the OR gate logic switch being electrically connected to the output end of the first D-type flip-flop and the output end of the second D-type flip-flop;

a third D-type flip-flop, the input end of the third D-type flip-flop being used to receive the data; and an AND gate logic switch, the input end of the AND gate logic switch being electrically connected to the output end of the OR gate logic switch and the output end of the third D-type flip-flop, for outputting the enable signal according to the output of the OR gate logic switch and the output of the third D-type flip-flop.

27. The circuit of a multiplexing inkjet print system according to claim 22, wherein the shift register comprises:

i shift sub-circuits, each of the shift sub-circuits comprising:

a fourth D-type flip-flop, the trigger end of the fourth D-type flip-flop receiving the second clock signal; and a fifth D-type flip-flop, the input end of the fifth D-type flip-flop being electrically connected to the output end of the fourth D-type flip-flop, and the trigger end of the fifth D-type flip-flop being used to receive the enable signal, so as to output the address signal according to the output of the fourth D-type flip-flop and the enable signal;

wherein in the first shift sub-circuit, the input end of the fourth D-type flip-flop is used to receive the data; and in the second shift sub-circuit to the $(i-1)^{th}$ shift sub-circuit, the output end of the fourth D-type flip-flop is electrically connected to the input end of the fourth D-type flip-flop of the next shift sub-circuit.

28. The circuit of a multiplexing inkjet print system according to claim 22, wherein the counter comprises:

a plurality of counting sub-circuits, each of the counting sub-circuits comprising:

a sixth D-type flip-flop, the inverted output end of the sixth D-type flip-flop being fed back to the input end of the sixth D-type flip-flop;

wherein in the first counting sub-circuit, the trigger end of the sixth D-type flip-flop is used to receive the enable signal, so as to output the time counting signal; and wherein in the second counting sub-circuit to the counting sub-circuit in the last stage, each of the counting sub-circuits further comprises:

an AND gate logic switch, the output end of the AND gate logic switch being electrically connected to the trigger end of the sixth D-type flip-flop; and the sixth D-type flip-flop being used to output the time counting signal according to the output of the AND gate logic switch and the input of the sixth D-type flip-flop;

wherein in the second counting sub-circuit, the input end of the AND gate logic switch is electrically connected to the signal generating unit for receiving the enable signal, and is electrically connected to the output end of the sixth D-type flip-flop of the first counting sub-circuit for receiving the time counting signal;

wherein in the third counting sub-circuit, the input end of the AND gate logic switch is electrically connected to the signal generating unit for receiving the enable signal, and is electrically connected to the output end of the sixth D-type flip-flop of the second counting sub-circuit and the output end of the AND gate logic switch for receiving the time counting signal and the output of the AND gate logic switch; and wherein in the fourth counting sub-circuit to the counting sub-circuit in the last stage, the input end of each of the AND gate logic switches is electrically connected to the output end of the sixth D-type flip-flop of the counting sub-circuit in the preceding stage and to the output end of the AND gate logic switch, so as to receive the time counting signal and the output of the AND gate logic switch; and the input end of each of the AND gate logic switches of the shift sub-circuit in an odd stage is further electrically connected to the output end of the AND gate logic switch of the counting sub-circuit in the preceding odd stage and to the output of the AND gate logic switch.

29. The circuit of a multiplexing inkjet print system according to claim 22, wherein the counter comprises:

a plurality of counting sub-circuits, each of the counting sub-circuits comprising:

an inverter;

a sixth D-type flip-flop, the output end of the sixth D-type flip-flop being fed back to the input end of the sixth D-type flip-flop via the inverter;

wherein in the first counting sub-circuit, the trigger end of the sixth D-type flip-flop is used to receive the enable signal, so as to output the time counting signal; and wherein in the second counting sub-circuit to the counting sub-circuit in the last stage, each of the counting sub-circuits further comprises:

an AND gate logic switch, the output end of the AND gate logic switch being electrically connected to the trigger end of the sixth D-type flip-flop; and the sixth D-type flip-flop being used to output the time counting signal according to the output of the AND gate logic switch and the input of the sixth D-type flip-flop;

wherein in the second counting sub-circuit, the input end of the AND gate logic switch is electrically connected to the signal generating unit for receiving the enable signal, and is electrically connected to the output end of the sixth D-type flip-flop of the first counting sub-circuit for receiving the time counting signal;

wherein in the third counting sub-circuit, the input end of the AND gate logic switch is electrically connected to the signal generating unit for receiving the enable signal, and is electrically connected to the output end of the sixth D-type flip-flop of the second counting sub-circuit and the output end of the AND gate logic switch for receiving the time counting signal and the output of the AND gate logic switch; and wherein in the fourth counting sub-circuit to the counting sub-circuit in the last stage, the input end of each of the AND gate logic switches is electrically connected to the output end of the sixth D-type flip-flop of the counting sub-circuit in the preceding stage and to the output end of the AND gate logic switch, so as to receive the time counting signal and the output of the AND gate logic switch; and the input end of each of the AND gate logic switches of the shift sub-circuit in an odd stage is further electrically connected to the output end of the AND gate logic switch of the counting sub-circuit in the preceding odd stage and to the output of the AND gate logic switch.

30. The circuit of a multiplexing inkjet print system according to claim 22, wherein the transistor switch is an asymmetric metal-oxide-semiconductor field-effect transistor (MOSFET).

31. The circuit of a multiplexing inkjet print system according to claim 22, wherein the transistor switch is an FET with a high channel width-to-length ratio.

32. A circuit of a multiplexing inkjet print system, for driving a plurality of jet orifices, comprising:

a control circuit, comprising:

a signal generating unit, for generating an enable signal according to a first clock signal and a data;

a shift register, for shifting the data according to the first clock signal and a third clock signal, so as to generate i address signals, wherein i is a positive integer;

a counter, electrically connected to the signal generating unit, for counting according to the enable signal, so as to generate a plurality of time counting signals; and N decoders, electrically connected to the counter, for respectively receiving a portion of the time counting signals, wherein each of the decoders is used to decode the received time counting signals to generate a plurality of start signals, and N is a positive integer equal to or greater than 2; and an inkjet module, comprising at least one heater circuit corresponding to the jet orifices, wherein each of the heater circuits comprises:

an AND gate logic switch, electrically connected to the shift register and the decoders, for performing a logic operation on one of the address signals and one of the start signals of each group, so as to generate a drive signal;

a transistor switch, the gate of the transistor switch being electrically connected to the output end of the AND gate logic switch, so as to be turned on according to the drive signal; and a resistance element, one end of the resistance element being electrically connected to the drain of the transistor switch, and the other end is used to receive an appropriate voltage or current, so as to generate heat when the transistor switch is turned on, thereby driving the corresponding jet orifice.

33. The circuit of a multiplexing inkjet print system according to claim 32, wherein the signal generating unit comprises:

a first D-type flip-flop, the inverted output end of the first D-type flip-flop being fed back to the input end of the first D-type flip-flop, and the trigger end of the first D-type flip-flop receiving the first clock signal;

a second D-type flip-flop, connected in parallel with the first D-type flip-flop, the inverted output end of the second D-type flip-flop being fed back to the input end of the second D-type flip-flop, and the trigger end of the second D-type flip-flop receiving the first clock signal;

an OR gate logic switch, wherein the input end of the OR gate logic switch is electrically connected to the output end of the first D-type flip-flop and the output end of the second D-type flip-flop; and an AND gate logic switch, for outputting the enable signal according to the data and the output of the OR gate logic switch.

34. The circuit of a multiplexing inkjet print system according to claim 32, wherein the signal generating unit comprises:

a plurality of inverters;

a first D-type flip-flop, the output end of the first D-type flip-flop being fed back to the input end of the first D-type flip-flop via one of the inverters, and the trigger end of the first D-type flip-flop receiving the first clock signal;

a second D-type flip-flop, connected in parallel with the first D-type flip-flop, the output end of the second D-type flip-flop being fed back to the input end of the second D-type flip-flop via another inverter, and the trigger end of the second D-type flip-flop receiving the first clock signal;

an OR gate logic switch, the input end of the OR gate logic switch being electrically connected to the output end of the first D-type flip-flop and the output end of the second D-type flip-flop; and an AND gate logic switch, for outputting the enable signal according to the data and the output of the OR gate logic switch.

35. The circuit of a multiplexing inkjet print system according to claim 32, wherein the signal generating unit comprises:

a first D-type flip-flop, the inverted output end of the first D-type flip-flop being fed back to the input end of the first D-type flip-flop, and the trigger end of the first D-type flip-flop receiving the first clock signal;

a second D-type flip-flop, connected in parallel with the first D-type flip-flop, the inverted output end of the second D-type flip-flop being fed back to the input end of the second D-type flip-flop, and the trigger end of the second D-type flip-flop receiving the first clock signal;

an OR gate logic switch, the input end of the OR gate logic switch being electrically connected to the output end of the first D-type flip-flop and the output end of the second D-type flip-flop;

a third D-type flip-flop, the input end of the third D-type flip-flop being used to receive the data; and an AND gate logic switch, wherein the input end of the AND gate logic switch is electrically connected to the output end of the OR gate logic switch and the output end of the third D-type flip-flop, for outputting the enable signal according to the output of the OR gate logic switch and the output of the third D-type flip-flop.

36. The circuit of a multiplexing inkjet print system according to claim 32, wherein the signal generating unit comprises:

a plurality of inverters;

a first D-type flip-flop, the output end of the first D-type flip-flop being fed back to the input end of the first D-type flip-flop via one of the inverters, and the trigger end of the first D-type flip-flop receiving the first clock signal;

a second D-type flip-flop, connected in parallel with the first D-type flip-flop, the output end of the second D-type flip-flop being fed back to the input end of the second D-type flip-flop via another inverter, and the trigger end of the second D-type flip-flop receiving the first clock signal;

an OR gate logic switch, the input end of the OR gate logic switch being electrically connected to the output end of the first D-type flip-flop and the output end of the second D-type flip-flop;

a third D-type flip-flop, the input end of the third D-type flip-flop being used to receive the data; and an AND gate logic switch, the input end of the AND gate logic switch being electrically connected to the output end of the OR gate logic switch and the output end of the third D-type flip-flop, for outputting the enable signal according to the output of the OR gate logic switch and the output of the third D-type flip-flop.

37. The circuit of a multiplexing inkjet print system according to claim 32, wherein the shift register comprises:

i shift sub-circuits, each of the shift sub-circuits comprising:

a fourth D-type flip-flop, the trigger end of the fourth D-type flip-flop receiving the third clock signal; and a fifth D-type flip-flop, the input end of the fifth D-type flip-flop being electrically connected to the output end of the fourth D-type flip-flop, and the trigger end of the fifth D-type flip-flop being used to receive the first clock signal, so as to output the address signal according to the output of the fourth D-type flip-flop and the first clock signal;

wherein in the first and the second shift sub-circuits, the input end of the fourth D-type flip-flop is used to receive the data; and in the third shift sub-circuit to the $(i-1)^{th}$ shift sub-circuit, the output end of the fourth D-type flip-flop of the shift sub-circuit in an odd stage is electrically connected to the input end of the fourth D-type flip-flop of the shift sub-circuit in the next odd stage, and the output end of the fourth D-type flip-flop of the shift sub-circuit in an even stage is electrically connected to the input end of the fourth D-type flip-flop of the shift sub-circuit in the next even stage.

38. The circuit of a multiplexing inkjet print system according to claim 32, wherein the counter comprises:

a plurality of counting sub-circuits, each of the counting sub-circuits comprising:

a sixth D-type flip-flop, the inverted output end of the sixth D-type flip-flop being fed back to the input end of the sixth D-type flip-flop;

wherein in the first counting sub-circuit, the trigger end of the sixth D-type flip-flop is used to receive the enable signal, so as to output the time counting signal; and wherein in the second counting sub-circuit to the counting sub-circuit in the last stage, each of the counting sub-circuits further comprises:

an AND gate logic switch, the output end of the AND gate logic switch being electrically connected to the trigger end of the sixth D-type flip-flop; and the sixth D-type flip-flop being used to output the time counting signal according to the output of the AND gate logic switch and the input of the sixth D-type flip-flop;

wherein in the second counting sub-circuit, the input end of the AND gate logic switch is electrically connected to the signal generating unit for receiving the enable signal, and is electrically connected to the output end of the sixth D-type flip-flop of the first counting sub-circuit for receiving the time counting signal;

wherein in the third counting sub-circuit, the input end of the AND gate logic switch is electrically connected to the signal generating unit for receiving the enable signal, and is electrically connected to the output end of the sixth D-type flip-flop of the second counting sub-circuit and the output end of the AND gate logic switch for receiving the time counting signal and the output of the AND gate logic switch; and wherein in the fourth counting sub-circuit to the counting sub-circuit in the last stage, the input end of each of the AND gate logic switches is electrically connected to the output end of the sixth D-type flip-flop of the counting sub-circuit in the preceding stage and to the output end of the AND gate logic switch, so as to receive the time counting signal and the output of the AND gate logic switch; and the input end of each of the AND gate logic switches of the shift sub-circuit in an odd stage is further electrically connected to the output end of the AND gate logic switch of the counting sub-circuit in the preceding odd stage and to the output of the AND gate logic switch.

39. The circuit of a multiplexing inkjet print system according to claim 32, wherein the counter comprises:

a plurality of counting sub-circuits, each of the counting sub-circuits comprising:

an inverter;

a sixth D-type flip-flop, the output end of the sixth D-type flip-flop being fed back to the input end of the sixth D-type flip-flop via the inverter;

wherein in the first counting sub-circuit, the trigger end of the sixth D-type flip-flop is used to receive the enable signal, so as to output the time counting signal; and wherein in the second counting sub-circuit to the counting sub-circuit in the last stage, each of the counting sub-circuits further comprises:

an AND gate logic switch, the output end of the AND gate logic switch being electrically connected to the trigger end of the sixth D-type flip-flop; and the sixth D-type flip-flop being used to output the time counting signal according to the output of the AND gate logic switch and the input of the sixth D-type flip-flop;

wherein in the second counting sub-circuit, the input end of the AND gate logic switch is electrically connected to the signal generating unit for receiving the enable signal, and is electrically connected to the output end of the sixth D-type flip-flop of the first counting sub-circuit for receiving the time counting signal;

wherein in the third counting sub-circuit, the input end of the AND gate logic switch is electrically connected to the signal generating unit for receiving the enable signal, and is electrically connected to the output end of the sixth D-type flip-flop of the second counting sub-circuit and the output end of the AND gate logic switch for receiving the time counting signal and the output of the AND gate logic switch; and wherein in the fourth counting sub-circuit to the counting sub-circuit in the last stage, the input end of each of the AND gate logic switches is electrically connected to the output end of the sixth D-type flip-flop of the counting sub-circuit in the preceding stage and to the output end of the AND gate logic switch, so as to receive the time counting signal and the output of the AND gate logic switch; and the input end of each of the AND gate logic switches of the shift sub-circuit in an odd stage is further electrically connected to the output end of the AND gate logic switch of the counting sub-circuit in the preceding odd stage and to the output of the AND gate logic switch.

40. The circuit of a multiplexing inkjet print system according to claim 32, wherein the transistor switch is an asymmetric MOSFET.

41. The circuit of a multiplexing inkjet print system according to claim 32, wherein the transistor switch is an FET, and the FET is a high-power device with a high channel width-to-length ratio.

* * * * *